US007077499B2

(12) United States Patent
Kodama et al.

(10) Patent No.: US 7,077,499 B2
(45) **Date of Patent: *Jul. 18, 2006**

(54) INK-JET RECORDING APPARATUS AND RECORDING METHOD THEREFOR

(75) Inventors: Hidetoshi Kodama, Nagano (JP); Koichiro Yokoyama, Nagano (JP); Kiyoto Komuro, Nagano (JP); Takuya Yasue, Nagano (JP); Takashi Akahane, Nagano (JP); Masahiro Isono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

This patent is subject to a terminal disclaimer.

(21) Appl. No.: 10/695,934

(22) Filed: Oct. 30, 2003

(65) Prior Publication Data

US 2005/0078147 A1 Apr. 14, 2005

Related U.S. Application Data

(63) Continuation of application No. 09/544,543, filed on Apr. 6, 2000, now Pat. No. 6,964,466.

(30) Foreign Application Priority Data

| | | |
|---|---|---|
| Apr. 6, 1999 | (JP) | 11-98380 |
| Apr. 6, 1999 | (JP) | 11-98383 |
| Jun. 2, 1999 | (JP) | 11-155100 |
| Sep. 30, 1999 | (JP) | 11-277709 |
| Sep. 30, 1999 | (JP) | 11-280549 |
| Dec. 1, 1999 | (JP) | 11-342595 |
| Apr. 5, 2000 | (JP) | 2000-103652 |
| Apr. 5, 2000 | (JP) | 2000-103689 |

(51) Int. Cl.
*B41J 2/165* (2006.01)

(52) U.S. Cl. ..... 347/36; 347/104

(58) Field of Classification Search ..... 347/22, 347/23, 32, 35–37, 104
See application file for complete search history.

(56) References Cited

U.S. PATENT DOCUMENTS

| | | | |
|---|---|---|---|
| 4,920,355 | A | 4/1990 | Katerberg |
| 5,291,227 | A | 3/1994 | Suzuki |
| 5,751,303 | A | 5/1998 | Erickson et al. |

(Continued)

FOREIGN PATENT DOCUMENTS

| | | | |
|---|---|---|---|
| EP | 0 751 476 | A2 | 1/1997 |

(Continued)

OTHER PUBLICATIONS

Japanese Office Action dated Aug. 20, 2004.

(Continued)

*Primary Examiner*—Stephen Meier
*Assistant Examiner*—Ly T. Tran
(74) *Attorney, Agent, or Firm*—Sughrue Mion, PLLC

(57) ABSTRACT

A recording head has a dot formation element array including a pluarlity of dot formation elements arranged in a first direction. A platen is operable to hold a recording medium in a position opposite to the recording head. The platen has a hole formed in a substantially center area in the first direction of the platen. The hole guides ink that has be discarded outside at least one of a leading end and a trailing end of the recording medium when data are recorded on the recording medium without leaving a margin on at least one of the leading end and the trailing end of the recording medium. The hole has a size in the first direction which is less than an entire portion of the dot formation element array.

2 Claims, 47 Drawing Sheets

U.S. PATENT DOCUMENTS

| | | | | |
|---|---|---|---|---|
| 5,844,585 | A | 12/1998 | Kurashima et al. | |
| 6,239,817 | B1 * | 5/2001 | Meyer | 347/36 |
| 6,325,489 | B1 | 12/2001 | Endo | |
| 6,352,333 | B1 * | 3/2002 | Matsumoto et al. | 347/23 |

FOREIGN PATENT DOCUMENTS

| | | | |
|---|---|---|---|
| JP | 63-299940 | A | 12/1988 |
| JP | 3-87273 | A | 4/1991 |
| JP | 3-49236 | | 5/1991 |
| JP | 3-49236 | U | 5/1991 |
| JP | 4-34274 | | 3/1992 |
| JP | 5-162886 | A | 6/1993 |
| JP | 5-169739 | A | 7/1993 |
| JP | 5-286129 | | 11/1993 |
| JP | 6-182988 | A | 7/1994 |
| JP | 7-9712 | | 1/1995 |
| JP | 7-9712 | A | 1/1995 |
| JP | 7-25007 | A | 1/1995 |
| JP | 8-58119 | | 3/1996 |
| JP | 8-156351 | A | 6/1996 |
| JP | 8-169155 | | 7/1996 |
| JP | 8-169580 | | 7/1996 |
| JP | 9-71009 | | 3/1997 |
| JP | 86004 | | 3/1997 |
| JP | 10-226059 | | 8/1998 |
| JP | 11-208040 | A | 8/1999 |
| JP | 11-291506 | | 10/1999 |
| JP | 11-321016 | | 11/1999 |

OTHER PUBLICATIONS

Japanese Office Action for JP2000-103652 issued May 13, 2004.

Japanese Office Action for JP2000-103689 issued Jun. 30, 2004.

Japanese Office Action for JP2004-072742 issued Jun. 30, 2004.

Japanese Office Action 095160, dated Apr. 5, 2000, citing references 3-49236, 4-34274, 9-86004 and 8-169580.

Patent Abstracts of Japan 08169155 Jul. 2, 1996.

Patent Abstracts of Japan 09071009 Mar. 18, 1997.

Patent Abstracts of Japan 11291506 Oct. 26, 1999.

Patent Abstracts of Japan 09086004 Mar. 31, 1997.

Patent Abstracts of Japan 08169580 Jul. 7, 1996.

* cited by examiner

FIRST PAPER REMOVAL ROUTINE

INK-JET RECORDING APPARATUS AND RECORDING METHOD THEREFOR

This is a continuation of application Ser. No. 09/544,543, filed Apr. 6, 2000 now U.S. Pat. No. 6,964,466; the disclosure of which is incorporated herein by reference.

FIELD OF THE INVENTION

The present invention relates to an ink-jet recording apparatus, and more particularly, to an ink-jet recording apparatus having the function of recording without leaving blank space on at least one of the areas above, below, and on either side of a recording medium, as well as to a recording method for use with the apparatus.

BACKGROUND OF THE INVENTION

An example structure of a presently-known platen of an ink-jet recording apparatus will now be described. The ink-jet recording head has a dot formation element array (hereinafter referred to as a "nozzle array") in which a plurality of dot formation elements (hereinafter referred to as "nozzles") are arranged in a secondary scanning direction. A platen is provided opposite the recording head and functions to hold recording paper in position during a recording operation performed by a printer. A plurality of ribs are provided on the surface of the platen at given intervals in the primary scanning direction. Flat surfaces of the ribs support the recording paper, thus holding the recording paper in position relative to the recording head.

In a normal printing operation of the ink-jet recording apparatus, data are printed while the top and bottom margins of the recording paper are maintained blank. However, on some occasions, data are printed from the top end of the recording paper without leaving a margin. In a case where data are printed without leaving a margin (hereinafter often called "margin-free printing"), a presently-known platen structure cannot prevent the ink squirted outside the top end of the recording paper (hereinafter referred to as "discarded ink") from adhering to the surface of the platen. The ink which has adhered to the platen adheres to another sheet of recording paper, thus making a stain on the other sheet of recording paper.

To prevent occurrence of such a stain, there has already been proposed a printer in which a large hole is formed in the surface of the platen so as to extend over the entire area of the surface opposite the nozzle array of the recording head. The discarded ink is received by the large hole, thus preventing adherence of the discarded ink to the platen. However, presence of the large hole makes the leading edge of recording paper supplied by a paper feed roller (which may also be called a roller for feeding the recording medium) likely to collide with the wall of the large hole. In the event of such a collision, a so-called paper jam is likely to arise at this location. Further, the presence of a large hole results in the platen encountering difficulty in firmly supporting recording paper in a position opposite the nozzle array, thereby resulting in a change in the distance between the recording head and the recording paper. Consequently, print quality is deteriorated.

These problems arise even in a case where data are printed without leaving an end margin on recording paper. Problems resulting from data being printed without leaving an end margin are in principle the same as those arising in a case where data are printed from a top end of recording paper without leaving a margin, and hence repeated explanations of the problems are omitted.

Japanese Patent Laid-Open No. 169155/1996 describes a printer as an example ink-jet recording apparatus of the background art capable of printing data on a recording material without leaving a margin on either side of the recording medium.

In order to enable printing which eliminates a margin on either side of the recording medium, an ink-jet recording head of this printer is arranged so that the primary scanning range can be set to extend outside either side of the recording medium. Further, the printer is equipped with ink recovery means for recovering ink droplets squirted from the recording head at positions outside either side of the recording medium.

The above-described printer is a printer specifically designed for use in printing in which the printing medium ultimately assumes solid form; for example, solid and compact coating of a recording medium, such as a tape. The problems solved by the printer are elimination of non-coated areas from a tape during a solid coating process and staining of a recording medium to be transported, which would otherwise be caused when the ink droplets squirted during the solid coating process adhere to a guide member or a like member.

Therefore, the following technical demands are not taken into consideration in the design of this printer: a demand for enabling easy and reliable printing of an image of a certain photographic image data set on paper while leaving a margin on either side of the paper, and printing of the photographic image on paper of the same size while leaving a margin on either side of the paper (hereinafter often called a "lateral-margin-free printing"); and a demand for sufficiently reducing the portion of image data, which would be located outside either side edge of the paper and discarded when the image data are printed without leaving a margin on either side of the paper, to thereby effectively print the image data so as to minimize wastage of image data during lateral-margin-free printing. Lateral-margin-free printing of text data must inevitably be avoided. However, the printer of the background art fails to refer to or even suggest lateral-margin-free printing of text data.

The ink recovery means of the background art can recover the ink droplets squirted outside the edges of paper. However, the ink recovery means is not designed in consideration of preventing minute staining of paper edges, which would otherwise be caused by airborne ink mist stemming from discarded ink droplets. The airborne ink mist arises during the course of squirting of ink droplets. Hence, in a case where ink droplets are squirted over a long distance, airborne ink mist is likely to arise. Further, in a case where paper is carried while being laid on a mesh screen or a like component, a portion of ink collides with not perforations of the mesh screen but with the framework of the mesh screen, also causing airborne ink mist. An ink-jet recording apparatus capable of effecting printing of photographic quality is highly susceptible to influence of deterioration of print quality stemming from airborne ink mist.

Accordingly, the present invention is aimed at providing an ink-jet recording apparatus which records data on a recording medium without leaving a margin on the top end, a margin on the bottom end, or a margin on either side edge and without involvement of staining of the recording medium, which would otherwise be caused by discarded ink; which firmly supports the recording medium; which holds the recording medium in position during a recording operation; and which prevents deterioration of recording quality, as well as a recording method for use with the ink-jet recording apparatus.

The present invention is also aimed at providing an ink-jet recording apparatus which can readily and unfailingly record a certain photographic image data set on paper while leaving a margin on either side of the paper and which can readily and unfailingly record the image data set on paper of the same size without leaving a margin on either side of the paper; and which sufficiently reduces a portion of the image data set, which would be formed outside either side of the paper when the image data are recorded without leaving a margin on either side of the paper, to thereby minimize wastage of image data and enable effective recording of image data even at the time of recording of image data without leaving a margin, as well as a recording method for use with the ink-jet recording apparatus.

The present invention is further aimed at providing an ink-jet recording apparatus capable of diminishing the chance of occurrence of airborne ink mist and the chance of side portions of a recording medium being stained by airborne floating mist; in other words, capable of maintaining photograph-quality printing even in the side portions of the recording medium, and diminishing the chance of deterioration of print quality.

The present invention is further aimed at providing an ink-jet recording apparatus capable of simultaneously fulfilling the features of the ink-jet recording apparatus and those of recording methods, as described above.

SUMMARY OF THE INVENTION

To achieve the objects, the present invention provides an ink-jet recording apparatus comprising:

a recording head having a dot formation element array including a plurality of dot, formation elements arranged along a secondary scanning direction;

a platen for holding a recording medium in position opposite the recording head during a printing operation while the recording head is caused to scan in a primary scanning direction;

a recording-medium feed roller disposed upstream of the recording head;

an output roller disposed downstream of the recording head; and a first hole which is formed in an area of the platen opposite a downstream portion of the dot formation element array with respect to the secondary scanning direction, the platen guiding to the first hole the ink that has been discarded outside a top end of the recording medium when data are recorded on the recording medium without leaving a margin on the top end of the recording medium.

In the present invention, the first hole is not formed over the 25 entire surface of the platen but locally at a position corresponding to the top end of a recording material when data are recorded on the recording medium without leaving a margin on the top end. A positioning-function section for holding the recording material in position is left in the area on the surface of the platen opposite the recording head. When data are recorded on the recording medium without leaving a margin on the top end of the recording medium, the ink squirted outside the top end is guided to the first hole. The recording material is firmly held in position relative to the recording head. In a case where data are recorded on the recording medium without leaving a margin on the top end of the recording medium, the chance of the recording material being stained with the thus-discarded ink is significantly lowered. During a printing operation, the recording material is firmly held in position, thus preventing a decrease in quality.

The present invention further provides an ink-jet recording apparatus comprising:

a recording head having a dot formation element array including a plurality of dot formation elements arranged along a secondary scanning direction;

a platen for holding a recording medium in position opposite the recording head during a printing operation while the recording head is caused to scan in a primary scanning direction;

a recording-medium feed roller disposed upstream of the recording head;

an output roller disposed downstream of the recording head; and a second hole which is formed in an area of the platen opposite an upstream portion of the dot formation element array with respect to the secondary scanning direction, the platen guiding to the second hole the ink that has been discarded outside a top end of the recording medium when data are recorded on the recording medium without leaving a margin on the top end of the recording medium.

In the present invention, the second hole is not formed over the entire surface of the platen but locally at a position corresponding to the top end of a recording material when data are recorded on the recording medium without leaving a margin on the top end. A positioning-function section for holding the recording material in position is left in the area on the surface of the platen opposite the recording head. When data are recorded on the recording medium without leaving a margin on the top end of the recording medium, the ink squirted outside the top end is guided to the second hole. The recording material is firmly held in position relative to the recording head. In a case where data are recorded on the recording medium without leaving a margin on the top end of the recording medium, the chance of the recording material being stained with the thus-discarded ink. During a printing operation, the recording material is firmly held in position, thus preventing a decrease in quality.

Preferably, a second hole is formed in an area of the platen opposite an upstream portion of the dot formation element array with respect to the secondary scanning direction, and there is guided to the second hole the ink that has been discarded outside a top end of the recording medium when data are recorded on the recording medium without leaving a margin on the top end of the recording medium.

As a result, in a case where data are recorded on the recording medium without leaving a margin on the top end and bottom end of the recording medium, the chance of the recording material being stained with the thus-discarded ink. During a printing operation, the recording material is firmly held in position, thus preventing a decrease in quality.

Preferably, the recording head is arranged so as to be able to selectively perform a standard interlaced recording operation for recording data by actuation of all the dot formation elements of the dot formation element array, and a limited interlaced recording operation for limitedly actuating a portion of the dot formation elements, through use of a dot drive control section, and the limited interlaced recording operation is performed when the top end of the recording medium is situated at the first hole and when the bottom end of the recording medium is situated at the second hole.

In a case where data are recorded on the recording medium without leaving a margin on the top end and bottom end of the recording medium, the limited interlaced recording operation is performed, thereby reducing the amount of ink to be discarded and the amount of image data to be discarded along with wastage of the ink. Therefore, the extent of paper cockle arising in the top or bottom end can be diminished. In the areas of the recording material other than the top end and bottom end thereof, an interlaced recording operation is performed. Consequently, high-quality recording can be effected without involvement of a reduction in throughput.

Preferably, in the area of the surface of the platen opposite the dot formation array, there are located flat tops which come into contact with the recording medium and support the recording medium from below.

As a result, the recording material can be stably, securely held in position relative to the recording head.

Preferably, in a downstream position outside the area of the surface of the platen opposite the dot formation array, there are located flat tops which come into contact with the recording medium and support the recording medium from below. As a result, even if ink erroneously adheres to the portion of the surface of the platen opposite the dot formation element array while data are recorded on the recording material though us of all the dot formation elements, the recording material is prevented from being sustained with the ink until output. Further, the distance between the recording material feed roller and the flat top can be set to a large value, thereby rendering the load of transporting a recording material lighter, thereby particularly improving the ability of the paper feed roller to feed thick paper.

Preferably, an ink-absorbing material is provided within each of the first and second holes. The ink absorbing material enables stable storage of discarded ink without involvement of leakage and can be easily replaced.

Preferably, a water repellent net is provided so as to cover an opening of each of the first and second holes, and ink-absorbing material is provided in each hole so as to be in contact with the hole. Since the opening of the first and second holes are covered with nets, the recording material is transported as if the first and second holes had not been formed in the platen, thereby firmly holding the recording material in position. Further, the discarded ink droplets collide with and adhere to the nets. However, the nets have a property of repelling water, and hence the ink that has adhered to the nets is immediately absorbed by the ink-absorbing member, thus substantially eliminating residual ink from the surface of the platen which is to contact the recording material. Accordingly, the recording material is held firmly in position, thereby substantially eliminating the chance of the discarded ink re-adhering to the recording material.

Preferably, a reclosable closure is attached to the opening of each of the first and second holes, and the closure is opened when data are recorded on the recording medium without leaving a margin on either the top or bottom end of the recording medium, the closure being closed when data are recorded on the recording medium while leaving a margin. When an image is recorded on the recording paper without leaving a margin on either the top end or the bottom end, the first hole or the second hole is opened by the closure. During a printing operation other than a margin-free printing operation, the closures are held in a closed position, thus preventing functional wastage.

Preferably, the closure has a pivot located below the opening of the corresponding hole and is pivotally opened or closed by being pivoted around the pivot. The configuration of the recording apparatus obviates a necessity for providing, in the travel path of the recording material, a mechanism for opening and closing the closures. Accordingly, there can be prevented an increase in the likelihood of a paper jam, which would otherwise be caused when a new member is provided in the recording apparatus.

Further, the present invention provides a recording method for recording data on a recording medium without leaving a margin through use of an ink-jet recording apparatus, the apparatus including:

a recording head having a dot formation element array including a plurality of dot formation elements arranged along a secondary scanning direction;

a platen which holds a recording medium in position opposite the recording head during a printing operation while the recording head is caused to scan in a primary scanning direction;

a recording-medium feed roller disposed upstream of the recording head; and an output roller disposed downstream of the recording head, wherein ink is squirted while the end portion of the recording medium is situated within the range of the dot formation element array in the secondary scanning direction, and a portion of the ink is discarded into a hole locally formed in the area of the surface of the platen opposite the end portion of the recording medium situated thereat, to thereby record data on the recording medium without leaving a margin on the edge of the recording medium.

In a case where data are recorded on the recording material without leaving a margin on the top end of the recording material, the recording method prevents a reduction in print throughput, the chance of recording material being sustained with discarded ink, and a reduction in recording quality by firmly holding the recording material in position during a recording operation.

Preferably, the recording head performs an interlaced recording operation for actuating one of the dot formation elements located at a position close to the end portion of all the dot formation elements when data are recorded on the end portion of the recording medium without leaving a margin, or an interlaced recording operation for recording data on the recording medium by actuation of all dot formation elements when the data are recorded in a record region other than the end portion. Therefore, there is yielded the same advantage as that yielded by the recording apparatus.

Further, the present invention provides an ink-jet recording apparatus comprising:

an ink-jet recording head on which a plurality of dot formation elements are arranged along a secondary scanning direction and which is reciprocally moved in a primary scanning direction;

a platen which is disposed opposite the recording head and holds a recording medium in position by supporting the recording medium from below when data are recorded, by means of the recording head, on the recording medium to be intermittently transported in the secondary scanning direction;

a control section for controlling, on the basis of recorded data, intermittent transportation of the recording medium in the secondary scanning direction, reciprocal movement of the recording head in the primary scanning direction, and the squirting of ink from the recording head;

ink-receiver open holes which are formed in the areas of the platen corresponding to the right and left sides of one type of recording medium of predetermined size or the right and left sides of two or more types of recording media of predetermined sizes, from among the recording media to be transported over the platen in the secondary scanning direction, the holes being formed so as to extend beyond the respective right and left sides of the employed recording medium and formed to longitudinally extend beyond the range of the dot formation elements in the secondary scanning direction; and the control section having a first operation mode in which a recording operation is performed by means of expanding recorded data within a record region inside the right and left sides of the employed recording medium of predetermined size, and a second operation mode in which a recording operation is performed by means of expanding the recorded data of the same within a record region outside either side of the employed recording medium of the same size and inside an outer edge of the ink-receiver open hole, wherein in a case where data are recorded on the recording medium without leaving a margin on either side of the recording medium, the second operation mode is performed.

The control section has two operation modes; i.e., a first operation mode and a second operation mode. In the first operation mode, the control section expands recorded data and records the data in a recording region set inside either side of the recording medium of any of predetermined sizes. In a second operation mode, the control section expands the same recorded data and records the data within a record region which extends beyond either side of the recording medium of the same size and is positioned inside a non-reference-side edge of the recording medium within the corresponding one of the through holes. In the first operation mode, a certain photographic image data set can be normally recorded on the recording material of a single size while a margin is left on either side thereof. In the second operation mode, the image data set can be recorded on the recording material without a margin being left on either side thereof. In other words, since the control section is provided with the first and second operation modes, a certain photographic image data set can be readily and unfailingly recorded on the recording medium of a single size with or without a margin being left on either side thereof.

Further, since the control section is determined to operate according to either the first or second operation mode for the recording medium of a predetermined size, the second mode can be readily set such that the amount of image data to be produced and wasted outside either side of the recording medium is sufficiently reduced. Accordingly, image data can be effectively recorded without a margin being left, by means of minimizing wastage of image data.

The present invention further provides an ink-jet recording apparatus comprising:

an ink-jet recording head on which a plurality of dot formation elements are arranged along a secondary scanning direction and which is reciprocally moved in a primary scanning direction;

a platen which is disposed opposite the recording head, has a flat upper surface on which a plurality of protuberances protruding the same distance are formed at predetermined intervals in the primary scanning direction, and holds the recording medium in position by supporting the recording medium from below through use of flat tops of the plurality of protuberances when data are recorded, by means of the recording head, on the recording medium to be intermittently transported in the secondary scanning direction;

a control section for controlling, on the basis of recorded data, intermittent transportation of the recording medium in the secondary scanning direction, reciprocal movement of the recording head in the primary scanning direction, and the squirting of ink from the recording head;

ink-receiver open holes which are formed in the flat areas of the upper surface of the platen in which the protuberances are not formed, as well as in the areas of the upper surface of the platen corresponding to the right and left sides of one type of recording medium of predetermined size or the right and left sides of two or more types of recording media of predetermined sizes, from among the recording media to be transported over the platen in the secondary scanning direction, the holes being formed so as to extend beyond the respective right and left sides of the respective recording media and formed to longitudinally extend beyond the range of the dot formation elements in the secondary scanning direction; and the control section having a first operation mode in which a recording operation is performed by means of expanding recorded data within a record region inside the right and left sides of the employed recording medium of predetermined size, and a second operation mode in which a recording operation is performed by means of expanding the recorded data of the same within a record region outside either side of the employed recording medium of the same size and inside an outer edge of the ink-receiver open hole, wherein in a case where data are recorded on the recording medium without leaving a margin on either side of the recording medium, the second operation mode is performed.

Protuberances protruding by the same distance are formed at predetermined intervals in the primary scanning direction and in an upper surface of the platen. When the recording head records image data on the recording medium while the recording medium is intermittently transported in the secondary scanning direction, the platen supports the recording medium from below, to thereby hold the recording medium in position relative to the recording head. The protuberances enable regular generation of paper cockle, which is usually caused when the recording medium is soaked with ink, thereby rendering stable the position of the recording medium in its widthwise direction. Therefore, setting of the record region for the second operation mode does not involve a necessity for taking into consideration a large positional offset of the recording paper attributable to paper cockle. Accordingly, the recording region for the second operation mode can be made small, thus enabling a further reduction in the amount of image data to be wasted during a margin-free recording operation.

Preferably, the recording region for the second mode is set to be wider than the width of the recording medium by 4.5 mm to 5.5 mm. By virtue of such an allowance, image data can be recorded on the recording medium without a margin being left on either side thereof and without being substantially influenced by a tolerance stemming from the design or manufacture of a path for transporting the recording medium.

Preferably, in both the first and second operation modes, the control section assumes, as a speed at which the recording head reciprocally travels in the primary scanning direction, a single acceleration gradient at which the recording head is to shift from a stationary state to a constant-speed state and a single deceleration gradient at which the recording head is to shift from the constant-speed state to the stationary state, and a travel distance attained by the recording head of the second operation mode in the constant-speed state is longer than a travel distance attained by the recording head of the first operation mode in the constant-speed state, and travel distance in an acceleration side and travel distance in a deceleration side are substantially equal. At the time of implementation of the first and second operation modes, the control required for reciprocally moving the recording head in the primary scanning direction can be facilitated. Recording throughput can be optimized in both the first and second operation modes.

Preferably, an ink-absorbing material is provided in each of the ink-receiver open holes, and the ink-absorbing material is situated within corresponding ink-receiver open hole such that the upper surface of the ink-absorbing material is located in the vicinity of the opening of the through hole opposite the recording head. Accordingly, the distance over which the ink droplets are squirted and wasted outside either side of the recording medium can be shortened. Further, the ink-absorbing material, which is disposed in each of the through holes such that the upper surface of the ink-absorbing material is situated in the vicinity of the opening opposite the recording head, immediately captures the ink droplets, thus significantly reducing the chance of occurrence of airborne ink mist.

Preferably, an ink-absorbing material is provided in each of the ink-receiver open holes, and the ink-absorbing material is situated within corresponding ink-receiver open hole such that the upper surface of the ink-absorbing material is located in the vicinity of the opening of the through hole opposite the recording head. As a result, there is yielded the same advantage as that mentioned above.

Preferably, a first removal stopper is provided along the edge of the opening of each of the ink-receiver open holes disposed opposite the recording head, for preventing removal of the ink-absorbing material toward the recording head. Since the upper surface of the ink absorbing material is firmly retained in position, generation of airborne ink mist can be stably prevented. Further, the chance of the upper surface of the ink absorbing material rubbing against the recording material being transported or the chance of the upper surface of the ink absorbing material rubbing against the recording material because of paper cockle can be reduced thoroughly.

Preferably, the first removal stopper is formed into a step provided along the edge of the opening of each of the ink-receiver open holes disposed opposite the recording head. Thus, the first removal stoppers can be readily formed integrally with the platen, and the thus-formed removal stops can exert a removal effect by means of a simple structure.

Preferably, each of the ink-receiver open holes penetrates through the platen from the side opposite the recording head to the other side.

The through-hole structure enables insertion of the ink-absorbing material into each of the ink receiver open holes by means of pushing only the ink-absorbing material, thus facilitating assembly of ink receiver open holes with ink absorbing material.

Preferably, second removal stoppers are provided in each of the ink-receiver open hole for preventing removal of the ink-absorbing material away from the recording head. The second removal stoppers unfailingly prevent removal of the ink-absorbing material in the direction opposite the recording head. In cooperation with the first removal stoppers, the second removal stoppers can securely hold the ink-absorbing material within the through holes.

Preferably, the second removal stoppers are formed into raised long lines extending along the interior surface of the ink-receiver open hole in the direction of penetration. The second removal stoppers are formed in raised lines on the interior surface of each of the through holes, the lines aligned in the longitudinal direction thereof. Such a structure of the second removal stopper enables insertion of the ink-absorbing material into each of the through holes by means of pushing only the ink-absorbing material. Further, the second removal stoppers can be readily formed integrally with the through holes and can be readily formed integrally with the through holes.

Preferably, the second removal stoppers are each formed into a step provided along the edge of corresponding opening of the ink-receiver open hole disposed opposite the recording head. The step-shaped removal stoppers unfailingly prevent removal of the ink-absorbing material through employment of a simple structure and can be readily formed integrally with the through holes.

Preferably, a tilt section is provided in each of the ink-receiver open holes at an angle from the recording head to the other side so as to maintain the through state of the through hole, and an ink-absorbing material is laid on the tilt section. When image data are recorded on a recording medium without leaving a margin on either side of the recording medium, the ink which has been squirted from the recording head outside either side of the recording medium directly enters any of the through holes having openings, each opening longitudinally extending beyond the range of the recording head within which range nozzles are arranged. The ink then immediately adheres to the ink-absorbing material laid on the tilt section provided in any of the through holes. Accordingly, the chance of occurrence of airborne ink mist can be substantially obviated. Even when an ink-jet recording apparatus performs photographic-quality printing which does not involve leaving a margin on either side of the recording medium, there arises substantially no decrease in print quality of the lateral side areas of the recording medium. When the ink which has adhered to the ink-absorbing material accumulates to a certain level, the ink flows over the surface of the tilt section and is drained from the through holes.

Preferably, each of the ink-receiver open holes is formed in the form of a through hole, and a tilt section is provided in the through hole at an angle from the recording head to the other side so as to maintain the through state of the through hole, a plurality of ribs being provided on the tilt section at intervals such that holes are formed in the tilting direction, and top surfaces of the ribs being formed so as to be lower than the opening of the through hole. As in the case of the platen mentioned above, when image data are recorded on a recording medium without leaving a margin on either side of the recording medium, the ink which has been squirted from the recording head outside either side of the recording medium directly enters any of the through holes having openings, each opening longitudinally extending beyond the nozzle range of the recording head. The ink is then guided to the bottom of the holes by the plurality of walls located below the opening of each of the through holes. The walls exhibit an ink-capturing function, as does the ink-absorbing material, thereby substantially obviating the chance of occurrence of airborne ink mist. Even when an ink-jet recording apparatus performs photographic-quality printing which does not involve leaving a margin on either side of the recording medium, there arises substantially no decrease in print quality of the lateral side areas of the recording medium. When the ink which has adhered to the bottom of the holes accumulates to a certain level, the ink flows over the surface of the tilt section and is drained from the through holes.

Preferably, the ink-jet recording apparatus comprises:

a control section for controlling, on the basis of recorded data, intermittent transportation of the recording medium in the secondary scanning direction, reciprocal movement of the recording head in the primary scanning direction, and the squirting of ink from the recording head;

ink-receiver open holes which are formed in the areas of the platen corresponding to the right and left sides of one type of recording medium of predetermined size or the right and left sides of two or more types of recording media of predetermined sizes, from among the recording media to be transported over the platen in the secondary scanning direction, the holes being formed so as to extend beyond the respective right and left sides of the respective recording media and formed to longitudinally extend beyond the range of the dot formation elements in the secondary scanning direction; and the control section having a first operation mode in which a recording operation is performed by means of expanding recorded data within a record region inside the right and left sides of the employed recording medium of predetermined size, and a second operation mode in which a recording operation is performed by means of expanding the recorded data of the same within a record region outside either side of the employed recording medium of the same size and inside an outer edge of the corresponding ink-receiver open hole, wherein in a case where data are recorded on the recording medium without leaving a margin on either side of the recording medium, the second operation mode is performed.

Recording of image data on a recording medium without leaving a margin on the top, bottom, or either side of the recording medium can be readily achieved, thus yielding the same advantages as those mentioned previously.

The present invention provides an ink-jet recording apparatus comprising:

a recording head having a dot formation element array including a plurality of dot formation elements arranged along a secondary scanning direction;

a platen for holding a recording medium in position opposite the recording head during a printing operation while the recording head is caused to scan in a primary scanning direction;

a recording-medium feed roller disposed upstream of the recording head;

an output roller disposed downstream of the recording head;

a flat top for supporting the recording medium from below which is provided in the area of the platen surface opposite the dot formation element array; and a center hole formed in substantially the center of the flat top with respect to the direction in which the recording medium is to be transported, wherein, when data are recorded on the recording medium without leaving a margin on the top end and/or the bottom end of the recording medium, the ink discarded outside the top end or the bottom end is guided to the center hole.

The flat top stably supports the recording material, and use of only one center hole enables recording of data on the recording material without leaving a margin on the top end and/or the bottom end of the recording material.

The present invention provides an ink-jet recording apparatus comprising:

a recording head having a plurality of dot formation element arrays for respective colors and arranged sequentially along a secondary scanning direction, each dot formation element array including a plurality of dot formation elements arranged along the secondary scanning direction;

a platen for holding a recording medium in position opposite the recording head during a printing operation while the recording head is caused to scan in a primary scanning direction;

a recording-medium feed roller disposed upstream of the recording head;

an output roller disposed downstream of the recording head;

first holes formed in the positions of the surface of the platen opposite downstream portions of the respective dot formation element arrays of respective colors; and second holes formed in the positions of the surface of the platen opposite upstream portions of the respective dot formation element arrays of the respective colors, wherein when data are recorded on the recording medium without leaving a margin on the top end of the recording medium, the ink squirted from the dot formation element arrays of respective colors outside the top end is guided to the first holes, and when data are recorded on the recording medium without leaving a margin on the bottom end of the recording medium, the ink squirted from the dot formation element arrays of respective colors outside the bottom end is guided to the second holes.

Even in a case where a plurality of color nozzles are arranged in a vertical column, the color nozzles are assigned respective hole pairs; that is, each pair consisting of the first hole and the second hole. As in the case of a recording head having color nozzles arranged horizontally, the recording head can record an image on either the top end or the bottom end of the recording paper without leaving a margin.

Preferably, the recording head is arranged so as to be able to selectively perform a standard interlaced recording operation for recording data by actuation of all the dot formation elements of the dot formation element array, and a limited interlaced recording operation for limitedly actuating a portion of the dot formation elements, through use of a dot drive control section, and the limited interlaced recording operation is performed when the top end of the recording medium is situated at the first holes and when the bottom end of the recording medium is situated at the second holes.

In a case where an image is recorded on the recording material without leaving a margin on the top end, the bottom end, and either end of the recording material, the amount of ink to be discarded into the first hole and the second hole and the amount of image data discarded in association with the amount of discarded ink can be reduced by means of performing a limited interlaced recording operation. Further, the limited interlaced recording operation enables a reduction in the degree of cockle arising in the top end, the bottom end, and either side of the recording paper. In the area of the recording paper other than the top end and the bottom end, a high-quality image can be recorded without involvement of a reduction in print throughput, by means of performing an ordinary interlaced recording operation.

Preferably, the recording head is arranged so as to be able to selectively perform a standard interlaced recording operation for recording data by actuation of all the dot formation elements of the dot formation element array, and a limited interlaced recording operation for limitedly actuating a portion of the dot formation elements, through use of a dot drive control section, and the limited interlaced recording operation is performed when the top end or the bottom end of the recording medium is situated at the center hole.

In a case where an image is recorded on the recording material without leaving a margin on either the top end or the bottom end, the amount of ink to be discarded into the first hole and the second hole and the amount of image data discarded in association with the amount of discarded ink can be reduced by means of performing a limited interlaced recording operation. Further, the limited interlaced recording operation enables a reduction in the degree of cockle arising in the top end or the bottom end of the recording paper. In the area of the recording paper other than the top end and the bottom end, a high-quality image can be recorded without involvement of a reduction in print throughput, by means of performing an ordinary interlaced recording operation.

Preferably, the recording head is arranged so as to be able to selectively perform a standard interlaced recording operation for recording data by actuation of all the dot formation elements of the dot formation element array, and a limited interlaced recording operation for limitedly actuating a portion of the dot formation elements, through use of a dot drive control section, and the limited interlaced recording operation is performed when the top end of the recording medium is situated at the first holes corresponding to the plurality of dot formation element arrays of respective colors and when the bottom end of the recording medium is situated at the second holes corresponding to the plurality of dot formation element arrays of respective colors.

Even in the case of a recording head in which a plurality of color nozzles are arranged in a vertical column, when an image is recorded on the recording material without leaving a margin on either the top end or the bottom end, the amount of ink to be discarded into the first hole and the second hole and the amount of image data discarded in association with the amount of discarded ink can be reduced by means of performing a limited interlaced recording operation. Further, the limited interlaced recording operation enables a reduction in the degree of cockle arising in the top end or the bottom end of the recording paper. In the area of the recording paper other than the top end and the bottom end, a high-quality image can be recorded without involvement of a reduction in print throughput, by means of performing an ordinary interlaced recording operation.

BRIEF DESCRIPTION OF THE DRAWINGS

FIGS. 59A and 59B are schematic representations of the first paper removal routine, wherein FIG. 59A shows a state in which advancing the top of recording medium over a certain distance has been completed, and FIG. 59B shows forward advancement of the single sheet of cut paper;

FIGS. 61A and 61B are schematic representations of the second paper removal routine, wherein FIG. 61A shows a state in which advancing the top of a roll of paper over a certain distance has been completed, and FIG. 61B shows forward advancement of the roll of paper;

DETAILED DESCRIPTION OF THE INVENTION

Recording without Leaving Top and Bottom Margins

Figure 1:
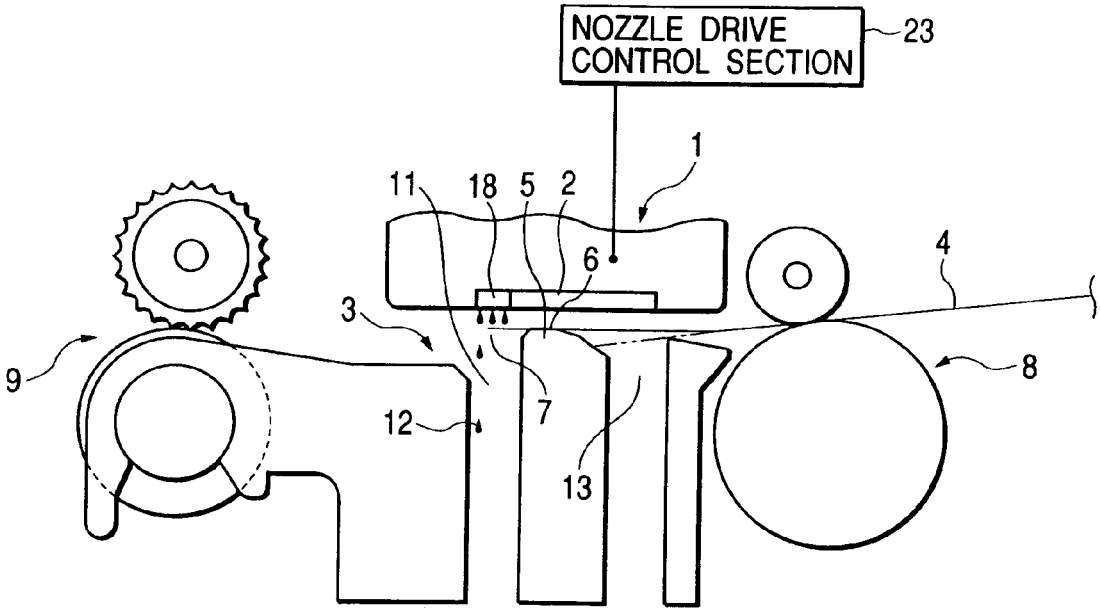
FIG. 1 is a cross-sectional view of the principal section of an ink-jet recording apparatus according to a first embodiment of the present invention when data are recorded on recording paper without leaving a margin on the top end of the paper.
Figure 2:
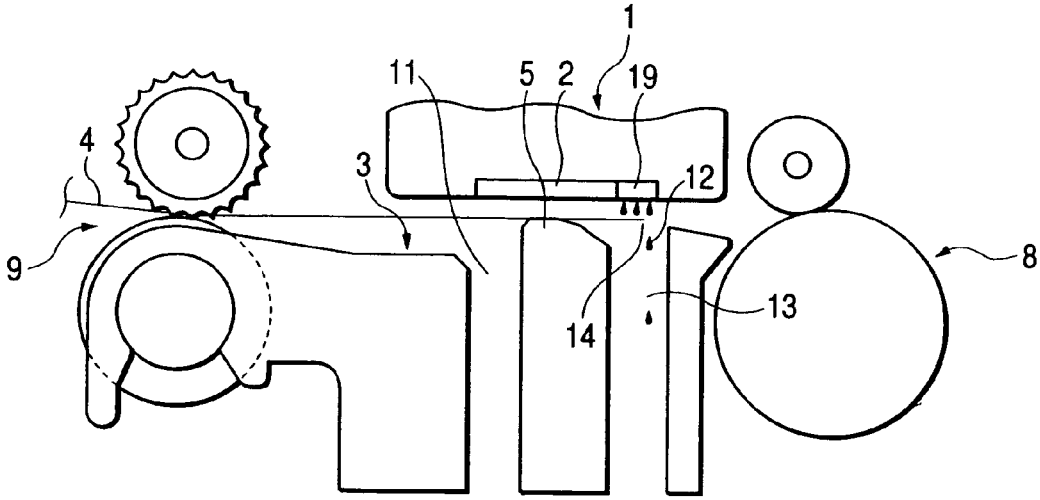
FIG. 2 is a cross-sectional view of the principal section of the ink-jet recording apparatus according to the first embodiment when data are recorded on the recording paper without leaving a margin on the bottom end of the paper.

Preferred embodiments of the present invention will now be described by reference to the accompanying drawings. FIG. 1 shows an ink-jet recording apparatus according to a first embodiment of the present invention; that is, FIG. 1 shows a cross-sectional view of the principal section of the recording apparatus when data are recorded on recording paper without leaving a margin on the top end of the paper. FIG. 2 is a cross-sectional view of the principal section of the ink-jet recording apparatus when data are recorded on the recording paper without leaving a margin on the bottom end of the paper.

As shown in FIG. 1, in the present embodiment, a first hole 11 is formed in a portion of the surface of a platen 3 opposite a downstream-side portion of a nozzle array 2 in a secondary-scanning direction. When data are recorded on recording paper 4 without leaving a margin on a top end 7 of the paper 4, the first hole 11 functions to receive all ink droplets 12 squirted outside the top end 7 of the paper 4 (hereinafter often called "discarded ink droplets 12"). The first hole 11 is formed to assume an elongated shape and to extend continuously over the widthwise direction of paper (see FIGS. 5 and 6 to be described later) or is partially partitioned.

In the present embodiment, the first hole 11 is formed not over the entire surface of the platen 3 but locally so as to correspond to the top end 7 when data are recorded on the top end 7 of the recording paper 4 without leaving a margin. A positioning-function section for holding the recording paper 4 in position during a recording operation is left in the area on the platen 3 opposite a recording head 1; namely, ribs 5 and their flat tops 6 are formed within a range on the platen 3 opposite the nozzle array 2. When data are recorded on the recording paper 4 without leaving a margin on the top end 7, the ink droplets 12 which have been squirted outside the top end 7 and become discarded are introduced into the first hole 11. Even in such a case, the recording paper 4 is firmly held in position on the flat tops 6 of the ribs 5. Accordingly, the recording paper 4 can be stably held in position relative to the recording head 1.

A second hole 13 is formed in the portion of the surface of the platen 3 opposite an upstream portion of the nozzle array 2 in the secondary scanning direction. As shown in FIG. 2, the second hole 13 is formed so as to guide the discarded ink droplets 12 which have been squirted outside a bottom end 14 of the recording paper 4. The second hole 14 performs the same function as that performed by the first hole 11. In the drawing, reference numeral 8 designates a paper feed roller, and 9 designates a paper output roller. Both the paper feed roller 8 and the paper output roller 9 are presently known.

The present embodiment employs the platen 3 having the first hole 11 and the second hole 13. However, there may also be employed a platen having only one of the holes. Division of the area of the platen 3 is determined on the basis of the nature of a presumed recording method.

Figure 3:
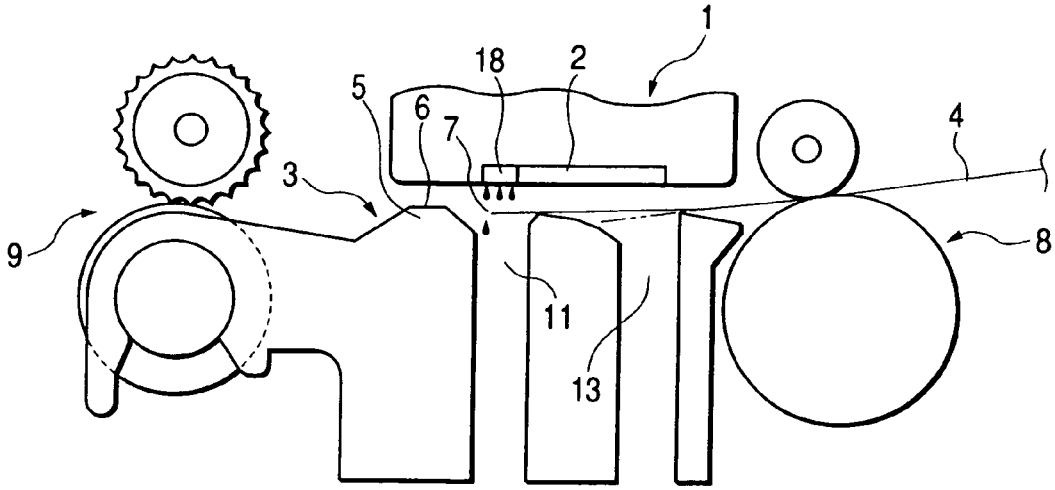
FIG. 3 is a cross-sectional view of the principal section of an ink-jet recording apparatus according to a second embodiment of the present invention when data are recorded on recording paper without leaving a margin on the top end of the paper.
Figure 4:
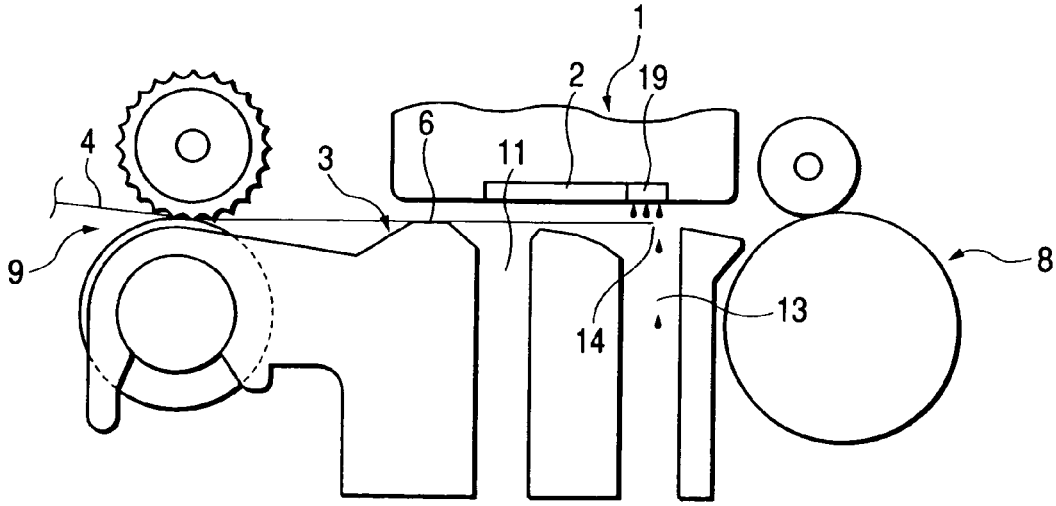
FIG. 4 is a cross-sectional view of the principal section of the ink-jet recording apparatus according to the second embodiment when data are recorded on the recording paper without leaving a margin on the bottom end of the paper.

FIGS. 1 and 2 show that the flat top 6 of the rib 5 is situated in the range of the platen 3 opposite the nozzle array 2. However, as shown in FIGS. 3 and 4, the rib 5 may be constructed such that the flat top 6 is situated outside the range of the platen 3 opposite the nozzle array 2 and in a downstream position in the secondary scanning direction. Even if ink accidentally adheres to the surface of the platen 3 opposite the nozzle array 2 while data are being recorded through use of all nozzles, such a structure of the platen 3 prevents staining of the recording paper 4 being printed until the paper 4 is output. Since the distance between the paper feed roller 8 and the flat top 6 can be set long, the paper feed roller 8 is subjected to a light load when feeding the recording paper 4, thereby particularly improving the ability of the paper feed roller 8 to feed thick paper.

Figure 5:
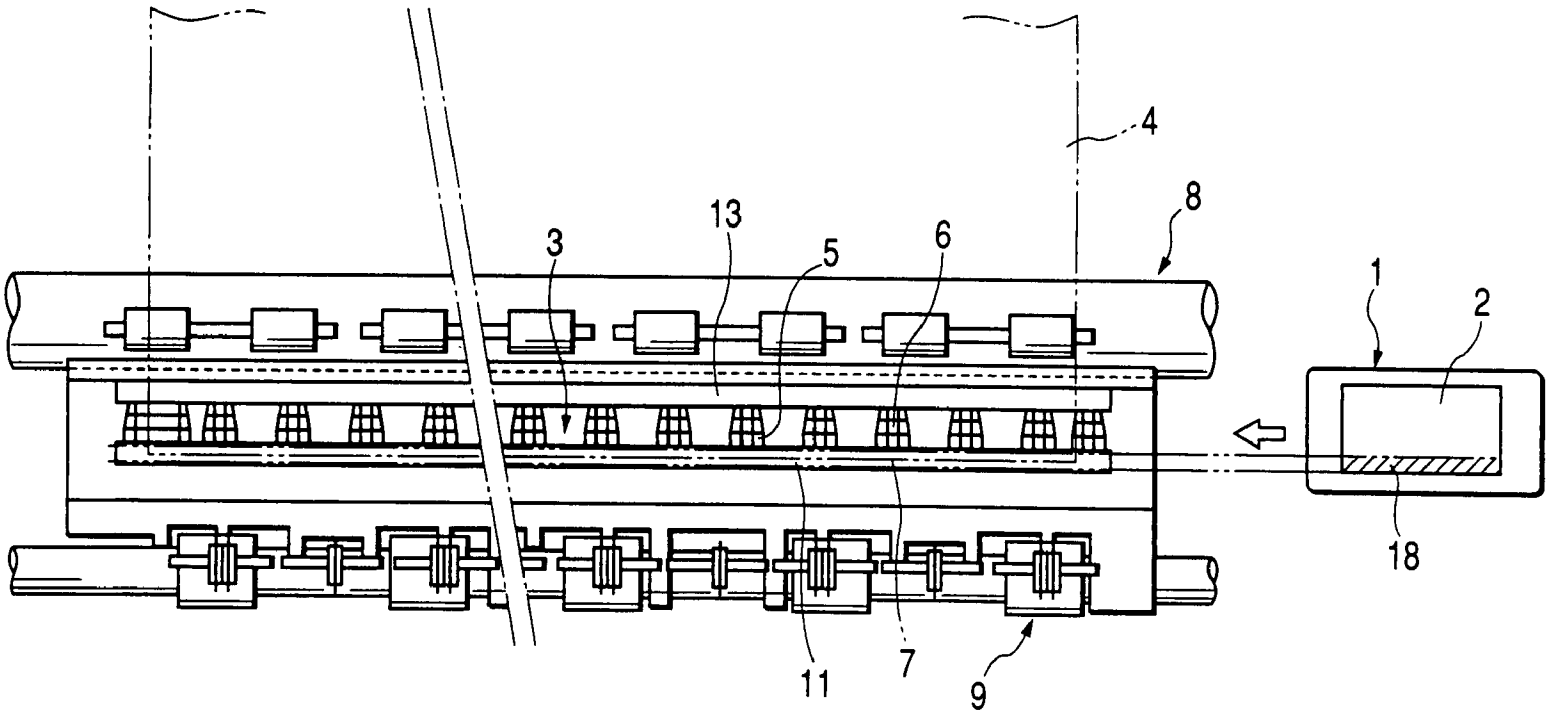
FIG. 5 is a plan view showing the principal section of the ink-jet recording apparatus shown in FIG. 1 when data are recorded on the top end of recording paper.
Figure 6:
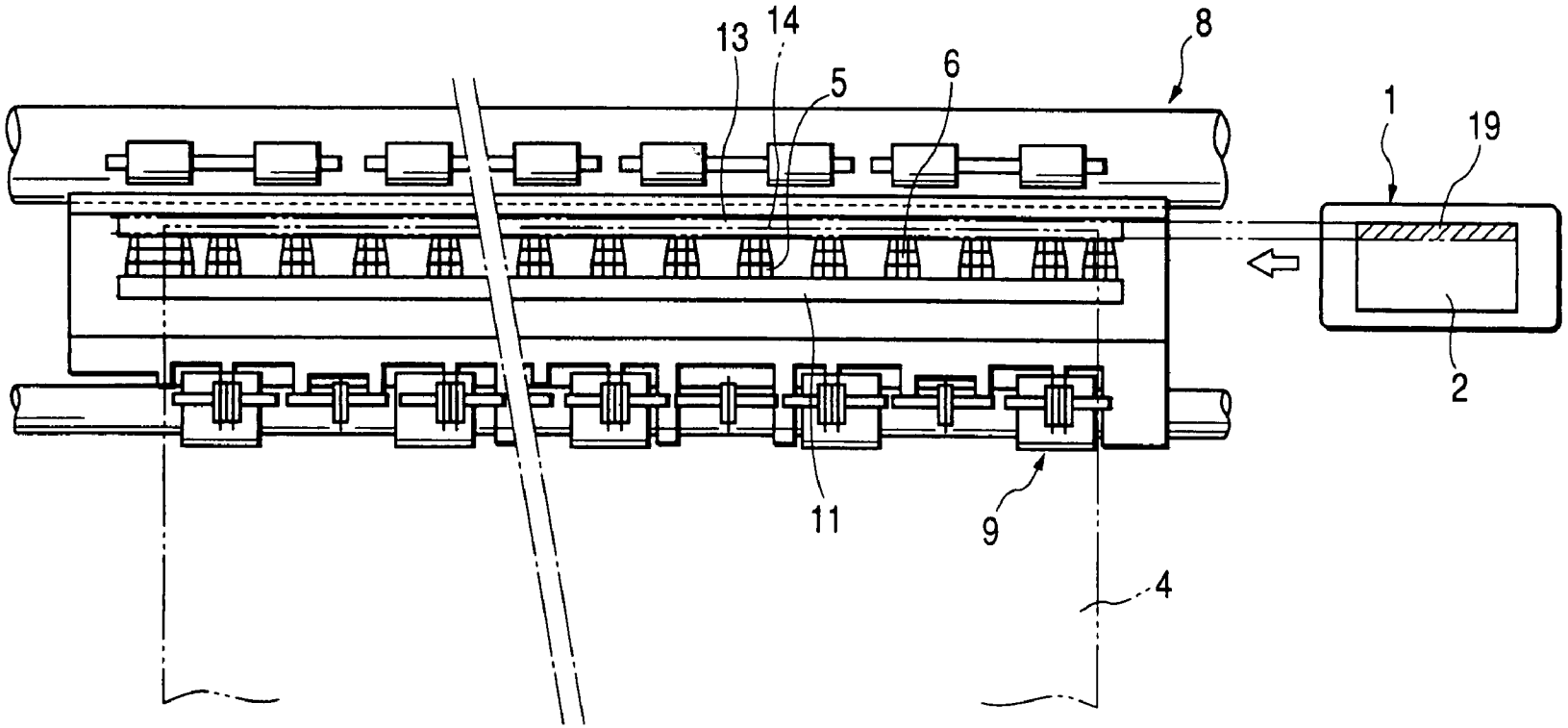
FIG. 6 is a plan view showing the principal section of the ink-jet recording apparatus shown in FIG. 1 when data are recorded on the bottom end of recording paper.

A nozzle drive control section 23 (shown only in FIG. 1 and omitted from the other drawings) for driving the nozzle array 2 of the recording head 1 is arranged so as to switchably perform an interlaced recording operation described in U.S. Pat. No. 5,844,585 entitled "Apparatus and Method for Printing High-Quality Color Image at High Speed," or a limited interlaced recording operation described in Japanese Patent Laid-Open Nos. 71009/1997 and 291506/1999, in which only some of the nozzles are limitedly actuated in order to minimize a margin left on the top end or the bottom end of recording paper. As shown in FIGS. 1, 3, and 5, when printing at the top end 7 of the recording paper 4, the nozzle drive control section 23 drives only a portion 18 of the nozzle array 2 located at the end in the direction in which paper is to be output (i.e., the downstream end with respect to the paper feed direction), thereby squirting ink to only the top end 7 of the recording paper 4. Similarly, as shown in FIGS. 2, 4, and 6, when printing at the bottom end 14 of the recording paper 4, the nozzle drive control section 23 drives only a portion 19 of the nozzle array 2, to thereby squirt ink to only the bottom end 14 of the recording paper 4.

Figure 43:
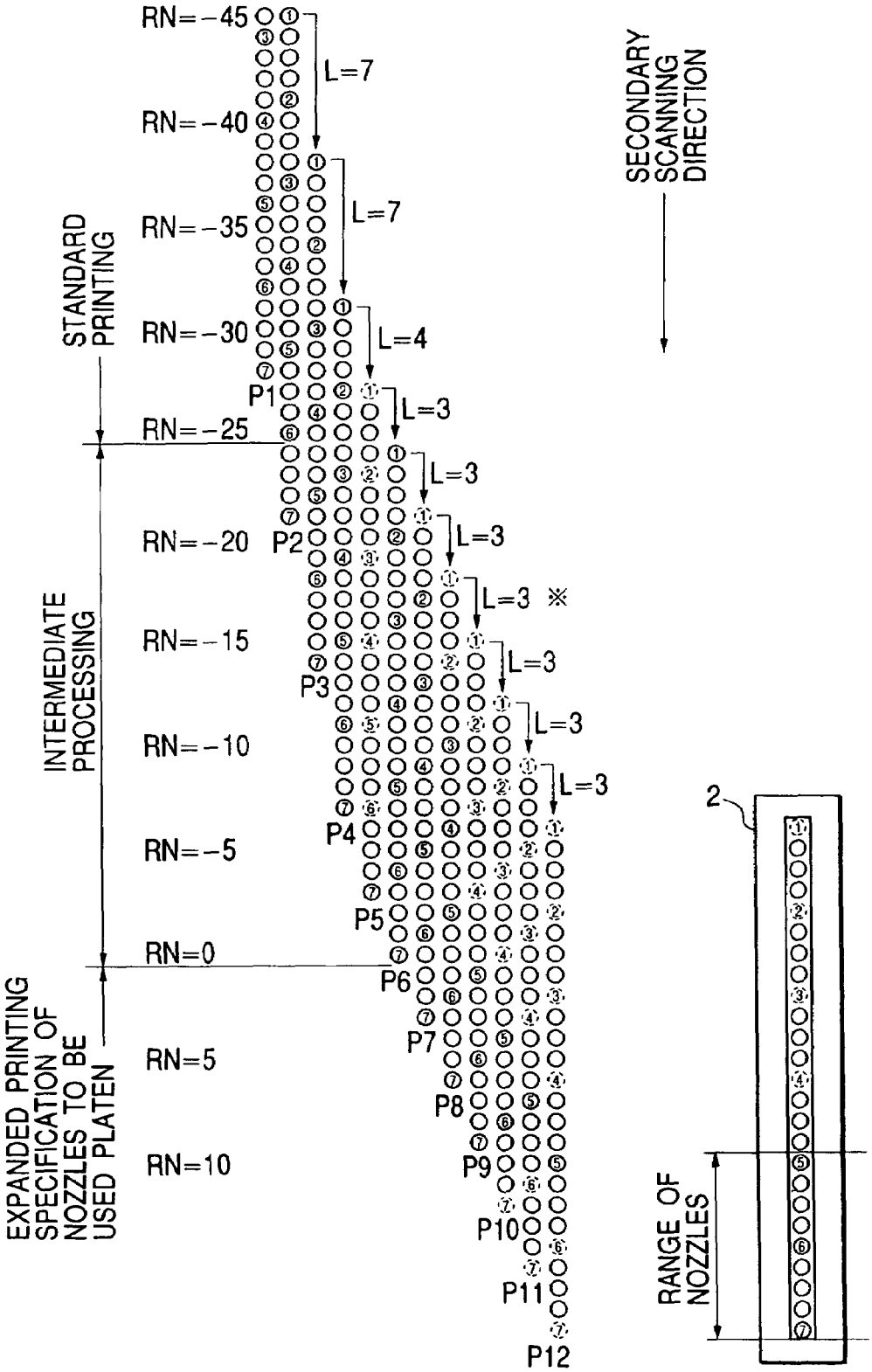
FIG. 43 is a schematic representation showing recording of dots by means of a standard interlaced recording operation and a limited interlaced recording operation to be employed in the present invention.

As shown in FIG. 43, the recording head 1 is arranged so as to be able to switchably perform a standard interlaced recording operation—in which the dot drive control section 23 drives all the nozzles of the nozzle array 2, to thereby perform a recording operation—and a limited interlaced recording—in which only portions of the nozzles are limitedly driven, to thereby perform a recording operation. There will now be described the manner in which the recording head 1 performs the limited interlaced recording operation when the top end 7 of the recording paper 4 is situated at the first hole 11 and when the bottom end 14 of the recording paper 4 is situated at the second hole 13.

FIG. 43 is a schematic representation showing the positions of the nozzles in the secondary scanning direction at the time of the primary scanning operation. The vertical direction in FIG. 43 corresponds to the secondary scanning direction. In order to avoid complication of illustration, in representation of the respective primary scanning operations, nozzle positions are sequentially shifted rightward in the drawing. For the sake of clarity, the nozzle array 2 and the hole formed in the platen 3 for receiving wasted ink are also illustrated in the drawing. In FIG. 43, reference symbol P1 designates a first primary scanning operation, and P2 designates a second primary scanning operation. Encircled numerals indicate the positions of the nozzles with respect to the secondary scanning direction during a primary scanning operation. Of these encircled numerals, numerals encircled by a thick circle designate locations at which dots are to be formed, and numerals encircled by a thin circle designate locations at which dots are not to be formed. Values provided in a columnar form on the left-side portion of FIG. 43 designate raster numbers (RNs) assigned to respective rasters for convenience. As will be described later, a raster number 0 (RN=0) is assigned to the lowest raster in use while an image is recorded by the recording method of the present invention while the paper feed accuracy during the secondary scanning operation is ensured. Rasters lower than the lowest raster are assigned positive numerals, whereas rasters higher than the lowest raster are assigned negative numerals. Numerals expressed with L (L=) depict, as the number of rasters, a paper feed per of the feed roller 8 during a secondary scanning operation.

When execution of a standard print processing routine is commenced, dot formation data are set, and dots are formed while a primary scanning operation is performed. In the example shown in FIG. 43, a nozzle pitch corresponds to four rasters. The dot formation data are formed by sequential extraction of image data from the top of the previously-input image data every four rasters with respect to the primary scanning direction. In FIG. 43, during the primary scanning operation P1, dots are formed every four rasters in a region whose lower edge is at raster number −28 (an area of RNs≦−28).

The paper feed motor 23 is driven, to thereby perform a secondary scanning operation. In the example shown in FIG. 43, paper is fed by the amount corresponding to seven rasters, whereupon the recording head 1 is moved to position P2 shown in FIG. 43. Of various feeds which enable recording of an image without involvement of lack of rasters stemming from an interlacing operation, the paper feed is set so as to enable the most effective use of nozzles. A paper feed can be defined in accordance with a nozzle pitch, the number of nozzles, and the number of repetitions of scanning. A method of setting a paper feed is publicly known, and hence its explanation is omitted here.

After completion of the secondary scanning operation, dots are formed in the area designated by the primary scanning operation P2; i.e., the area whose lower edge is at raster number −21. Through repetition of these processing operations, rasters are intermittently formed, thus enabling recording of an image. As is evident from, for example, FIG. 43, an image in the area defined between raster number −34 and −25 is completed after the primary scanning operations P1 through P4 have been performed. These operations are repeatedly performed until formation of an image is completed. In the present embodiment, as will be described later, the standard print processing operation is followed by execution of a printing operation of another print mode. Therefore, completion of formation of an image does not mean completion of printing of the entire input image data, but means completion of formation of an image on the basis of the standard print processing routine.

After formation of an image through standard print processing has been completed, printing of an image is performed by means of an intermediate processing operation. The flow of formation of dots performed during an intermediate processing operation is the same as that employed in the standard print processing routine. In the intermediate processing, the paper feed required for the secondary scanning operation differs from that required for the standard printing operation.

In contrast with a standard print processing operation in which paper is fed by the amount corresponding to seven rasters, paper is fed by the amount corresponding to four rasters during an intermediate processing operation, thus forming a raster (designated by the primary scanning operation PS shown in FIG. 43). The significance of four rasters will be described later. Next, paper is fed by the amount corresponding to three rasters, thus forming rasters (designated by the primary scanning operations P6 through P8 shown in FIG. 43). As in the case of, for example, the first nozzle employed in the primary scanning operation 7, a nozzle is present in the raster position where a dot has already been formed. In this case, the nozzle masks the dot formation data so as not to form a dot. The location where the primary scanning operation P8 shown in FIG. 43 is performed is a critical location where paper feeding can be effected while the accuracy of paper feeding is ensured. In other words, the bottom of the recording paper 4 is at a position immediately before release from the paper feed roller 8.

Setting of paper feed during an intermediate processing operation will now be described. During an intermediate processing operation of the present embodiment, transient feeding of paper by the amount corresponding to four rasters is followed by feeding of paper by a given amount corresponding to three rasters. The given paper feed corresponds to a paper feed for interlaced printing employed in a case where three nozzles are provided at a nozzle pitch corresponding to four rasters. The transient feeding of paper by the amount corresponding to four rasters, which had been performed at the beginning of the intermediate processing operation, is also set so as to avoid lack of rasters. The transient paper feed is determined in accordance with parameters such as a paper feed employed during the standard print processing operation and a paper feed employed during the intermediate processing operation.

Interlaced recording, during which the number of nozzles used is apparently diminished, is performed during the intermediate processing operation, because there can be broadened a region at which an image can be recorded while the accuracy of a paper feed is ensured.

In the thus-broadened print area, dots are recorded while the paper is fed in the secondary scanning direction by the amount corresponding to three rasters. At this time, the paper feed to be employed for effecting an interlaced recording operation is further diminished to three rasters.

After the foregoing settings have been effected, nozzles to be used are set. Nozzles which are not to be used are subjected to data masking. Here, the expression "data masking" means processing for hindering nozzles from forming dots.

Next, an expanded print processing operation is performed. The paper feed employed during the intermediate processing operation differs from that employed during the standard print processing operation. As mentioned previously, during an expanded print processing operation, dots are formed by means of interlaced recording operation while the paper is fed by the amount corresponding to three rasters. At this time, since the image has already been formed in the area located higher than raster number 0 (i.e., an area of RN≦0), the nozzles located in that area are prohibited from forming dots.

As has been described, a high-quality image can be produced by the interlaced recording method within the area to be subjected to a standard print processing operation. Further, the area where an image can be formed while the accuracy of a paper feed is ensured can be expanded by means of employment of the intermediate processing operation. Even in such a broadened area, an image is recorded by means of the interlaced recording method, thus enabling formation of a high-quality image. The area at which an image can be recorded can be broadened downward, by means of execution of an expanded print processing operation.

The standard interlaced recording method which utilizes actuation of all nozzles and has been described by reference to FIG. 43, and the expanded print processing operation which employs limited use of nozzles; i.e., a limited interlaced recording method, are known techniques, as described in Japanese Patent Laid-Open No. 291506/1999. FIGS. 25A through 25D show printing processes during which an image is formed on the recording paper 4 without leaving a margin on the top end 7, by means of performing the standard interlaced recording operation and the limited interlaced recording operation. When the top end 7 of the recording paper comes to the first hole 11, an expanded print processing operation is effected through use of nozzles of the portion 18 of the nozzle array 2, in accordance with the method described by reference to FIG. 43. An image is recorded on the recording paper 4 without leaving a margin on the top end 7 while a small amount of ink is squirted toward the first hole 11, as illustrated in the drawings, thus effecting top-margin-free printing.

FIGS. 26A through 26D show print processes for printing an image on the recording paper 4 without leaving a margin on the bottom end 14, by means of performing a standard interlaced recording operation and a limited interlaced recording operation. Recording of an image without leaving a margin on the bottom end 14 is in principle the same as recording of an image without leaving a margin on the top end 7, and hence its explanation is omitted.

A margin-free recording operation has been described by reference to an example in which a margin-free recording operation is achieved by means of a limited interlaced recording operation. In a case where an image is recorded on the recording paper 4 without leaving a margin on either the top end 7 or the bottom end 14, the amount of ink to be discarded into the first hole 11 and the second hole 12, which has been described by reference to the example shown in FIG. 1, can be reduced by means of performing a limited interlaced recording operation. Further, the limited interlaced recording operation enables a reduction in the degree of cockle (wrinkling) arising in the top end 17 or the bottom end 14 of the recording paper 4. In the area of the recording paper 4 other than the top end 7 and the bottom end 14, a high-quality image can be recorded without involvement of a reduction in print throughput, by means of performing an ordinary interlaced recording operation.

In the embodiment shown in FIGS. 1 and 2, the ink droplets 12—which have been squirted outside the top end 7 or the bottom end 14 while an image is recorded on the recording paper 4 without leaving a margin on the top end 7 or the bottom end 14—are guided to the first hole 11 and the second hole 13. During the printing operation, the recording paper 4 is held firmly in position relative to the recording head 1, by means of the flat tops 6 of the ribs 5. Thus, in a case where an image is recorded on the recording paper 4 without leaving a margin on either the top end 7 or the bottom end 14, there is no chance of the recording paper 4 being stained by re-adhesion of the discarded ink droplets 12. Further, the recording paper 4 is firmly held in position during a recording operation, thus enabling a high-quality recording operation.

Figure 7:
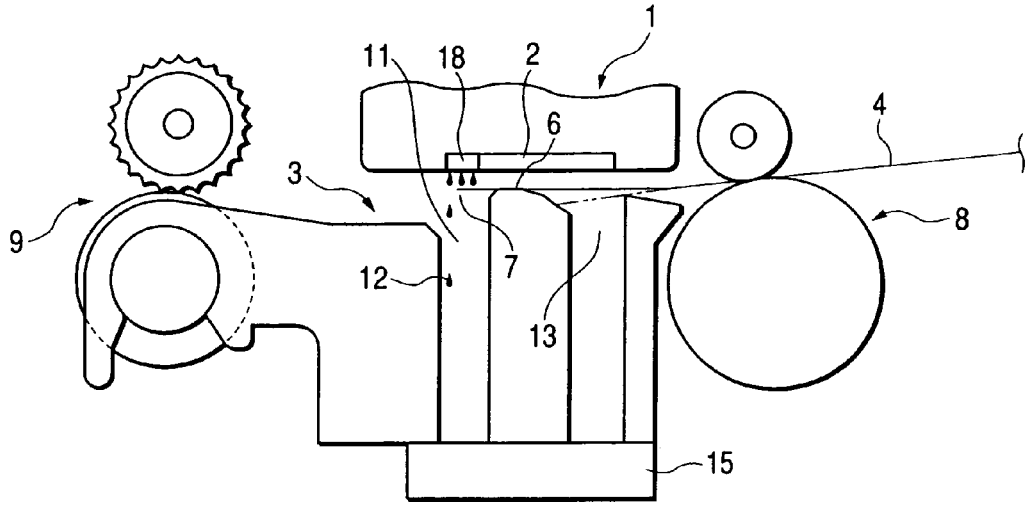
FIG. 7 is a cross-sectional view of the principal section of an ink-jet recording apparatus according to another embodiment of the present invention when data are recorded on recording paper without leaving a margin on the top end of the paper.

FIG. 7 shows another embodiment of the ink-jet recording apparatus of the present invention. The recording apparatus corresponds to the recording apparatus of the first embodiment shown in FIG. 1 additionally provided with an ink-absorbing member. Specifically, an ink-absorbing member 15 is provided on the inside bottom of the first hole 11 and the second hole 13. The ink-absorbing member 15 corresponds to a fibrous bulk; for example, open-cell foamed plastic material or non-woven fiber. The ink-absorbing member 15 enables stable storage of the discarded ink droplets 12 without involvement of leakage of the ink. Further, the ink-absorbing member 15 can be readily replaced with a new one.

Figure 8:
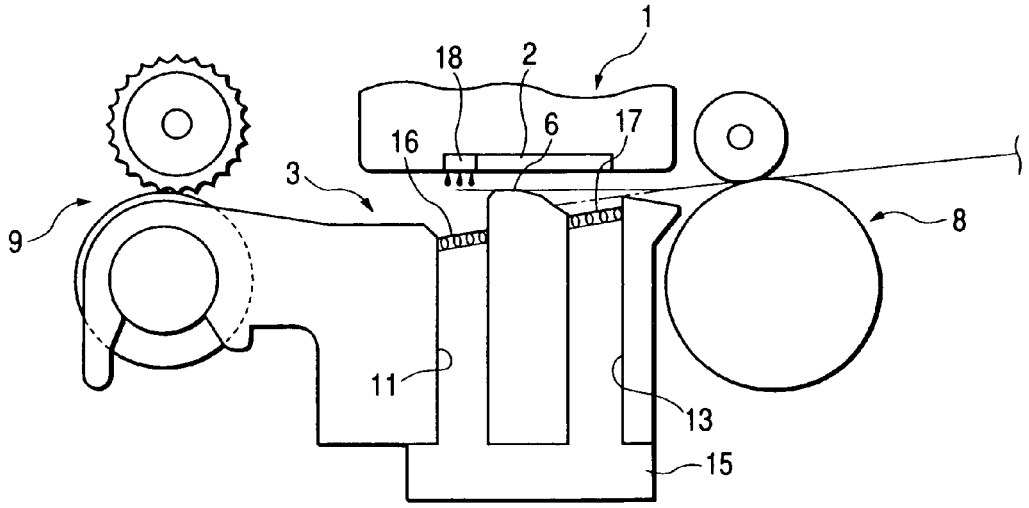
FIG. 8 is a cross-sectional view of the principal section of an ink-jet recording apparatus according to yet another embodiment of the present invention when data are recorded on recording paper without leaving a margin on the top end of the paper.

FIG. 8 shows yet another embodiment of the present invention. A water-repellent net 16 is provided in the opening of the first hole 11, and a water-repellent net 17 is provided in the opening of the second hole 13. The ink-absorbing member 15 is provided within the first and second holes 11 and 13 so as to contact the nets 16 and 17. In this embodiment, since the opening of the first hole 11 is covered with the net 16 and the opening of the second hole 13 is covered with the net 17, the recording paper 4 is transported as if the first hole 11 and the second hole 13 had not been formed in the platen 3, thereby firmly holding the recording paper 4 in position. Further, the discarded ink droplets 12 collide with and adhere to the nets 16 and 17. However, the nets 16 and 17 have a property of repelling water, and hence the ink 12 that has adhered to the nets 16 and 17 is immediately absorbed by the ink-absorbing member 15, thus substantially eliminating residual ink from the surface of the platen 3 which is to contact the recording paper 4. Accordingly, the recording paper 4 is held firmly in position, thereby substantially eliminating the chance of the discarded ink droplets 12 re-adhering to the recording paper 4.

Figure 9:
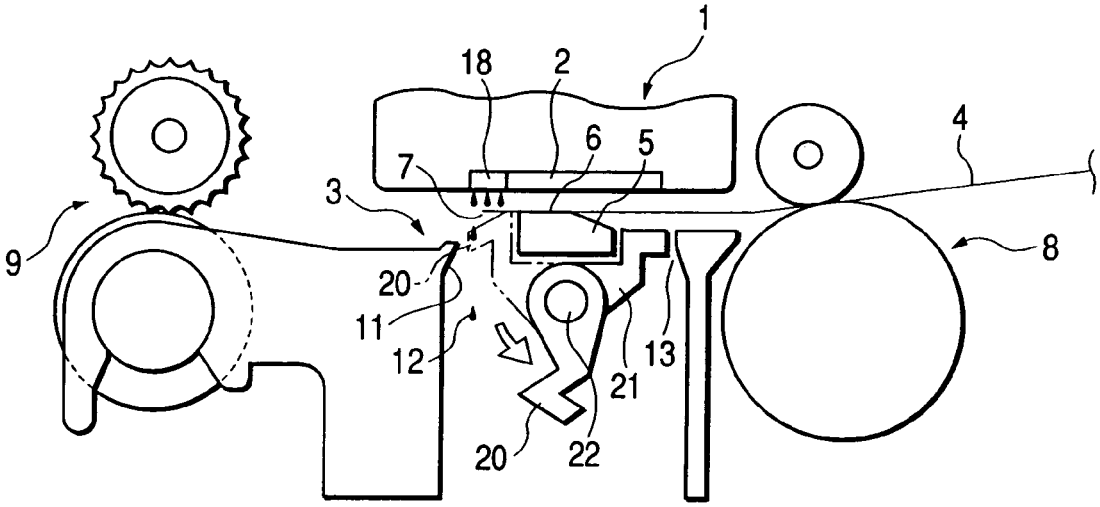
FIG. 9 is a cross-sectional view of the principal section of an ink-jet recording apparatus according to yet another embodiment of the present invention when data are recorded on recording paper without leaving a margin on the top end of the paper.
Figure 10:
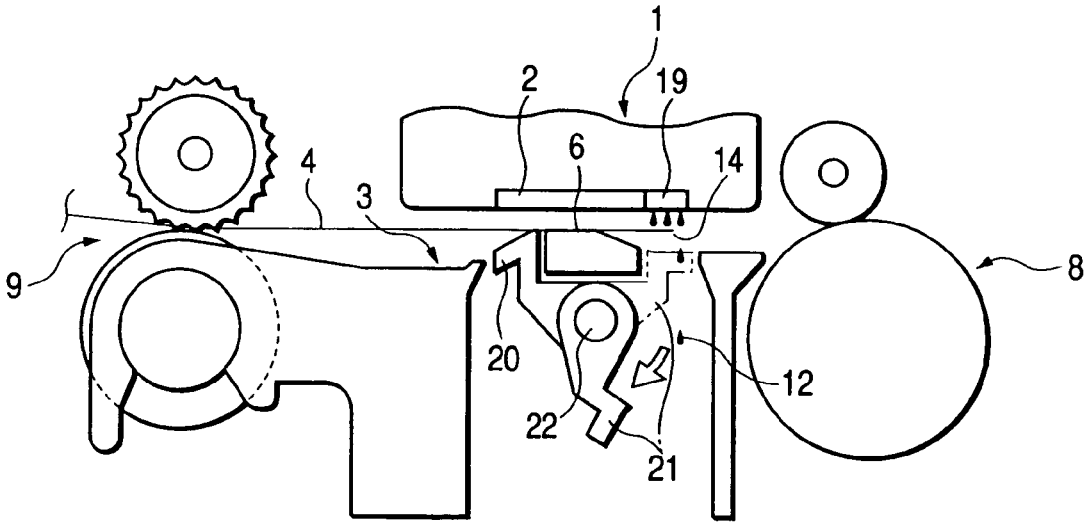
FIG. 10 is a cross-sectional view of the principal section of the ink-jet recording apparatus according to the embodiment shown in FIG. 9 when data are recorded on the recording paper without leaving a margin on the bottom end of the paper.

FIGS. 9 and 10 show still another embodiment of the present invention. A reclosable closure 20 is provided in the opening of the first hole 11, and a reclosable closure 21 is provided in the opening of the second hole 13. When an image is recorded on the recording paper 4 without leaving a margin on the top end 7 (see FIG. 9) or the bottom end 14 (see FIG. 10), the closures 20 and 21 are opened. During a printing operation other than a margin-free printing operation, the closures 20 and 21 are closed. Opening and closing actions of the respective closures 20 and 21 are controlled by an unillustrated control section. In the present embodiment, a pivot 22 is provided in a position below the openings of the first and second holes 11 and 13, and the closures 20 and 21 are pivotally moved about the pivot 22 so as to open or close the holes 11 and 12, by means of an unillustrated drive control section.

In the present embodiment, when an image is recorded on the recording paper 4 without leaving a margin on either the top end 7 or the bottom end 14, the first hole 11 or the second hole 12 is opened by the closure 20 or 21. During a printing operation other than a margin-free printing operation, the closures 20 and 21 are held in a closed position, thus preventing functional wastage. Further, the pivot 22 is located at a position below the openings of the first and second holes 20 and 21, thereby obviating a necessity for providing, in the travel path of the recording paper 4, a mechanism for opening and closing the closures and 21. Accordingly, there can be prevented an increase in the likelihood of a paper jam, which would otherwise be caused when a new member is provided in the recording apparatus.

Figure 27:
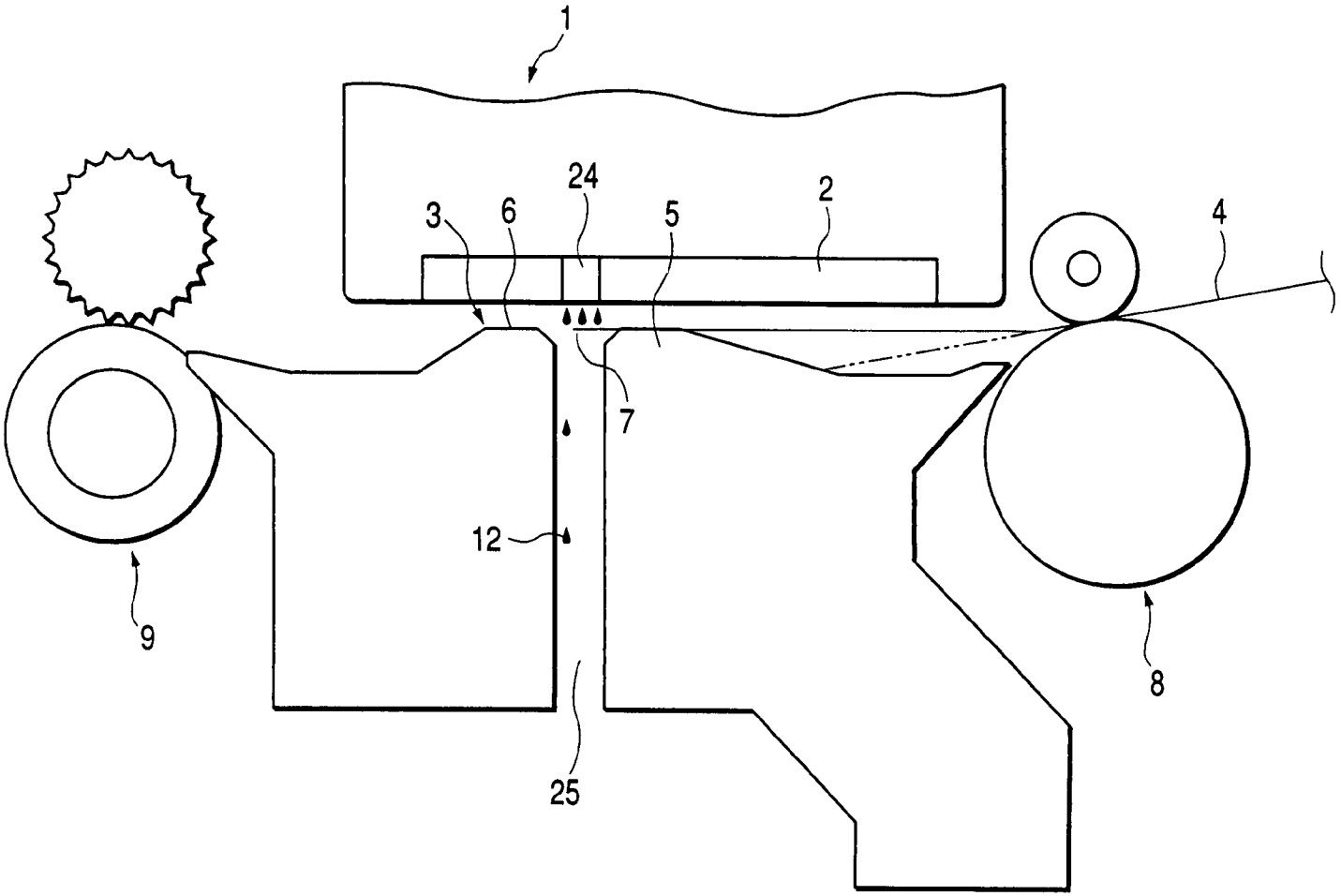
FIG. 27 is a cross-sectional view schematically showing the principal section of the ink-jet recording apparatus having a center hole according to the present embodiment; specifically, showing the principal section when an image is recorded on the top end of the recording paper.
Figure 28:
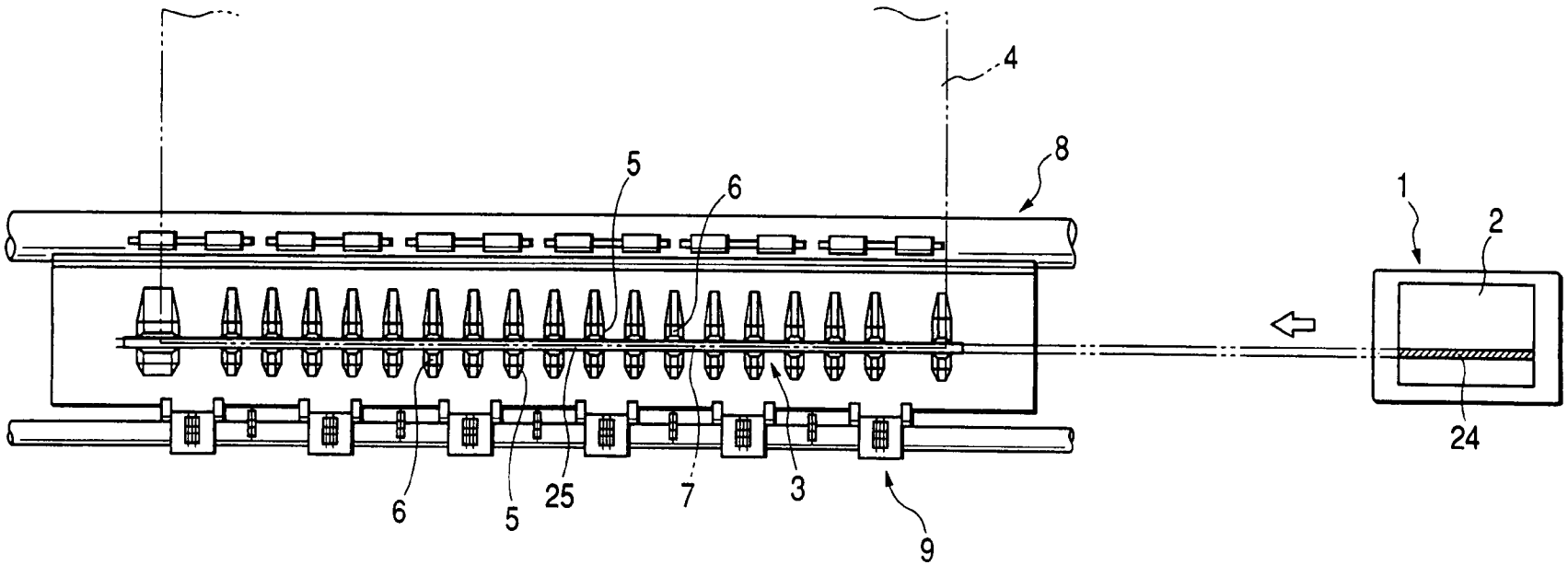
FIG. 28 is a plan view showing the principal section of the ink-jet recording apparatus when the ink-jet recording apparatus shown in FIG. 27 records an image on the top end of the recording paper.

FIG. 27 is a cross-sectional view schematically showing the principal section of the ink-jet recording apparatus having a center hole according to the present embodiment; specifically, showing the principal section when an image is recorded on the top end 7 of the recording paper 4. FIG. 28 is a plan view showing the principal section of the ink-jet recording apparatus when the ink-jet recording apparatus shown in FIG. 27 records an image on the top end 7 of the recording paper 4. The flat tops 6 for supporting the recording paper 4 from below are provided in the area of the platen 3 opposite the nozzle array 2, and the center hole 25 is provided in the longitudinal direction of the platen 3 so as to run across substantially the centers of the tops 6 with respect to the direction in which the recording paper 4 is to be transported. A portion 24 of the nozzle array 2 provided opposite the center hole 25 is used for margin-free printing operation. The ink droplets 12—which have wastefully been squirted outside the top end 7 or the bottom end 14 of the recording paper 4 when an image is recorded on the recording paper 4 without leaving a margin on either the top end 7 or the bottom end 14—is guided into the center hole 25.

By means of such a structure, the recording paper 4 is stably supported by the flat tops 6, and recording of an image on the recording paper 4 without leaving a margin on the top end 7 and/or the bottom end 13 can be executed by use of a single center hole 25.

Figure 29:
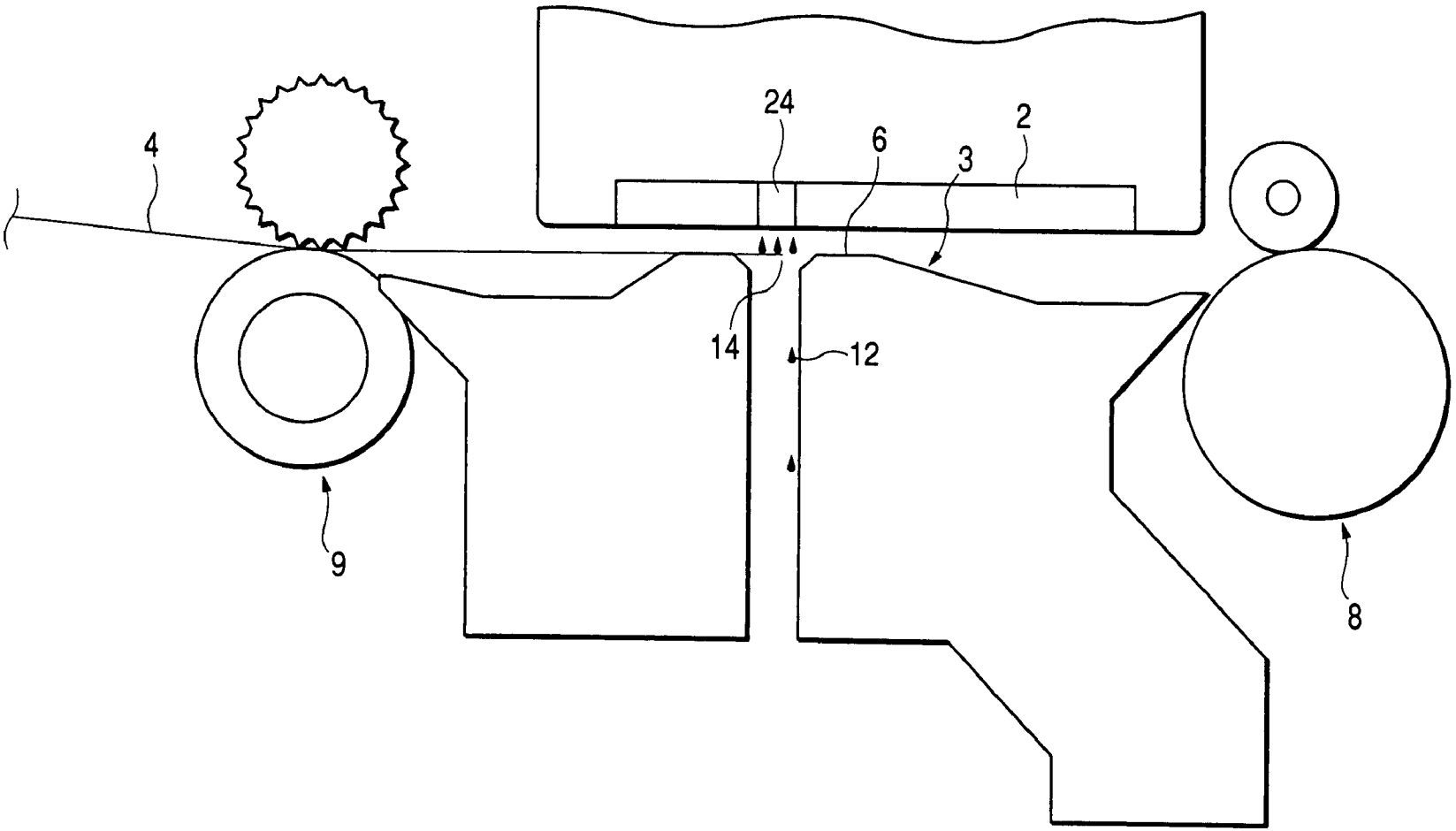
FIG. 29 is a cross-sectional view schematically showing the principal section of the ink-jet recording apparatus having the center hole when an image is recorded on the bottom end of the recording paper.
Figure 30:
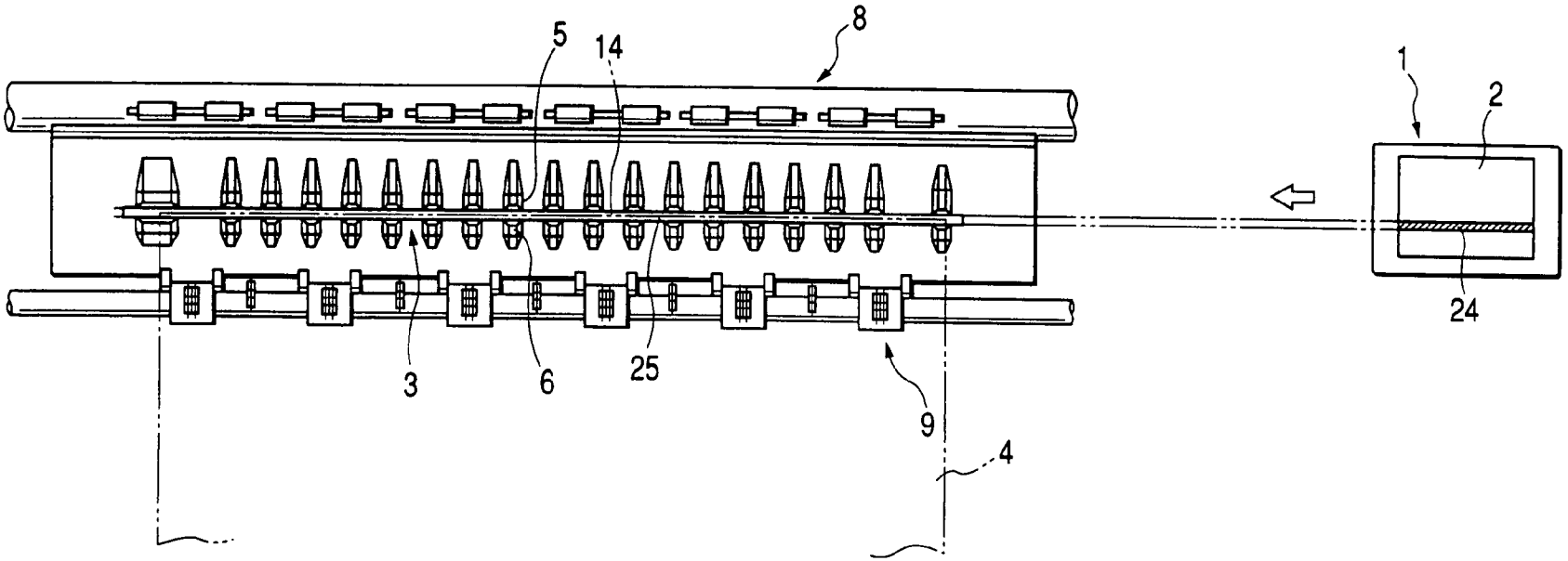
FIG. 30 is a plan view showing the principal section of the ink-jet recording apparatus when the ink-jet recording apparatus shown in FIG. 29 records an image-on the bottom end of the recording paper.

FIG. 29 is a cross-sectional view schematically showing the principal section of the ink-jet recording apparatus having the center hole 25 when an image is recorded on the bottom end 14 of the recording paper 4. FIG. 30 is a plan view showing the principal section of the ink-jet recording apparatus when the ink-jet recording apparatus shown in FIG. 29 records an image on the bottom end 14 of the recording paper 4. Since FIGS. 29 and 30 are in principle identical with FIGS. 27 and 28, the reference numerals which are the same as those provided in FIGS. 27 and 28 are assigned to FIGS. 29 and 30, and explanations of FIGS. 29 and 30 are omitted.

Figure 31:
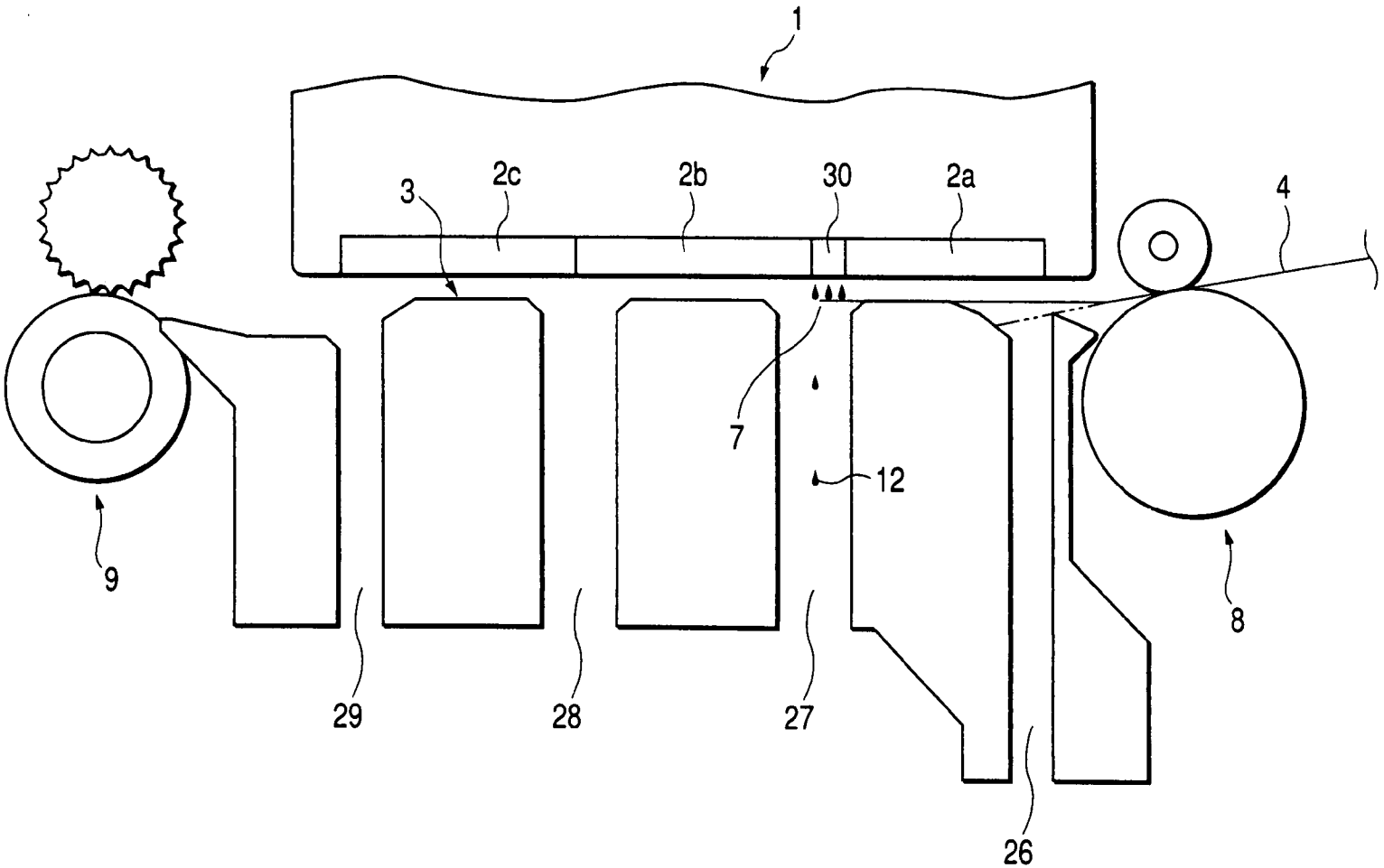
FIG. 31 shows an ink-jet recording apparatus of the present embodiment, in which three nozzle arrays corresponding to the respective three primary colors are arranged in the secondary scanning direction.
Figure 32:
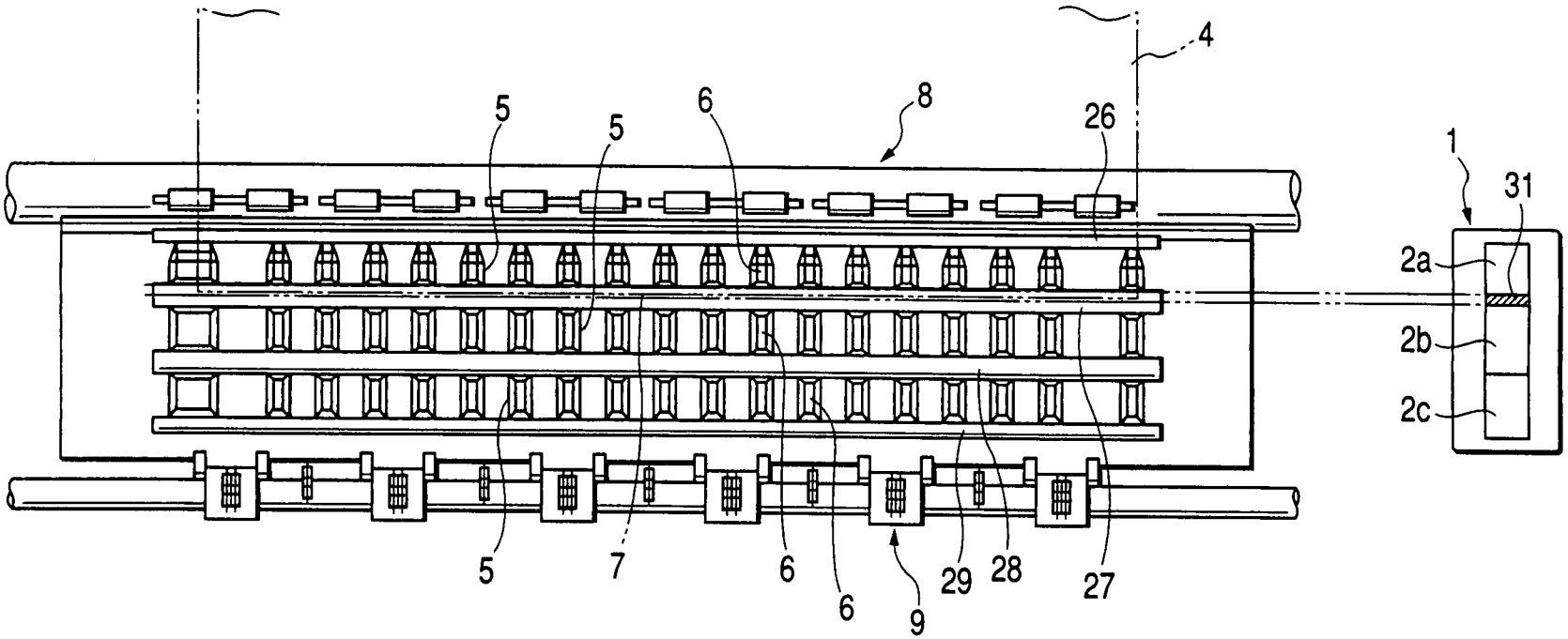
FIG. 32 is a plan view showing the principal section of the ink-jet recording apparatus when the ink-jet recording apparatus shown in FIG. 31 records an image on the top end of the recording paper.

FIG. 31 shows an ink-jet recording apparatus of the present embodiment, in which three nozzle arrays 2*a*, 2*b*, and 2*c* corresponding to the respective three primary colors are arranged in the secondary scanning direction. Specifically, FIG. 31 is a cross-sectional view schematically showing the principal section of the ink-jet recording apparatus when an image is recorded on the top end 7 of the recording paper 4. FIG. 32 is a plan view showing the principal section of the ink-jet recording apparatus when the ink-jet recording apparatus shown in FIG. 31 records an image on the top end 7 of the recording paper 4. The recording head 1 is equipped with the three nozzle arrays 2*a*, 2*b*, and 2*c* for the three primary colors, in which a plurality of nozzles are arranged in the secondary scanning direction. The nozzle arrays 2*a*, 2*b*, and 2*c* are arranged in the secondary scanning direction, in the sequence given. The drawings show a state in which a portion 30 of the nozzle array 2*a* located at the furthest upstream position is performing a limited interlaced recording operation, thereby recording an image on the recording paper 4 without leaving a margin on the top end 7.

In the area of the platen 3 opposite the nozzle array 2*a* assigned to one color, a second hole 26 is formed at an upstream position with respect to the secondary scanning direction, and a first hole 27 is formed at a downstream position with respect to the same. Further, in the area of the platen 3 opposite the nozzle array 2*b* assigned to another color, a second hole 27 (i.e., the first hole 27 acting as a second hole) is formed at an upstream position with respect to the secondary scanning direction, and a first hole 28 is formed at a downstream position with respect to the same. Further, in the area of the platen 3 opposite the nozzle array 2*c* assigned to still another color, a second hole 28 is formed at an upstream position with respect to the secondary scanning direction, and a first hole 29 is formed at a downstream position with respect to the same. As mentioned above, the first hole 27 of the nozzle array 2*a* acts also as the second hole 27 of the nozzle array 2*b*. Similarly, the first hole 28 of the nozzle array 2*b* acts also as the second hole 28 of the second nozzle array 2*c*.

The ink droplets which have been squirted outside the top end 7 of the recording paper 4 from the nozzle arrays 2*a*, 2*b*, and 2*c* of respective colors when an image is recorded on the recording paper 4 without leaving a margin on the top end 7 are guided to the first hole 27. Similarly, the ink droplets which have been squirted outside the bottom end 14 of the recording paper 4 from the nozzle arrays 2*a*, 2*b*, and 2*c* of respective colors when an image is recorded on the recording paper 4 without leaving a margin on the bottom end 14 are guided to the second hole 26.

Even in a case where a plurality of color nozzles are arranged in a vertical column, the color nozzles are assigned respective hole pairs; that is, a pair consisting of the first hole 27 and the second hole 26, a pair consisting of the first hole 28 and the second hole 27, and a pair consisting of the first hole 29 and the second hole 28. As in the case of a recording head having color nozzles arranged horizontally, the recording head can record an image on either the top end 7 or the bottom end 14 of the recording paper 4 without leaving a margin.

Figure 33:
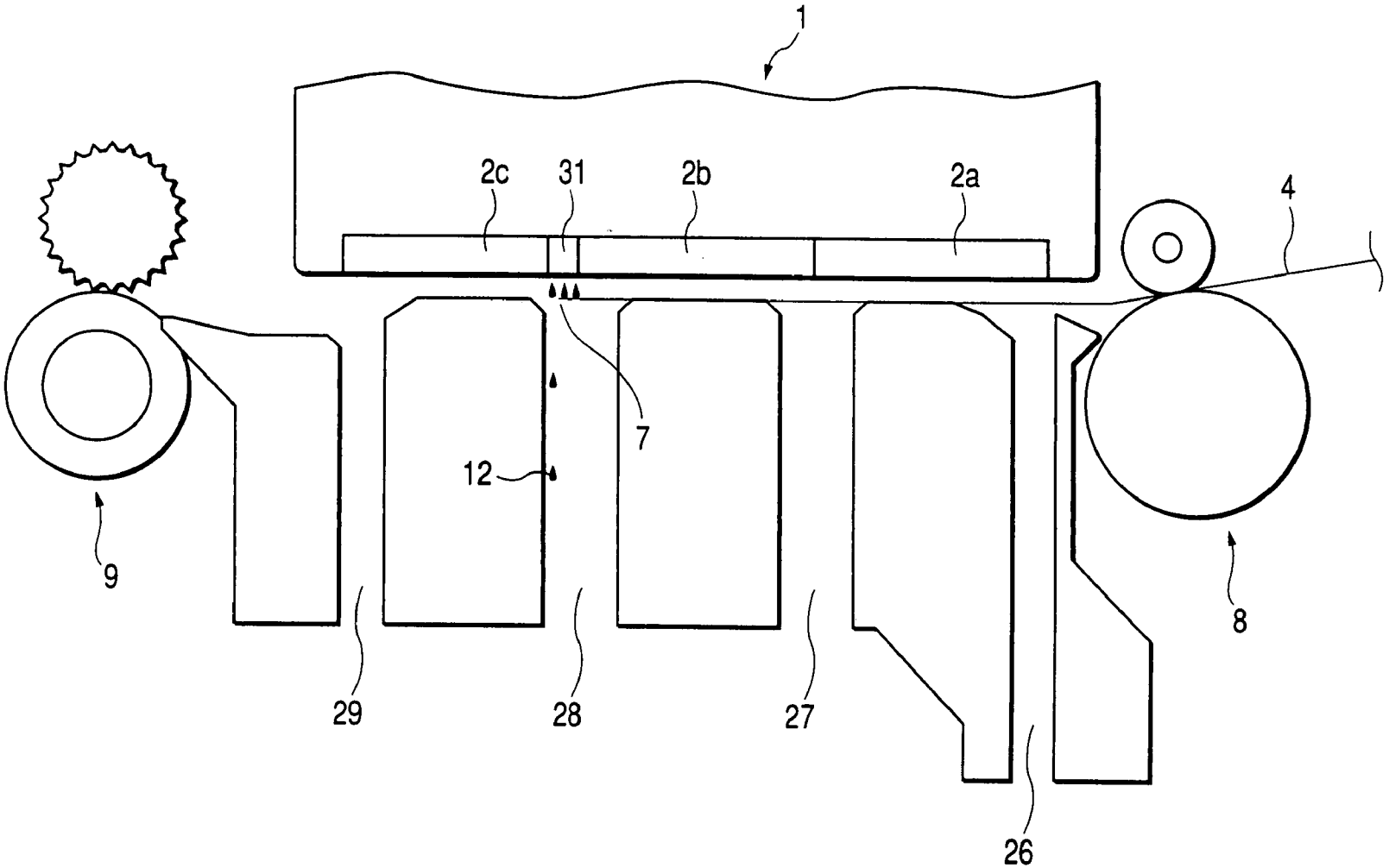
FIG. 33 is a cross-sectional view schematically showing the principal section of the ink-jet recording apparatus when an image is recorded on the top end of the recording paper by means of the nozzle array located in the center of a recording head of the embodiment having three color nozzle arrays arranged in a secondary scanning direction.
Figure 34:
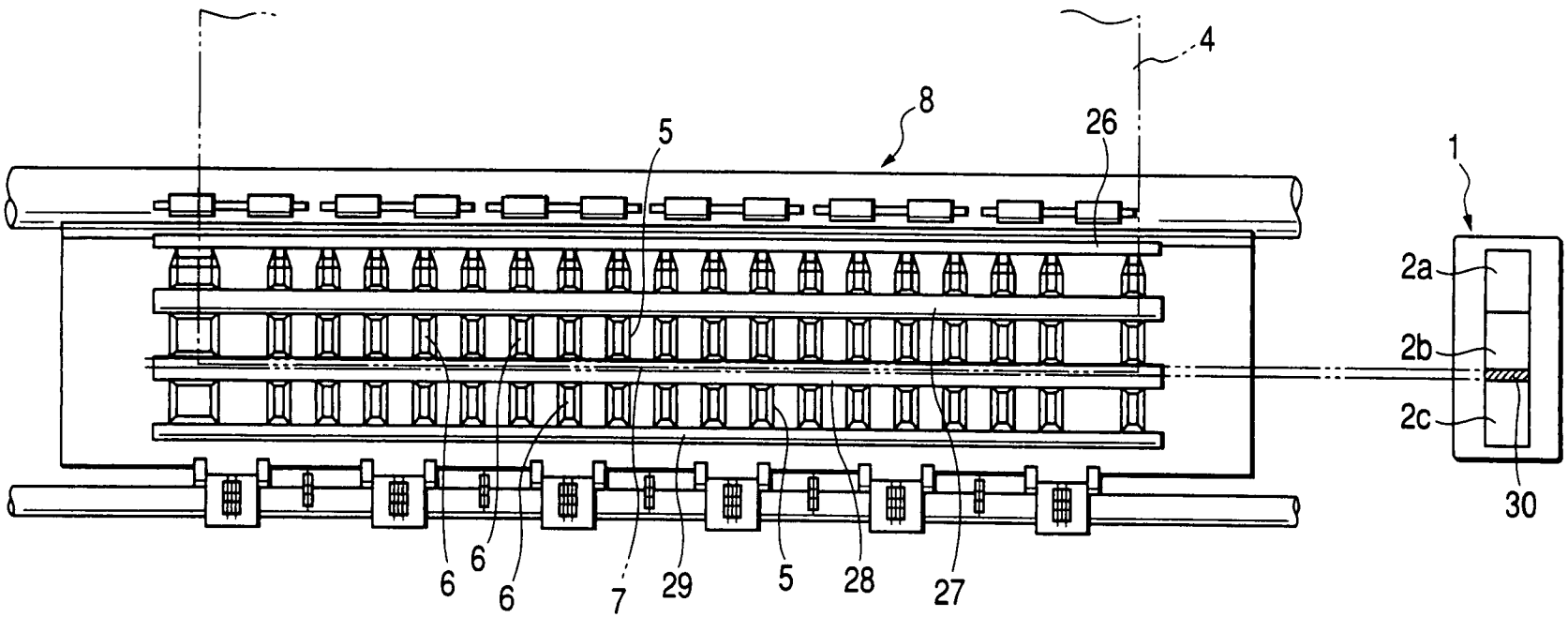
FIG. 34 is a plan view showing the principal section of the ink-jet recording apparatus when the ink-jet recording apparatus shown in FIG. 33 records an image on the top end of the recording paper.

FIG. 33 is a cross-sectional view schematically showing the principal section of the ink-jet recording apparatus when an image is recorded on the top end 7 of the recording paper 4 by means of the nozzle array 2*b* located in the center of the recording head 1. FIG. 34 is a plan view showing the principal section of the ink-jet recording apparatus when the ink-jet recording apparatus shown in FIG. 33 records an image on the top end 7 of the recording paper 4.

Figure 35:
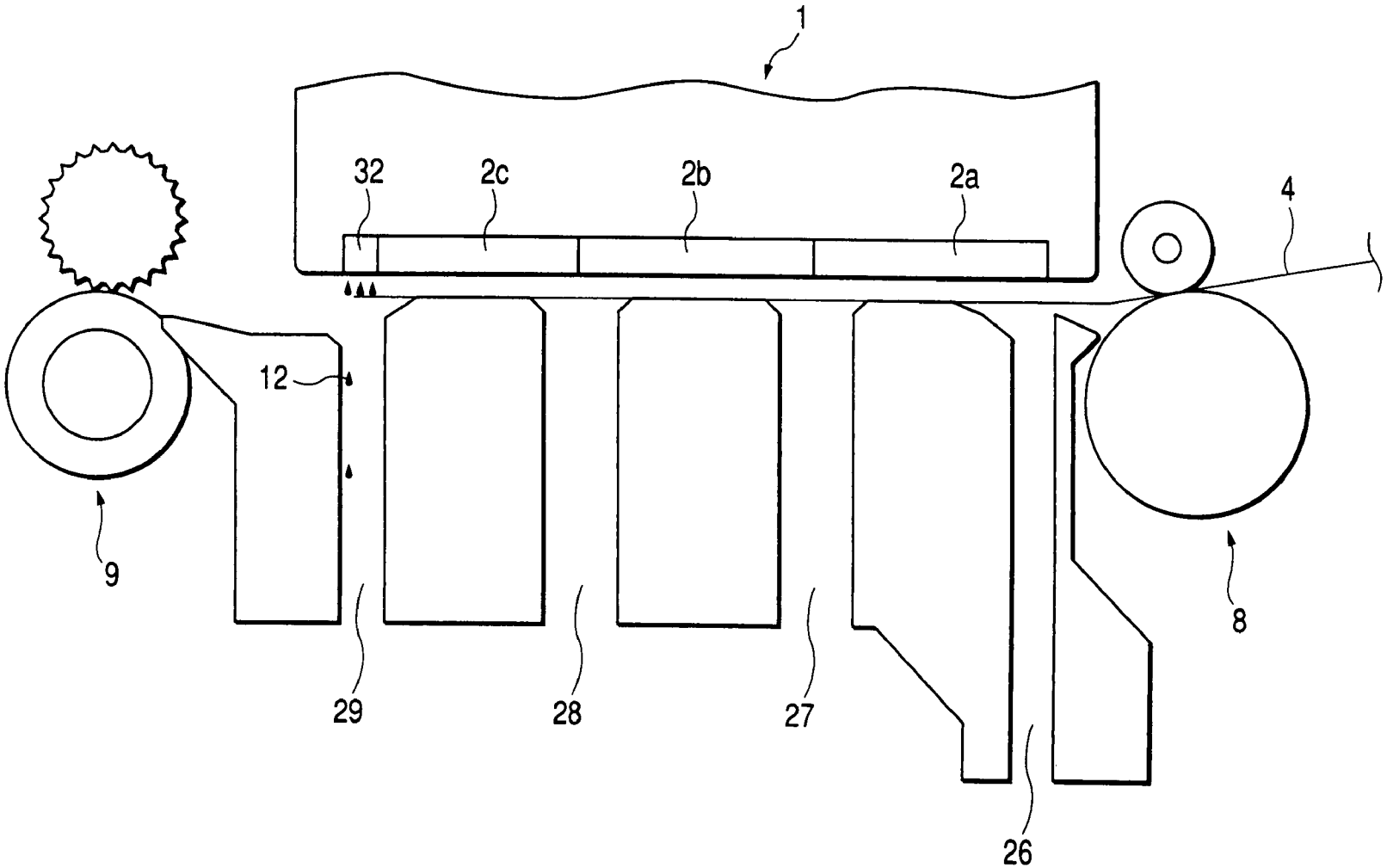
FIG. 35 is a cross-sectional view schematically showing the principal section of the ink-jet recording apparatus when an image is recorded on the top end of recording paper by means of a nozzle array located at a downstream position on the recording head of the embodiment having three color nozzle arrays arranged in a secondary scanning direction.
Figure 36:
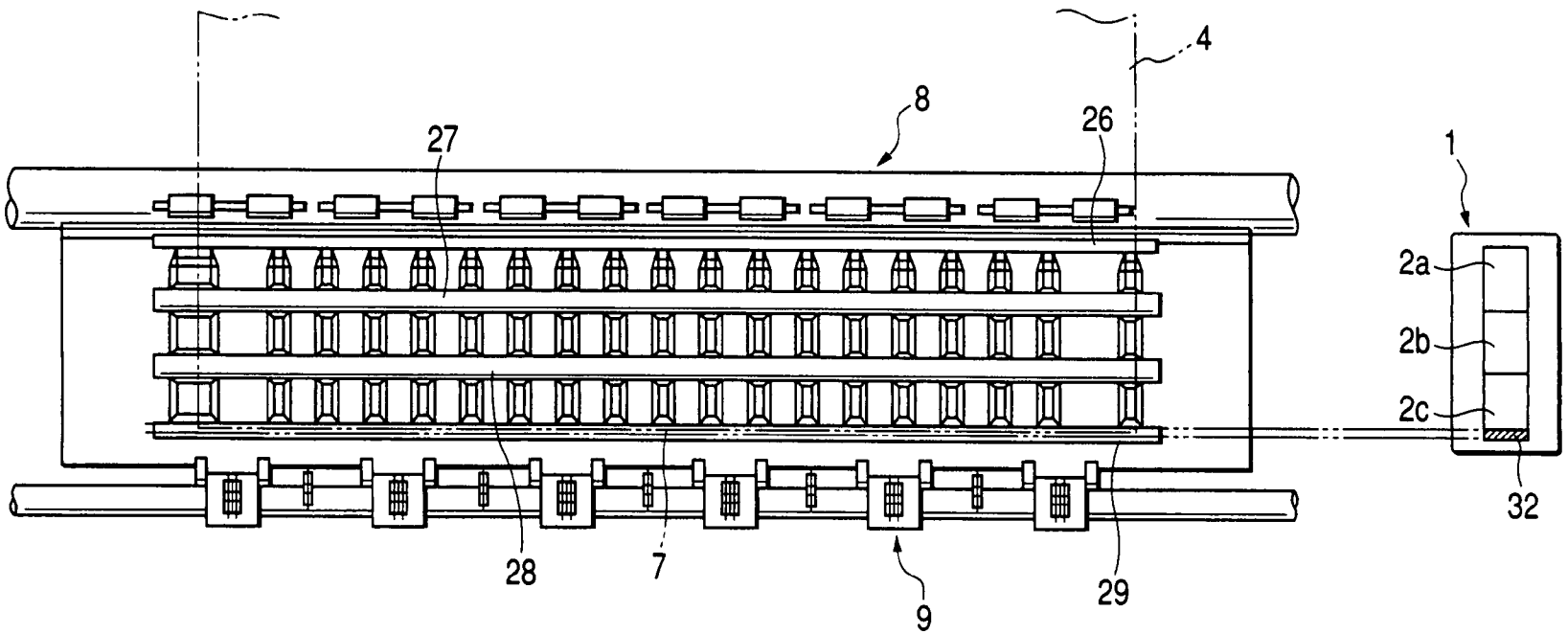
FIG. 36 is a plan view showing the principal section of the ink-jet recording apparatus shown when the ink-jet recording apparatus shown in FIG. 35 records an image on the top end of the recording paper.

FIG. 35 is a cross-sectional view schematically showing the principal section of the ink-jet recording apparatus when an image is recorded on the top end 7 of the recording paper 4 by means of the nozzle array 2*c* located at a downstream position on the recording head 1. FIG. 36 is a plan view showing the principal section of the ink-jet recording apparatus shown when the ink-jet recording apparatus shown in FIG. 35 records an image on the top end 7 of the recording paper 4.

As mentioned above, images of three colors can be readily recorded on the recording paper 4 without leaving a margin.

Figure 37:
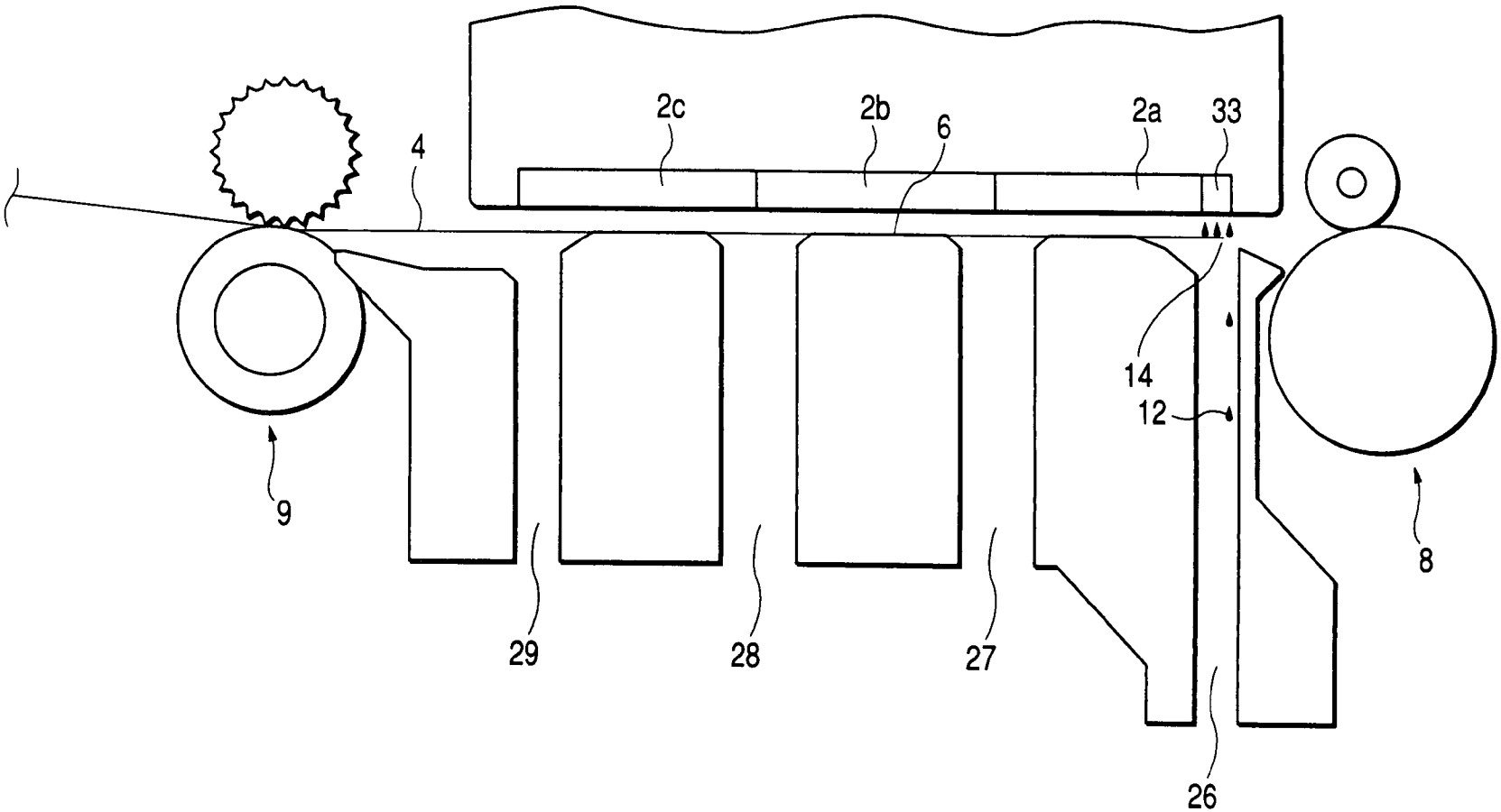
FIG. 37 is a cross-sectional view schematically showing the principal section of the ink-jet recording apparatus when an image is recorded on the bottom end of the recording paper by means of the nozzle array located at an upstream position of a recording head of the embodiment having three color nozzle arrays arranged in a secondary scanning direction.
Figure 38:
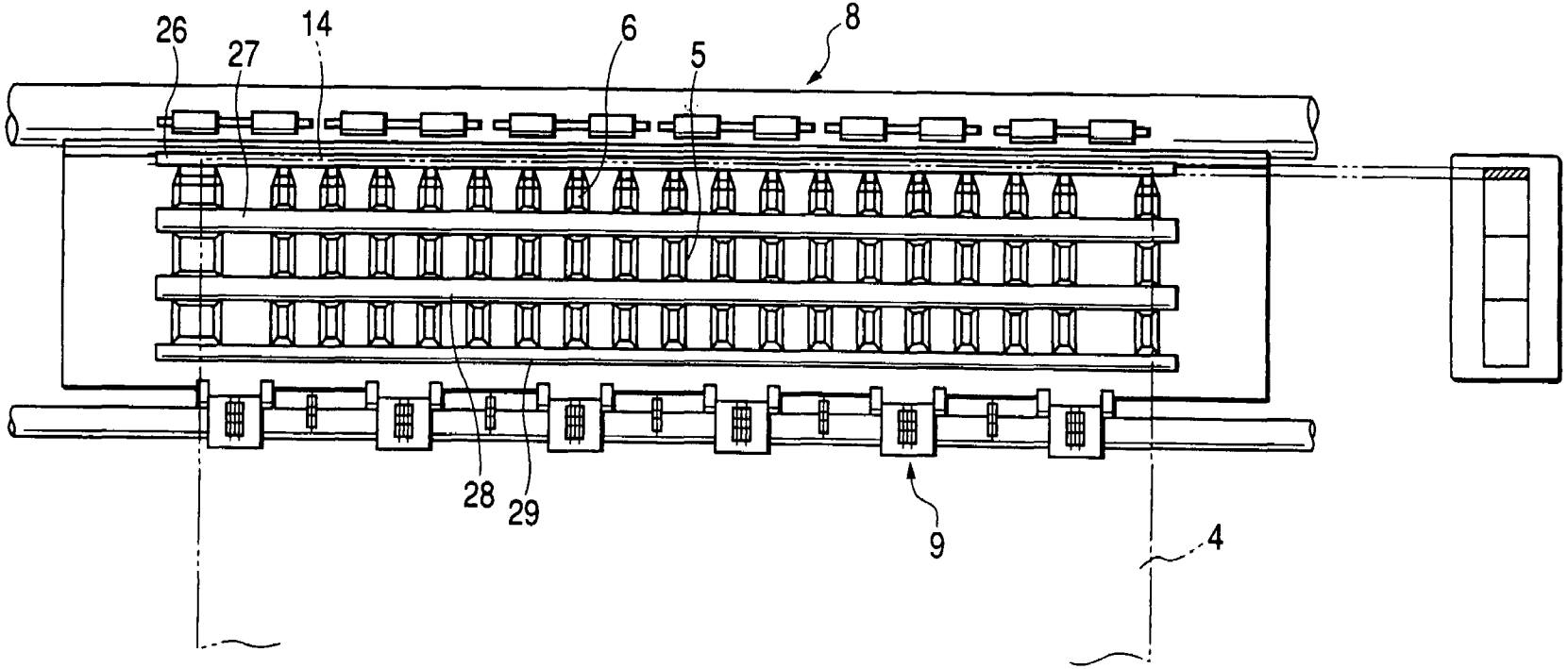
FIG. 38 is a plan view showing the principal section of the ink-jet recording apparatus when the ink-jet recording apparatus shown in FIG. 37 records an image on the bottom end of the recording paper.

FIG. 37 is a cross-sectional view schematically showing the principal section of the ink-jet recording apparatus when an image is recorded on the bottom end 14 of the recording paper 4 by means of the nozzle array 2*a* located at an upstream position the recording head 1. FIG. 38 is a plan view showing the principal section of the ink-jet recording apparatus when the ink-jet recording apparatus shown in FIG. 37 records an image on the bottom end 14 of the recording paper 4. In this case, the second hole 26 is used for receiving discarded ink.

Figure 39:
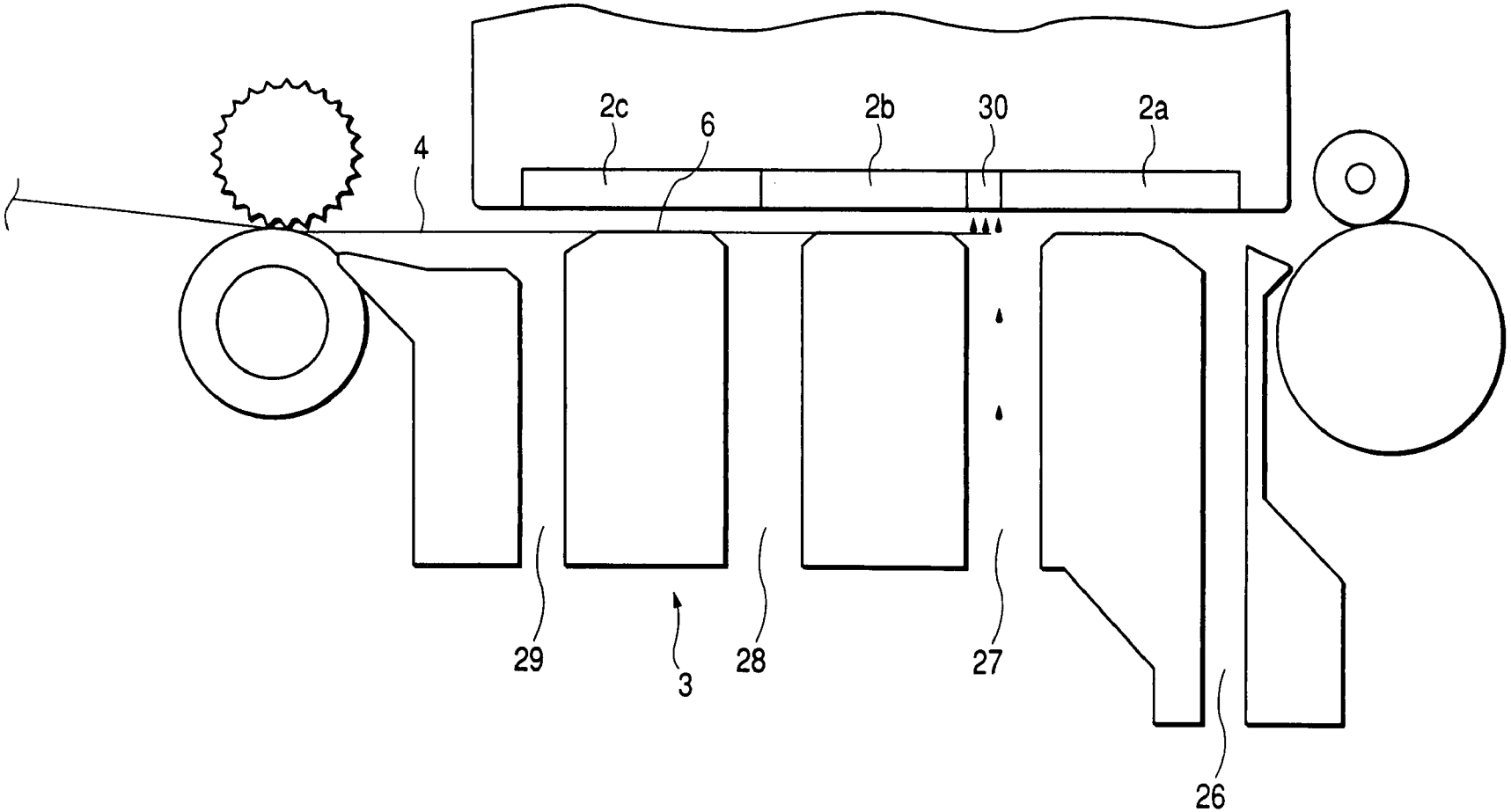
FIG. 39 is a cross-sectional view schematically showing the principal section of the ink-jet recording apparatus when an image is recorded on the bottom end of recording paper by means of a nozzle array located in the center of the recording head of the embodiment having three color nozzle arrays arranged in a secondary scanning direction.
Figure 40:
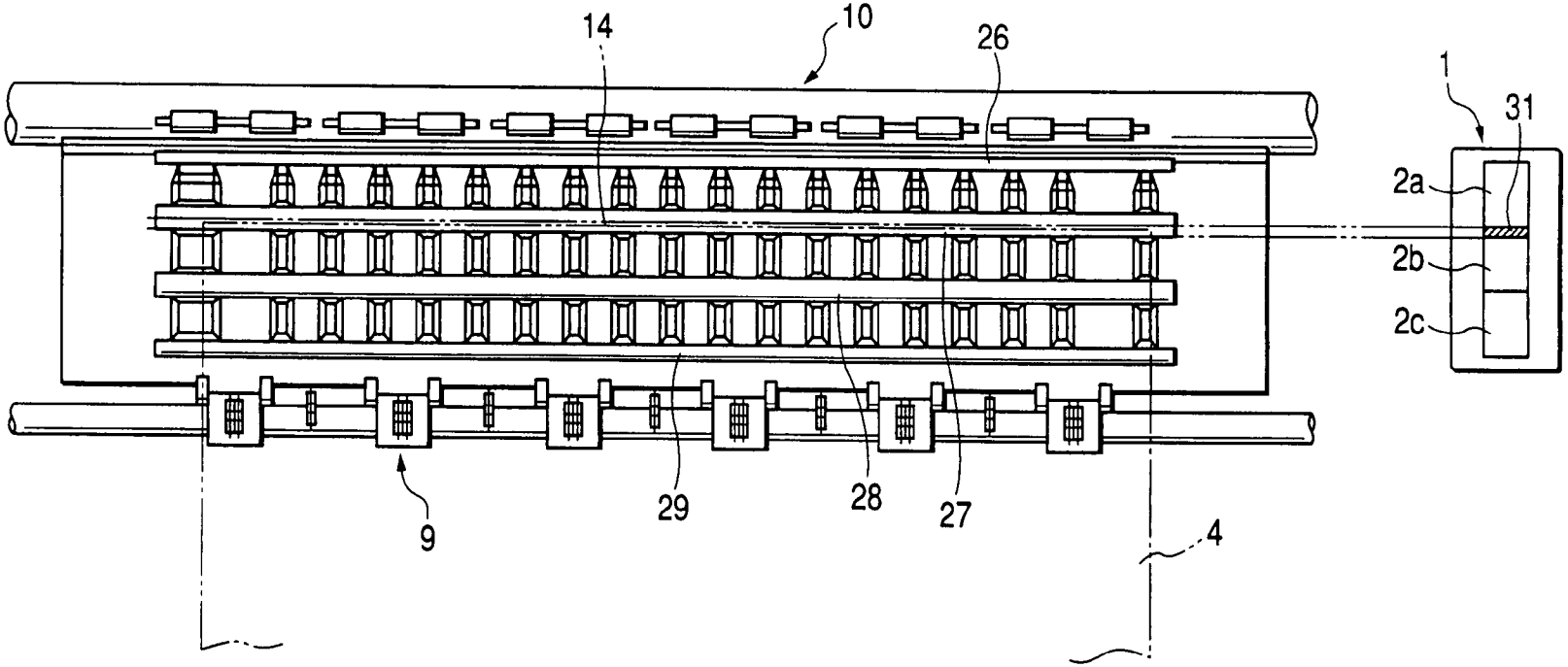
FIG. 40 is a plan view showing the principal section of the ink-jet recording apparatus shown when the ink-jet recording apparatus shown in FIG. 39 records an image on the bottom end of the recording paper.

FIG. 39 is a cross-sectional view schematically showing the principal section of the ink-jet recording apparatus when an image is recorded on the bottom end 14 of the recording paper 4 by means of the nozzle array 2*b* located in the center of the recording head 1. FIG. 40 is a plan view showing the principal section of the ink-jet recording apparatus shown when the ink-jet recording apparatus shown in FIG. 39 records an image on the bottom end 14 of the recording paper 4. In this case, the second hole 27 is used for receiving discarded ink.

Figure 41:
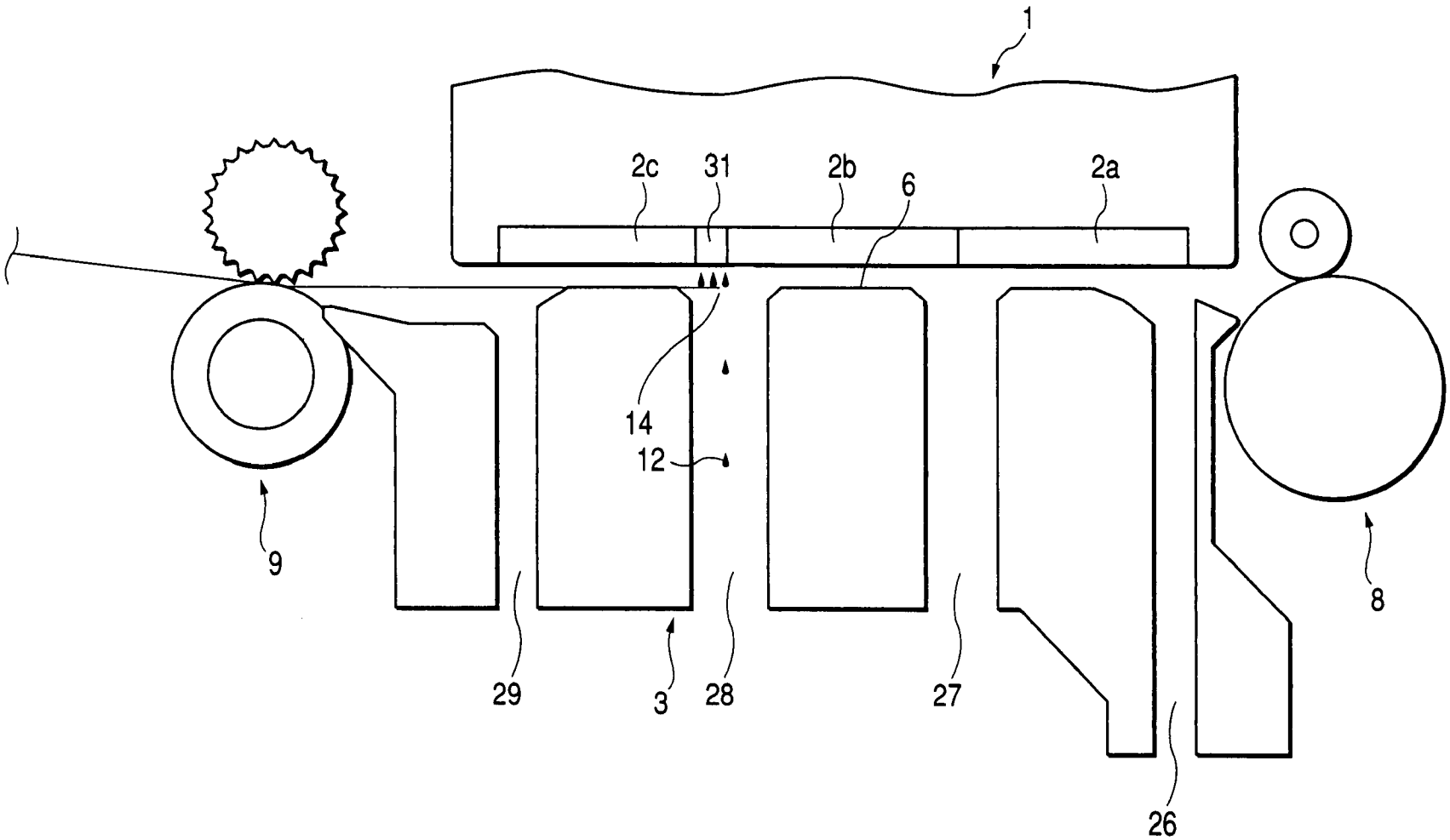
FIG. 41 is a cross-sectional view schematically showing the principal section of the ink-jet recording apparatus when an image is recorded on the bottom end of the recording paper by means of the nozzle array located at a downstream position of a recording head of the embodiment having three color nozzle arrays arranged in a secondary scanning direction.
Figure 42:
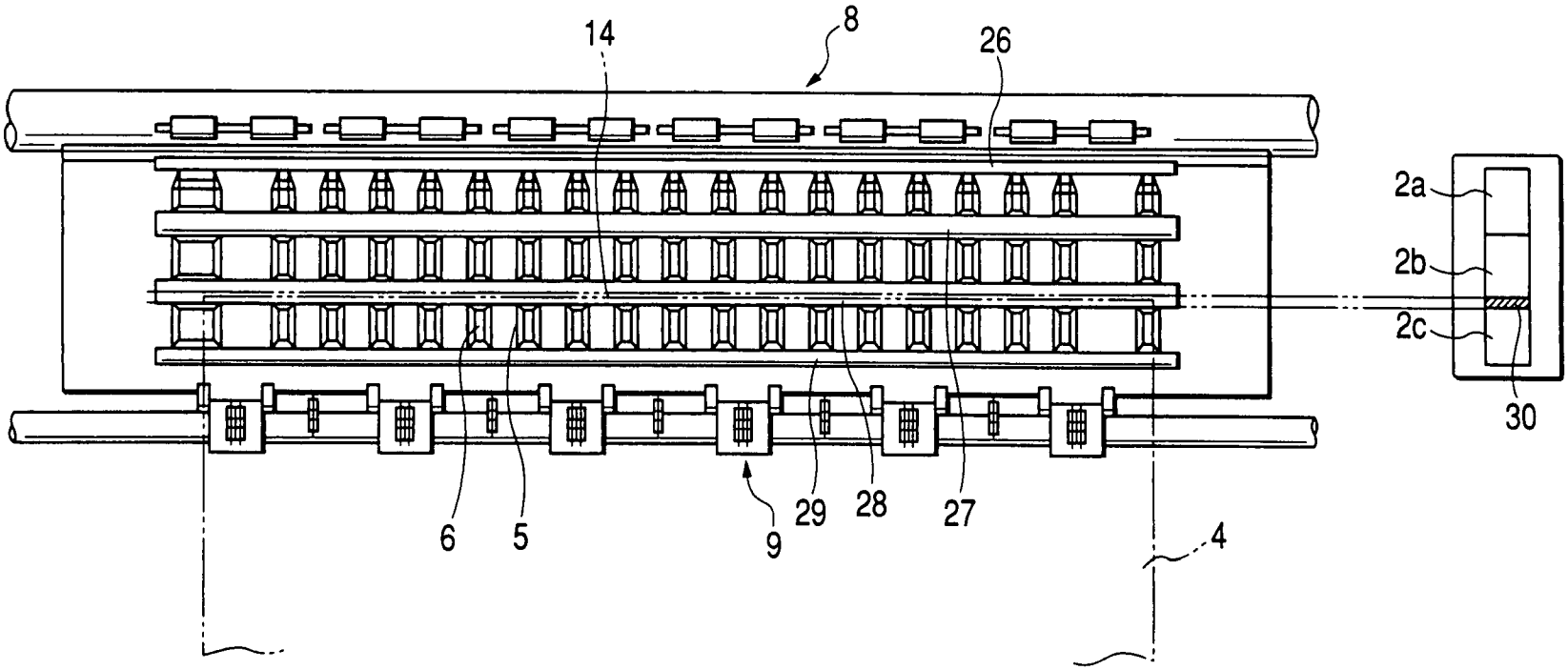
FIG. 42 is a plan view showing the principal section of the ink-jet recording apparatus shown when the ink-jet recording apparatus shown in FIG. 41 records an image on the bottom end of the recording paper.

FIG. 41 is a cross-sectional view schematically showing the principal section of the ink-jet recording apparatus when an image is recorded on the bottom end 14 of the recording paper 4 by means of the nozzle array 2*c* located at a downstream position on the recording head 1. FIG. 42 is a plan view showing the principal section of the ink-jet recording apparatus when the ink-jet recording apparatus shown in FIG. 41 records an image on the bottom end 14 of the recording paper 4. In this case, the second hole 28 is used for receiving discarded ink.

Recording without Leaving a Margin on Either Side of a Recording Paper

There will now be described an embodiment of the present invention, in which an image is recorded on a recording medium without leaving a margin on either side of the recording medium, by reference to FIGS. 11 through 24. Reference numerals are commonly used through only FIGS. 11 through 24. Those reference numerals provided in FIGS. 11 through 24 are irrelevant to those shown in FIGS. 1 through 10, FIGS. 25A through 25D, FIGS. 26A through 26D, and FIGS. 27 through 43. The following description is based on the premise that those reference numerals which are shown in FIGS. 11 through 24 and are the same as those employed in FIGS. 1 through 10, FIGS. 25A through 25D, FIGS. 26A through 26D, and FIGS. 27 through 43 do not designate the same elements.

Figure 24:
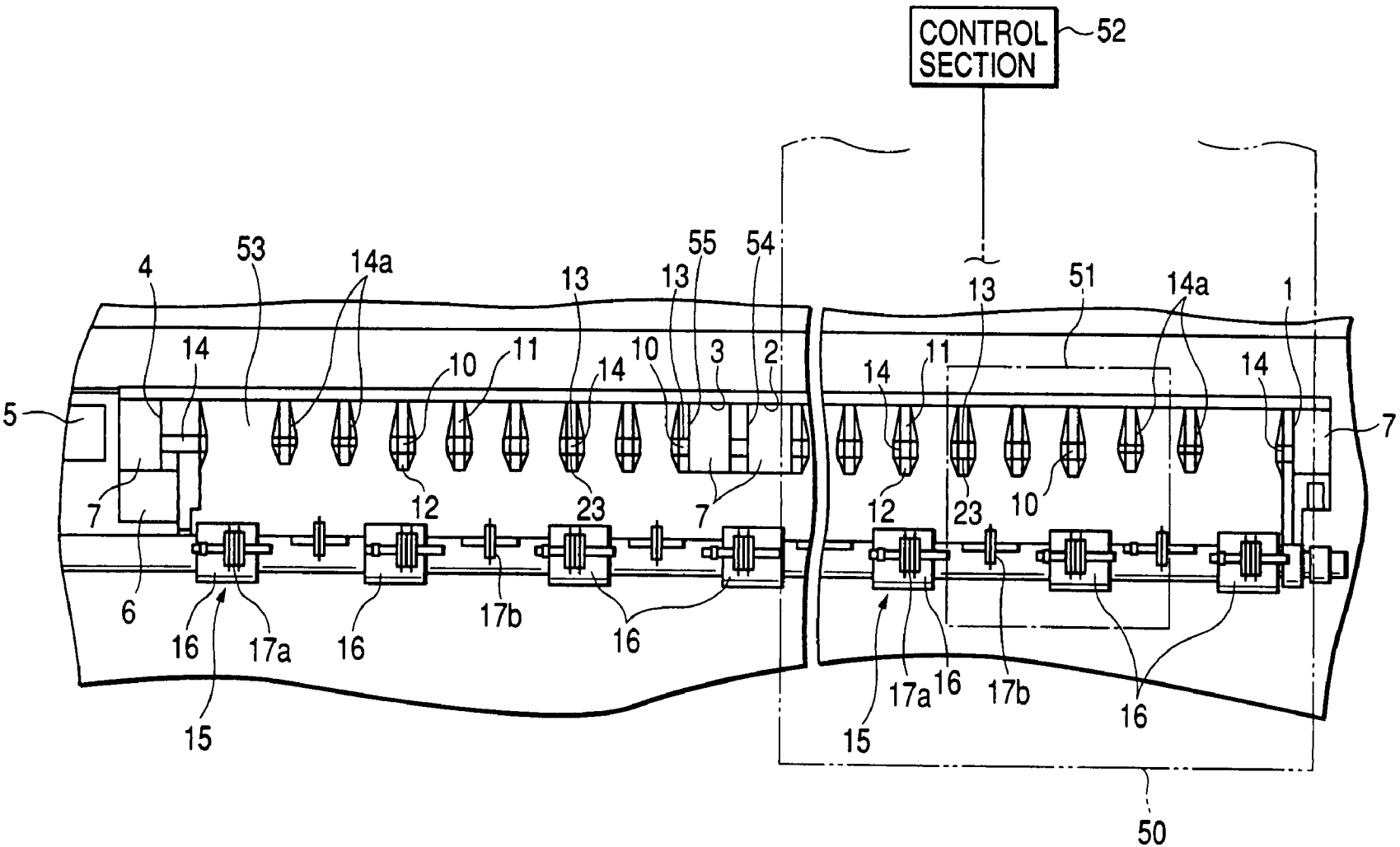
FIG. 24 is a plan view showing a platen of the ink-jet recording apparatus according to an embodiment of the present invention.
Figure 25A:
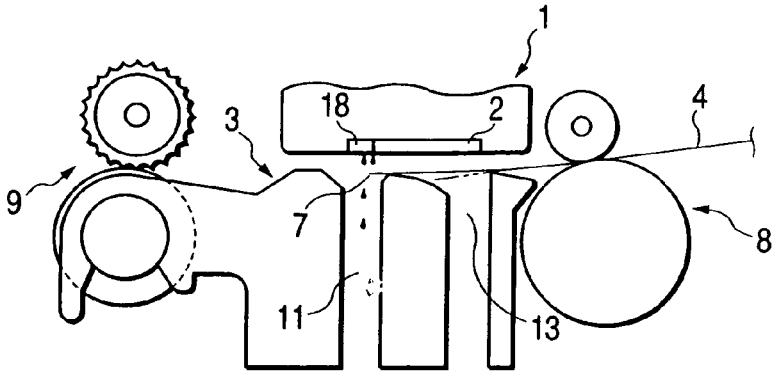
FIGS. 25A through 25D show printing processes during which data are recorded on a recording medium without leaving a margin on the top end, by means of performing margin-free interlaced recording operation through use of the ink-jet recording apparatus shown in FIG. 1.
Figure 25B:
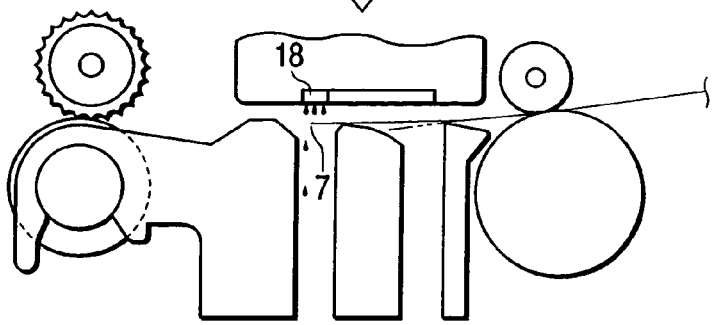
Figure 25C:
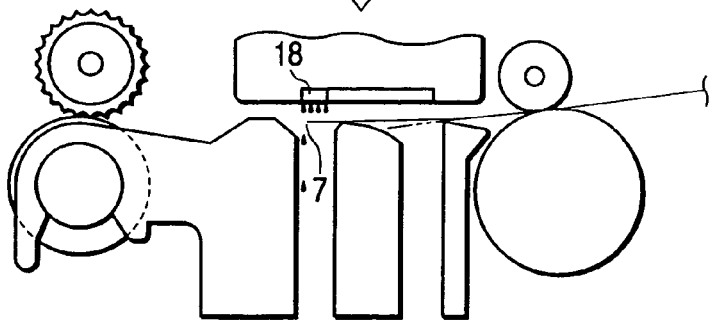
Figure 25D:
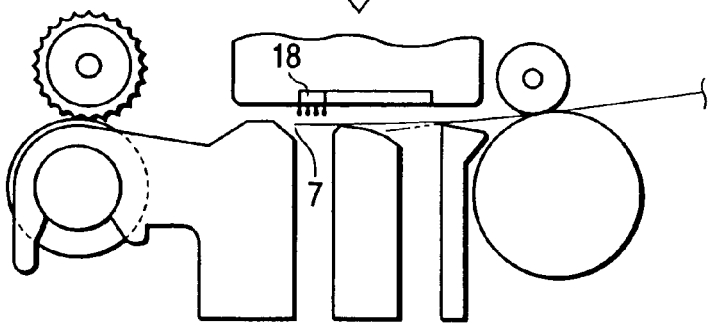
Figure 26A:
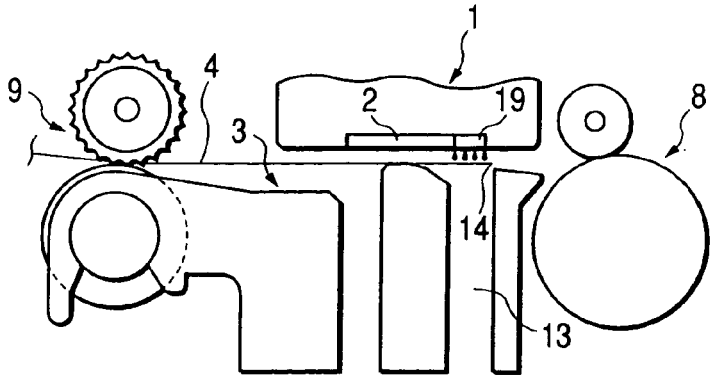
FIGS. 26A through 26D show printing processes during which data are recorded on a recording medium without leaving a margin on the bottom end, by means of performing margin-free interlaced recording operation through use of the ink-jet recording apparatus shown in FIG. 1.
Figure 26B:
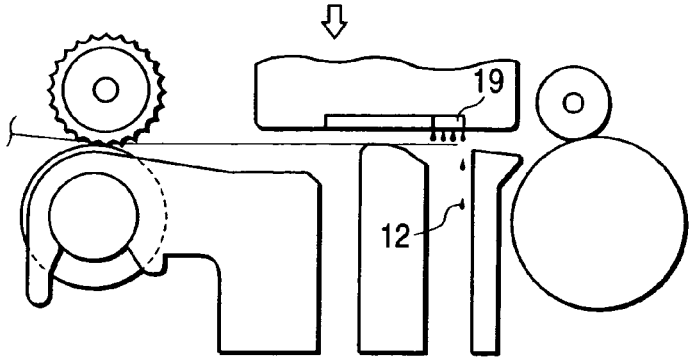
Figure 26C:
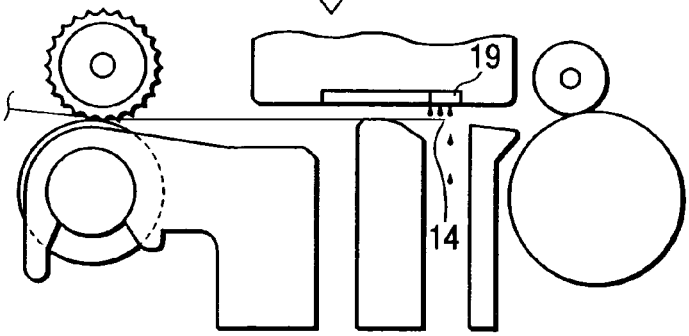
Figure 26D:
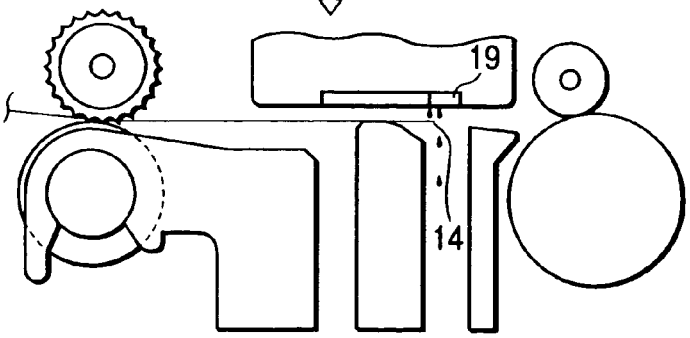

FIG. 24 is a plan view showing a platen of the ink-jet recording apparatus according to an embodiment of the present invention. The structure of the platen will be described schematically by reference to FIG. 24.

In the area of the platen with which a recording medium 50 is to come into contact, a plurality of protuberances 14 are formed at intervals with respect to the primary scanning direction of a recording head. Each of the protuberances 14 is formed into an elongated shape with respect to the direction in which the recording medium 50 is to be transported. The protuberance 14 has a flat top 10, and the top 10 defines a clearance between the recording medium 50 which is to be transported over the top 10 in the secondary scanning direction and the recording head; i.e., a paper gap. A sloping surface 11 is provided on and adjacent to the upstream side of the top 10 of the protuberance 14, and the top end of the recording medium 50 fed from an upstream direction is guided over, while remaining in contact with, the sloping surface 11, to thereby reach the top 10. Reference numeral 12 designates a sloping surface provided on the downstream side of the top 10 of the protuberance 14.

As shown in FIG. 24, through holes 1, 2, 3, and 4 are formed in the platen. In the present embodiment, the recording medium 50 is transported in the secondary scanning direction while one side of the recording medium 50 aligned with the through hole 1 is taken as a reference. The other side of the recording medium 50 assumes a different position according to the width of the recording medium 50. The through holes 2, 3, and 4 are formed in the platen so as to cope with the other side of the recording medium 50 of any size that can be accommodated by the recording apparatus. In the present embodiment, the through holes 2, 3, and 4 are formed in the respective spaces between the protuberances 14, and each of the respective through holes 1, 2, 3, and 4 is filled with an ink-absorbing material 7. Detailed description of the through holes 1, 2, 3, and 4 and of how the ink-absorbing material 7 is fitted into the through holes 1 through 4 will be provided later. In FIG. 24, reference numeral 5 designates an aperture for so-called flushing purpose (a squirting-ability restoration operation), and reference numeral 6 designates an indentation.

In the present embodiment, of the plurality of protuberances 14, protuberances 14*a* formed in the vicinity of either side of the platen in the primary scanning direction are characterized in that, as shown in FIG. 24, the tops 10, whose ends oppose the top end of the recording medium 50, are set back in the secondary scanning direction from the ends of the tops 10 of the other protuberances 14. The protuberances 14 are formed so as to cope with sizes of recording medium most popularly used by the recording apparatus. When a recording medium of any of the sizes is released from a paper feed roller (not shown), to thereby render the bottom end of the recording medium free, the set-back tops 10 prevent deformation of the corner of the free bottom end. A paper output roller 15 comprises a drive roller 16 which is rotatably driven by an unillustrated drive source, and two types of driven rollers 17*a* and 17*b* paired up with each other. The paper output roller 15 outputs the recording medium 50 having an image recorded thereon while nipping it.

Figure 11:
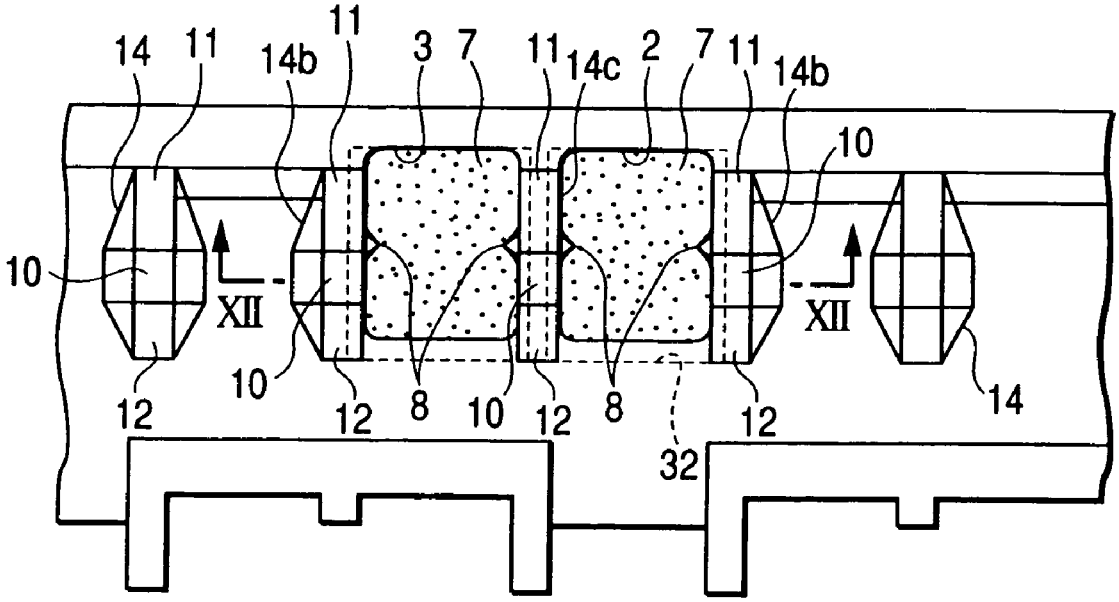
FIG. 11 is a plan view showing the principal section of the platen of an ink-jet recording apparatus according to one embodiment of the present invention.
Figure 12:
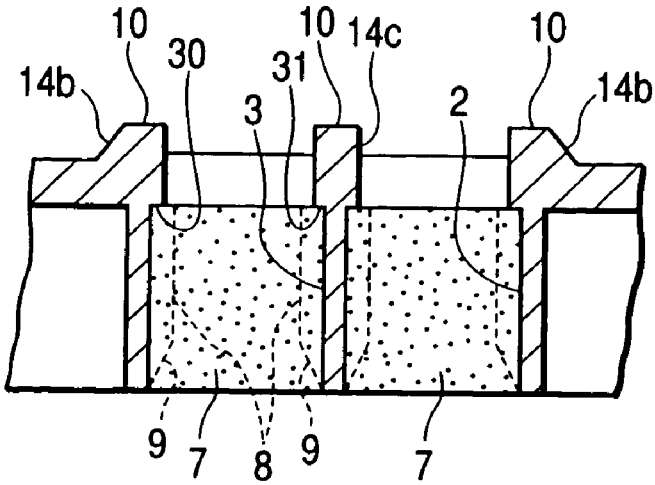
FIG. 12 is a cross-sectional view taken along line II—II shown in FIG. 11.
Figure 13:
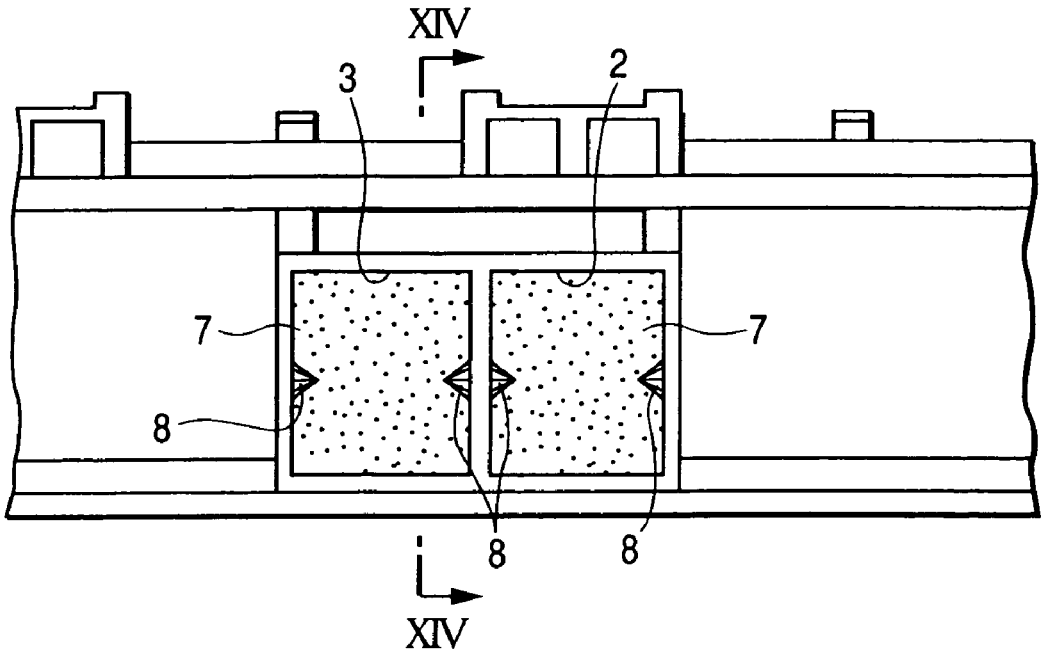
FIG. 13 is a back view showing the principal section of the platen.
Figure 14:
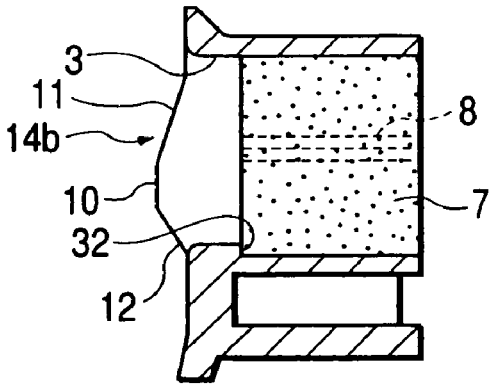
FIG. 14 is a cross-sectional view taken along line IV—IV shown in FIG. 13.
Figure 15:
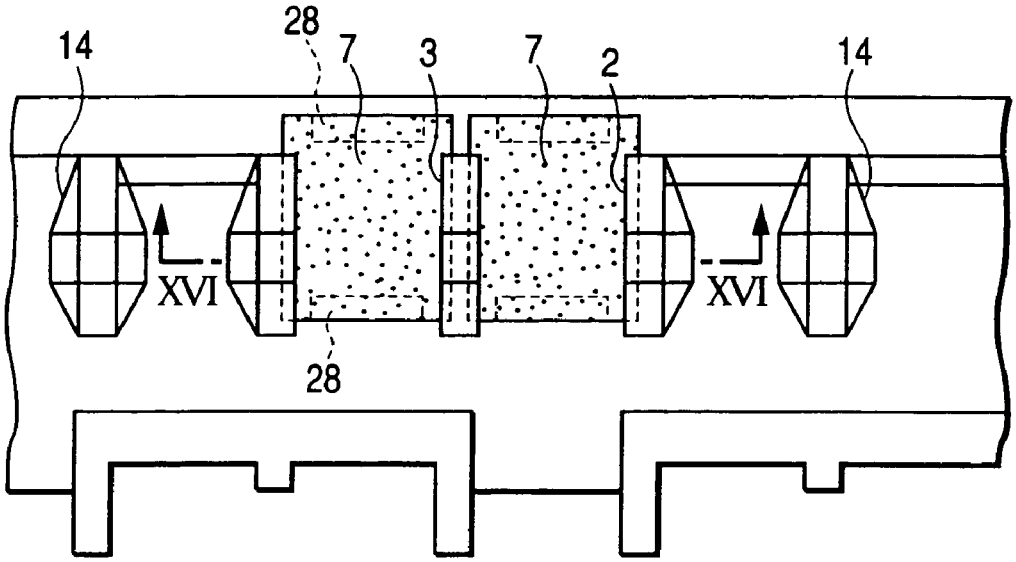
FIG. 15 is a plan view showing the principal section of the platen of an ink-jet recording apparatus according to another embodiment of the present invention.
Figure 16:
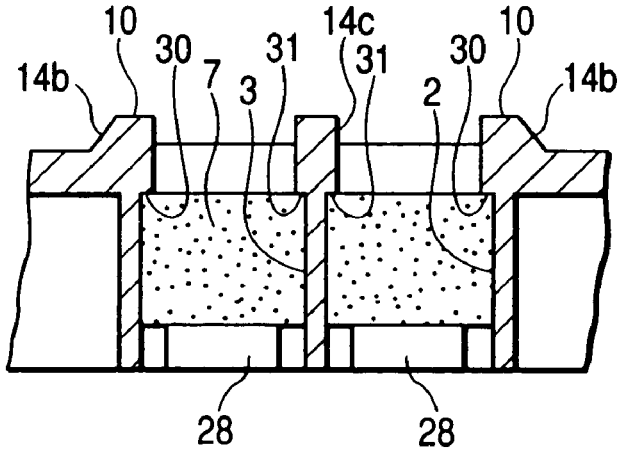
FIG. 16 is a cross-sectional view taken along line VI—VI shown in FIG. 15.
Figure 17:
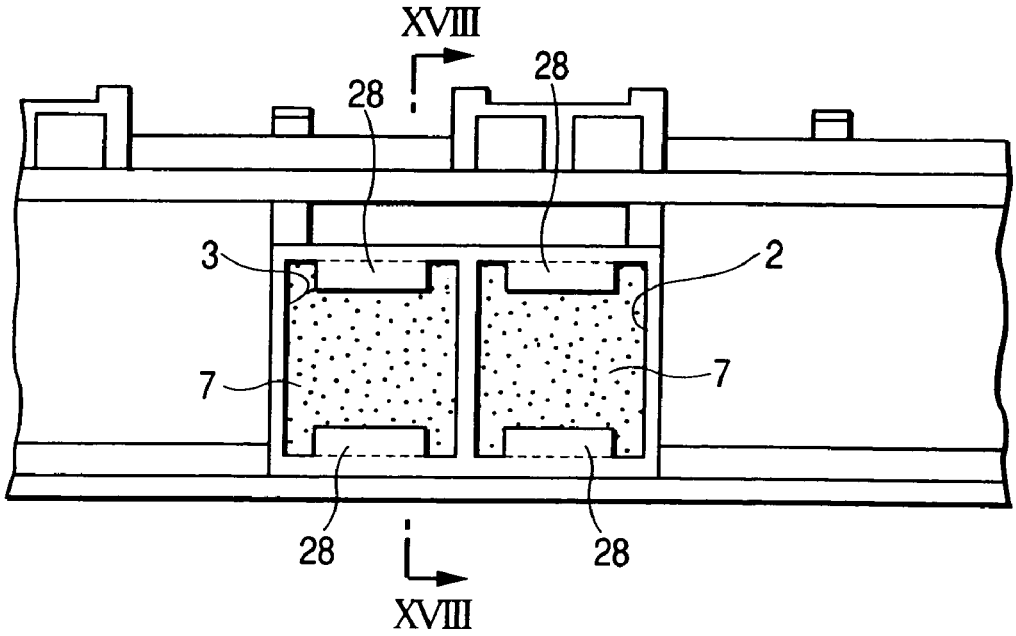
FIG. 17 is a back view showing the principal section of the platen.
Figure 18:
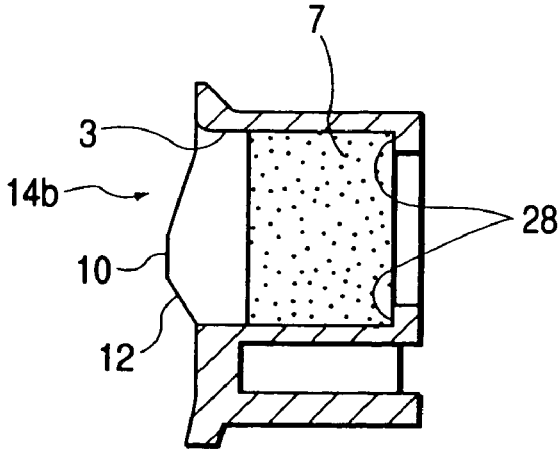
FIG. 18 is a cross-sectional view taken along line VIII—VIII shown in FIG. 17.

The through holes 1, 2, 3, and 4 and the way in which the ink-absorbing material 7 is fitted into the through holes 1 through 4 will now be described by reference to FIGS. 11 through 14. FIG. 11 is a plan view showing the principal section of the platen of the ink-jet recording apparatus according to one embodiment of the present invention; FIG. 12 is a cross-sectional view taken along line II—II shown in FIG. 11; FIG. 13 is a back view showing the principal section of the platen; and FIG. 14 is a cross-sectional view taken along line IV—IV shown in FIG. 13.

As mentioned above, the platen supports a recording medium from below and holds the recording medium in position relative to an ink-jet recording head (not shown), when an image is recorded on the recording medium disposed opposite the recording head while the ink-jet recording head—on which nozzles are arranged in the secondary scanning direction of the recording medium—is being moved so as to scan in the primary scanning direction. The through holes 1, 2, 3, and 4 are located at positions on the platen corresponding to the sides (the reference side and the other side) of recording media of various sizes to be moved in the secondary scanning direction. The through holes 1 through 4 are formed so as to extend beyond either side of the recording medium. Further, the through holes 1 through 4 are formed as ink receiver holes whose openings are formed to be longer than the nozzle array in the secondary scanning direction. As shown in FIG. 11, the through holes 1 through 4 are provided between adjacent protuberances 14*b* and 14*c*.

The ink-absorbing material 7 is provided in the respective through holes 1 through 4. In the through holes 1 through 4, the ink-absorbing material 7 is disposed in the vicinity of the opening opposite the recording head such that the top surface of the ink-absorbing material 7 is situated below the opening. In the present embodiment, first removal stoppers 30, 31, and 32 are provided along the interior edge of the recording-head-opposing opening of each of the through holes 1 through 4 and function to prevent removal of the ink-absorbing material 7 toward the recording head. As shown in FIGS. 11, 12, and 14, the first removal stoppers 30, 31, and 32 are formed into steps, which are provided along the interior edge of the opening, and integrally with the platen. The through holes 1 through 4 literally signify that the holes penetrate through the platen from the side opposing the recording head to the other side.

In the present embodiment, a pair of second removal stoppers 8 is provided in each of the through holes 1 through 4 for preventing removal of the ink-absorbing material 7 toward the recording head. The second removal stoppers 8 correspond to a pair of angularly-raised lines which are formed opposite each other on interior walls of the through hole in the longitudinal direction thereof. The end of the raised line 8 opposing the reverse side of the platen is tapered into a taper 9, to thereby facilitate insertion of the ink-absorbing material 7.

Based on the foregoing description, the configuration of the ink-jet recording apparatus for recording data on a recording medium without leaving margin on either side will now be described, by reference to FIG. 24. In an ink-jet-type recording head 51 (designated by a dotted line) which travels back and forth in the primary scanning direction, nozzles are arranged in the secondary scanning direction. A platen 53 is disposed opposite the recording head 51. When the recording head 51 records image data on the recording medium 50 (designated by a dotted line) while the recording medium 50 is intermittently transported in the secondary scanning direction, the platen 53 supports the recording medium 50 from below, to thereby hold the recording medium 50 in position relative to the recording head 51. On the basis of recorded data, a control section 52 controls the intermittent transportation of the recording medium 50 in the secondary scanning direction, the reciprocating movement of the recording head 51 in the primary scanning direction, and the squirting of ink from the recording head 51. The through holes 1, 2, 3, and 4 are formed in the respective areas of the platen 53 corresponding to either side of recording medium of predetermined sizes to be transported over the platen 53 in the secondary scanning direction. The through holes 1, 2, 3, and 4 are formed so as to extend beyond either side of the recording medium and to be longer, in the secondary scanning direction, than the area of the recording head where the nozzles are provided.

The control section 52 has two operation modes; i.e., a first operation mode and a second operation mode. In the first operation mode, the control section 52 expands recorded data and records the data in a recording region set inside either side of the recording medium of any of predetermined sizes (a postcard size, an A4-size, or a like size). In a second operation mode, the control section 52 expands the same recorded data and records the data within a record region which extends beyond either side of the recording medium 50 of the same size and is positioned inside a non-reference-side edge 54 of the recording medium 50 within the corresponding one of the through holes 1, 2, 3, and 4. In a case where data are recorded on the recording medium 50, the control section 52 operates according to the second operation mode.

In the present embodiment, in the first operation mode, a certain photographic image data set can be normally recorded on the recording medium 50 of a single size while a margin is left on either side thereof. In the second operation mode, the image data set can be recorded on the recording medium 50 without a margin being left on either side thereof. In other words, since the control section 52 is provided with the first and second operation modes, a certain photographic image data set can be readily and unfailingly recorded on the recording medium 50 of a single size with or without a margin being left on either side thereof.

Since the control section 52 operates according to either the first or second operation mode for the recording medium 50 of a predetermined size, the second mode can be readily set such that the amount of image data to be produced and wasted outside either side of the recording medium 50 is sufficiently reduced. Accordingly, image data can be effectively recorded without a margin being left, by means of minimizing wastage of image data.

Here, the expression "image data" may signify either text or an image.

Further, in the ink-jet recording apparatus of the present embodiment, protuberances 14 protruding by the same distance are formed at predetermined intervals in the primary scanning direction and in an upper surface of the platen 53. When the recording head 51 records image data on the recording medium 50 while the recording medium 50 is intermittently transported in the secondary scanning direction, the platen 53 supports the recording medium 50 from below, to thereby hold the recording medium 50 in position relative to the recording head 51. The protuberances 14 enable regular generation of paper cockle, which is usually caused when the recording medium is soaked with ink, thereby rendering stable the position of the recording medium 50 in its widthwise direction. Therefore, setting of the record region for the second operation mode does not involve a necessity for taking into consideration a large positional offset of the recording paper 50 attributable to paper cockle. Accordingly, the recording region for the second operation mode can be made small, thus enabling a further reduction in the amount of image data to be wasted during a margin-free recording operation.

More specifically, in the ink-jet recording apparatus programmed with the first and second operation modes, the recording region for the second operation mode is set to be wider than the width of the recording medium by 4.5 to 5.5 mm. By virtue of such an allowance, image data can be recorded on the recording medium 50 without a margin being left on either side thereof and without being substantially influenced by a tolerance stemming from the design or manufacture of a path for transporting the recording medium 50.

Figure 44:
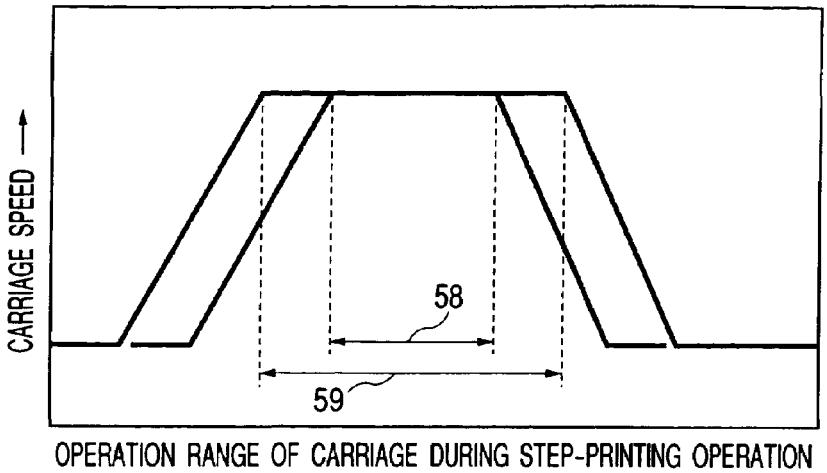
FIG. 44 is a plot showing the relationship between the range of operation a carriage having a recording carriage mounted thereon and a carriage speed, when data are recorded on a recording medium without leaving no margin on either side of the recording medium and when data are recorded on a recording medium while leaving a margin on either side thereof.

In the ink-jet recording apparatus programmed with the first and second operation modes, the control section 52 reciprocally actuates the recording head 51 in the primary scanning direction. As shown in FIG. 44, in both the first and second operation modes, the control section 52 assumes a single acceleration gradient at which the recording head 51 is to shift from a stationary state to a constant-speed state and a single deceleration gradient at which the recording head 51 is to shift from the constant-speed state to the stationary state. A travel distance 59 attained by the recording head 51 of the second operation mode in the constant-speed state is longer than a travel distance 58 attained by the recording head 51 of the first operation mode in the constant-speed state, and travel distance is substantially the same length on both an acceleration side and a deceleration side. In FIG. 44, the vertical axis represents the traveling speed of a carriage mounted on the recording head 50, and the horizontal axis represents an operation region in the primary scanning direction.

Figure 45:
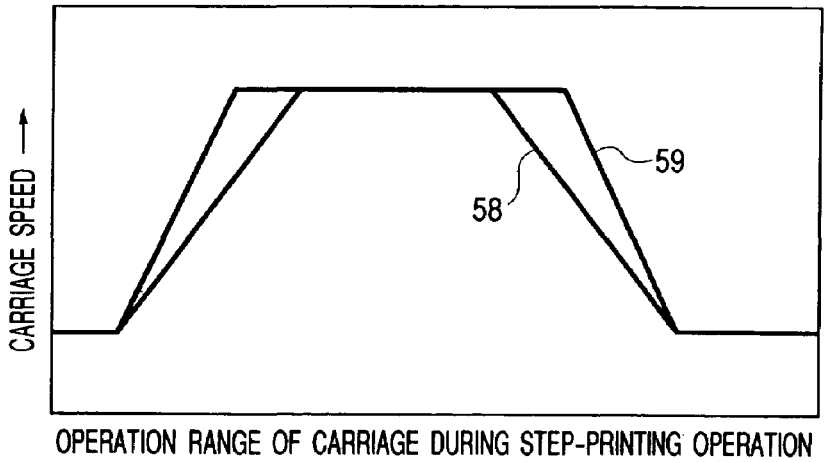
FIG. 45 is a plot showing the relationship between the range of operation a carriage having a recording carriage mounted thereon and a carriage speed, when data are recorded on a recording medium without leaving no margin on either side of the recording medium and when data are recorded on a recording medium while leaving a margin on either side thereof.
Figure 46:
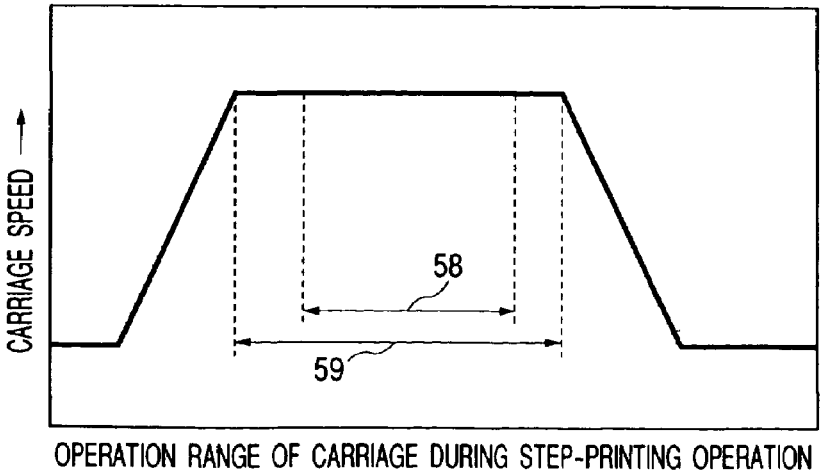
FIG. 46 is a plot showing the relationship between the range of operation a carriage having a recording carriage mounted thereon and a carriage speed, when data are recorded on a recording medium without leaving no margin on either side of the recording medium and when data are recorded on a recording medium while leaving a margin on either side thereof.

At the time of implementation of the first and second operation modes, the control required for reciprocally moving the recording head 51 in the primary scanning direction can be facilitated. Recording throughput can be optimized in both the first and second operation modes. The control section 52 may assume a speed pattern such as that shown in FIG. 45 or 46.

In the ink-jet recording apparatus programmed with the first and second operation modes, the ink-absorbing material 7 is provided in each of the through holes 1, 2, 3, and 4. The ink-absorbing material 7 is provided in the holes 1 through 4 such that the upper surface of the ink-absorbing material 7 is situated in the vicinity of the opening of the hole opposite the recording head.

Accordingly, the distance over which the ink droplets are squirted and wasted outside either side of the recording medium 50 can be shortened. Further, the ink-absorbing material 7, which is disposed in each of the through holes 1 through 4 such that the upper surface of the ink-absorbing material 7 is situated in the vicinity of the opening opposite the recording head, immediately captures the ink droplets, thus significantly reducing the chance of occurrence of airborne ink mist.

FIGS. 15 through 18 show another embodiment of the present invention and correspond to FIGS. 11 through 14. In the present embodiment, the second removal stops are embodied by a pair of steps 28 formed along the bottom edge of each of the through holes 1 through 4 opposite the upper edge facing the recording head. In other respects, the recording apparatus of the present embodiment is identical in structure with that shown in FIGS. 11 through 14, and hence like reference numerals designate like elements. Repeated description of these reference numerals is omitted.

The operation of the recording apparatus of the present embodiment will now be described. When image data are recorded on a recording medium without a margin being left on either side thereof, by setting the range of primary scanning of the ink-jet recording head so as to extend beyond either side of the recording medium, the ink—which has been squirted from the recording head outside either side of the recording medium—is directly received by any of the through holes 1 through 4 formed in the platen, each through hole having an opening larger than the nozzle range of the recording head. Further, the ink immediately adheres to the ink-absorbing material 7 which is provided in the through holes 1 through 4 such that the upper surface of the ink-absorbing material 7 is situated in the vicinity of the entrance of the through hole. Accordingly, substantially no airborne ink mist arises. As mentioned above, even the platen of the present embodiment enables a reduction in the chance of generation of airborne ink mist, thereby diminishing the chance of both sides of a recording medium being stained with airborne ink mist.

So long as the upper surface of the ink-absorbing material 7 is situated in a position below the open entrance of each of the through holes 1 through 4, a recording medium is prevented from rubbing against the ink-absorbing material 7, which would otherwise be caused during transportation of the recording medium. Further, even if the recording medium becomes wavy and deformed for reasons of paper cockle, the recording medium can be prevented from rubbing against the upper surface of the ink-absorbing material 7.

Further, the first removal stops 30, 31, and 32 are provided along the open edge of each of the through holes 1 through 4 opposite the recording head, in order to prevent removal of the ink-absorbing material 7 toward the recording head. Since the first removal stops 30, 31, and 32 securely hold the upper surface of the ink-absorbing material 7, generation of airborne ink mist can be stably prevented. Further, rubbing between the upper surface of the ink-absorbing material 7 and a recording medium to be transported and rubbing between the recording medium and the ink-absorbing material 7 stemming from paper cockle can be diminished thoroughly.

Since the first removal stops 30, 31, and 32 are formed along the open edge of each of the through holes 1 through 4 opposite the recording head, the first removal stops 30, 31, and 32 can be readily formed integrally with the platen. The thus-formed removal stops-can exert a removal effect by means of a simple structure.

The second removal stoppers 8 or 28 provided in each of the through holes 1, 2, 3, and 4 limit removal of the ink-absorbing material 7 in the direction opposite the recording head. The second removal stoppers 8 or 28 unfailingly prevent removal of the ink-absorbing material 7 in the direction opposite the recording head. In cooperation with the first removal stoppers 30, 31, and 32, the second removal stoppers 8 or 28 can securely hold the ink-absorbing material 7 within the through holes 1, 2, 3, and 4.

In one embodiment, the second removal stoppers 8 are formed in raised lines on the interior surface of each of the through holes 1, 2, 3, and 4, the lines aligned in the longitudinal direction thereof. Such a structure of the second removal stopper 8 enables insertion of the ink-absorbing material 7 into each of the through holes 1, 2, 3, and 4 by means of pushing only the ink-absorbing material 7. Further, the second removal stoppers 8 can be readily formed integrally with the through holes.

In another embodiment, the second removal stoppers 28 are formed in the shape of the steps 28 along the bottom edge of each of the through holes opposite the recording head. The step-shaped removal stoppers 28 unfailingly prevent removal of the ink-absorbing material 7 through employment of a simple structure and can be readily formed integrally with the through holes.

Figure 19:
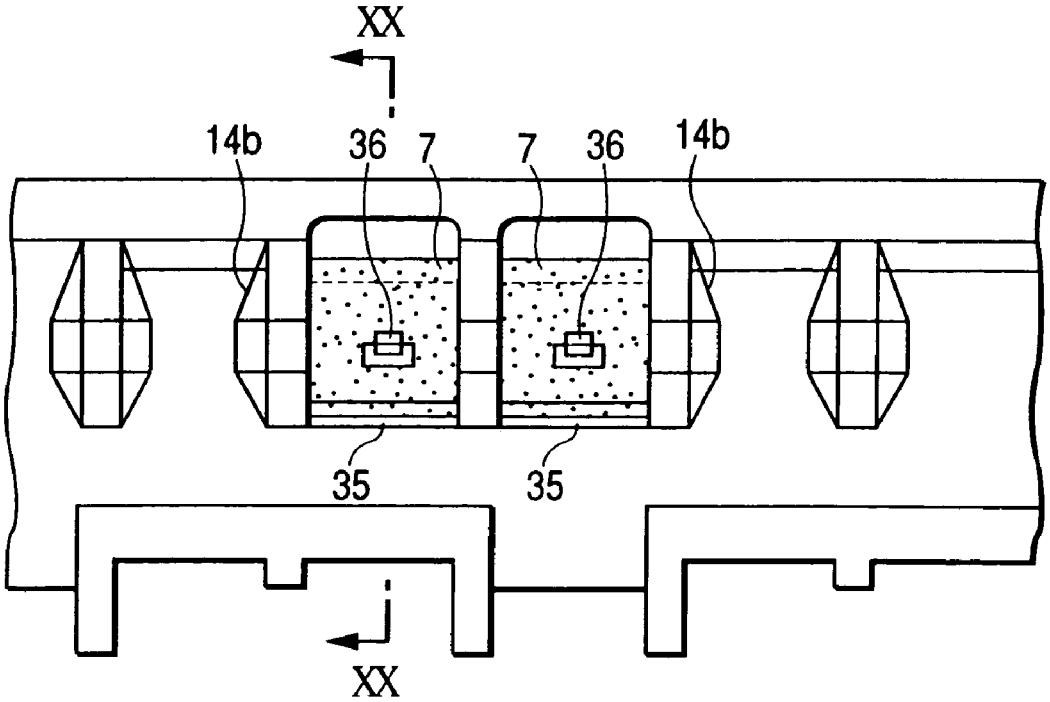
FIG. 19 is a plan view showing the principal section of the platen of an ink-jet recording apparatus according to another embodiment of the present invention.
Figure 20:
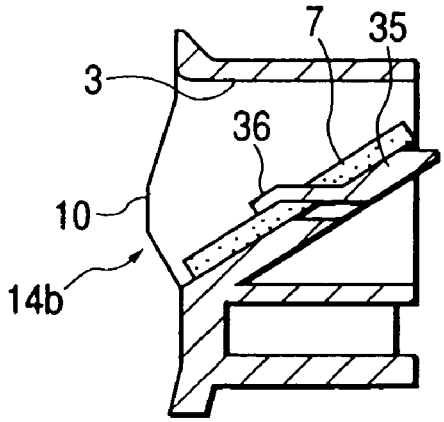
FIG. 20 is a cross-sectional view taken along line X—X shown in FIG. 19.

FIGS. 19 and 20 show a platen according to another embodiment of the present invention. FIG. 19 is a plan view showing the principal section of a recording apparatus according to the present embodiment, and FIG. 20 is a cross-sectional view taken along line X—X shown in FIG. 19. In each of the through holes 1, 2, 3, and 4 formed in a platen of the recording apparatus of the present embodiment, a tilt section 35 is provided at an angle from the upper opening opposite the recording head to the bottom so as to ensure a through space of the through hole. A plate-like ink absorbing-member 7 is laid on the tilt section 35. A claw 36 is integrally formed in the tilt section 35 so as to protrude and locks the ink-absorbing material 7 in place, as shown in FIG. 20. In other respects, the platen of the present embodiment is identical in structure with that of the previously-described embodiments, and hence like reference numerals designate like elements. Repetition of their explanations is omitted.

In the present embodiment, when image data are recorded on a recording medium without leaving a margin on either side of the recording medium, the ink which has been squirted from the recording head outside either side of the recording medium directly enters any of the through holes 1, 2, 3, and 4 having openings, each opening longitudinally extending beyond the range of the recording head within which range nozzles are arranged (hereinafter referred to as a "nozzle range"). The ink then immediately adheres to the ink-absorbing material 7 laid on the tilt section 35 provided in any of the through holes 1, 2, 3, and 4. Accordingly, the chance of occurrence of airborne ink mist can be substantially obviated. Even when an ink-jet recording apparatus performs photographic-quality printing which does not involve leaving a margin on either side of the recording medium, there arises substantially no decrease in print quality of the lateral side areas of the recording medium. When the ink which has adhered to the ink-absorbing material 7 accumulates to a certain level, the ink flows over the surface of the tilt section 35 and is drained from the through holes 1, 2, 3, and 4.

Figure 21:
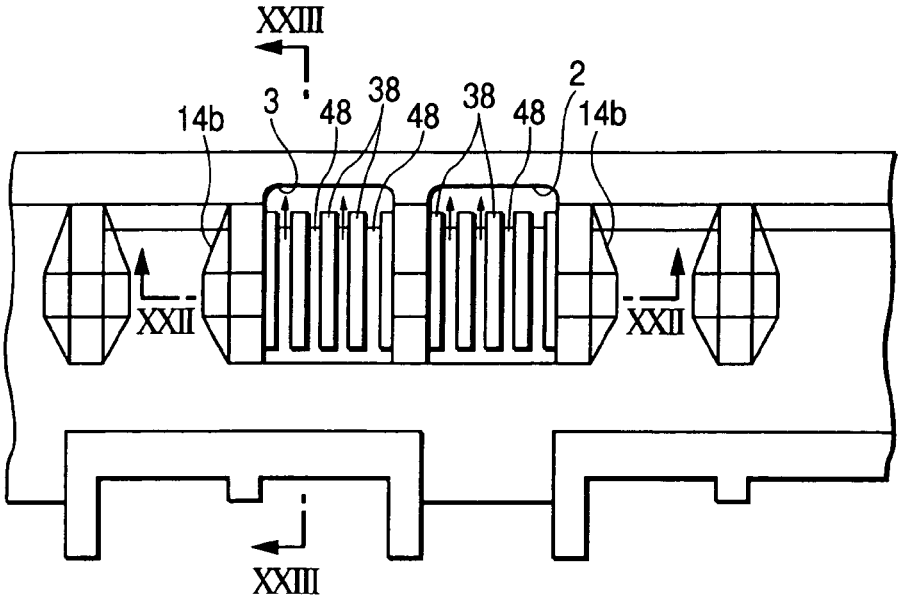
FIG. 21 is a plan view showing the principal section of the platen of an ink-jet recording apparatus according to another embodiment of the present invention.
Figure 22:
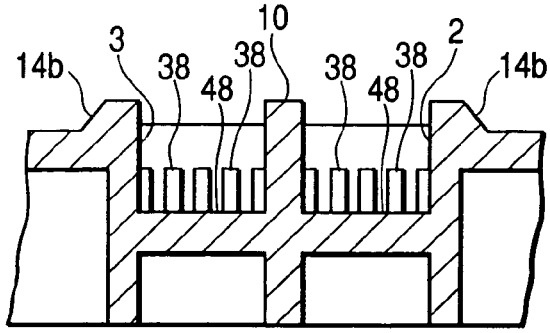
FIG. 22 is a cross-sectional view taken along line XII—XII shown in FIG. 21.
Figure 23:
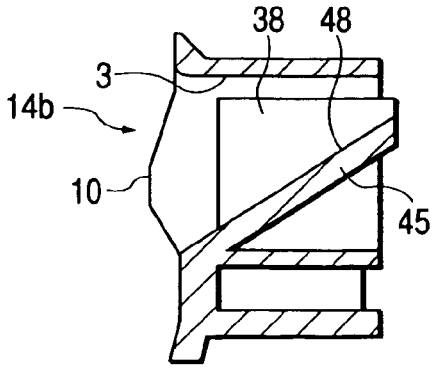
FIG. 23 is a cross-sectional view taken along line XIII—XIII shown in FIG. 21.

FIGS. 21 through 23 show a platen according to another embodiment of the present invention. FIG. 21 is a plan view showing the principal section of the platen according to the present embodiment; FIG. 22 is a cross-sectional view taken along line XII—XII shown in FIG. 21; and FIG. 23 is a cross-sectional view taken along line XIII—XIII shown in FIG. 21. In each of the through holes 1, 2, 3, and 4 formed in a platen of the recording apparatus of the present embodiment, a tilt section 45 is provided at an angle from the upper opening opposite the recording head to the bottom so as to ensure a through space of the through hole. A plurality of ribs 38 are formed at intervals along the tilt section 45, to thereby define holes 48 oriented in the tilt direction of the tilt section 45. The top surfaces of the ribs 38 are situated below the opening of each of the through holes 1, 2, 3, and 4. In other respects, the platen of the present embodiment is identical in structure with that of the previously-described embodiments, and hence like reference numerals designate like elements. Repetition of their explanations is omitted.

In the present embodiment, as in the case of the platen shown in FIG. 19, when image data are recorded on a recording medium without leaving a margin on either side of the recording medium, the ink which has been squirted from the recording head outside either side of the recording medium directly enters any of the through holes 1, 2, 3, and 4 having openings, each opening longitudinally extending beyond the nozzle range of the recording head. The ink is then guided to the bottom of the holes 48 by the plurality of ribs 38 located below the opening of each of the through holes 1, 2, 3, and 4. The ribs 38 exhibit an ink-capturing function, as does the ink-absorbing material 7, thereby substantially obviating the chance of occurrence of airborne ink mist. Even when an ink-jet recording apparatus performs photographic-quality printing which does not involve leaving a margin on either side of the recording medium, there arises substantially no decrease in print quality of the lateral side areas of the recording medium. When the ink which has adhered to the bottom of the holes 48 accumulates to a certain level, the ink flows over the surface of the tilt section 35 and is drained from the through holes 1, 2, 3, and 4.

Recording of image data on a recording medium without leaving a margin on the top, bottom, or either side of the recording medium can be achieved by combination of the ink-jet recording apparatus which has been described at the beginning of the specification and prints image data without leaving a margin on either the top or bottom side of recording medium, and the subsequent ink-jet recording apparatus which records image data without leaving a margin on either side of a recording medium.

Paper Feeder

The structure of a paper feeder provided in the ink-jet recording apparatus according to the present invention will now be described by reference to FIGS. 47 through 52. Throughout these drawings, like reference numerals designate like elements. However, the reference numerals are irrelevant to those employed in other drawings. Hence, the reference numerals may designate different elements than those designated in other drawings.

Figure 47:
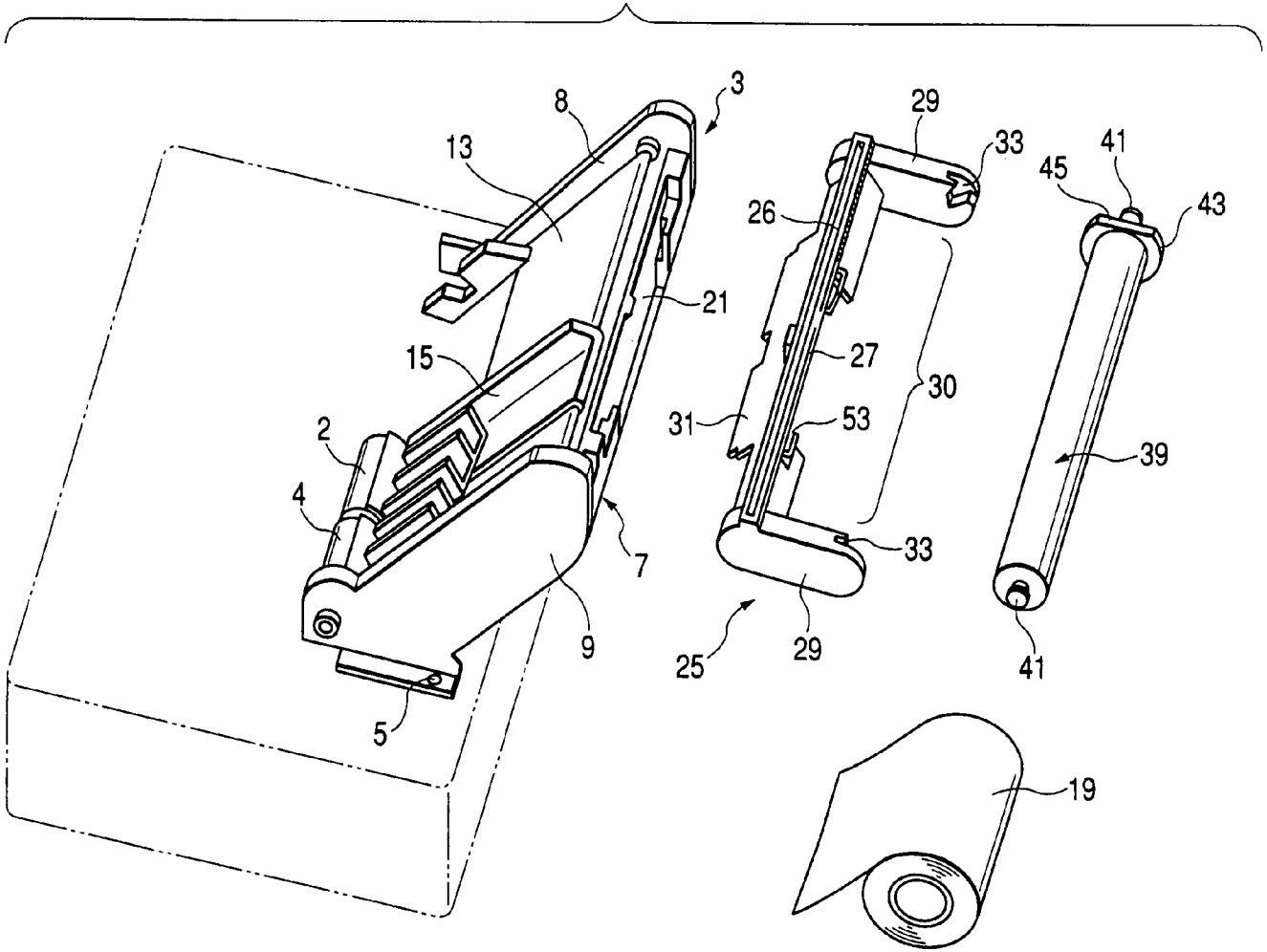
FIG. 47 is a exploded perspective view showing a paper feeder provided in an ink-jet recording apparatus according to a first embodiment of the present invention.
Figure 48:
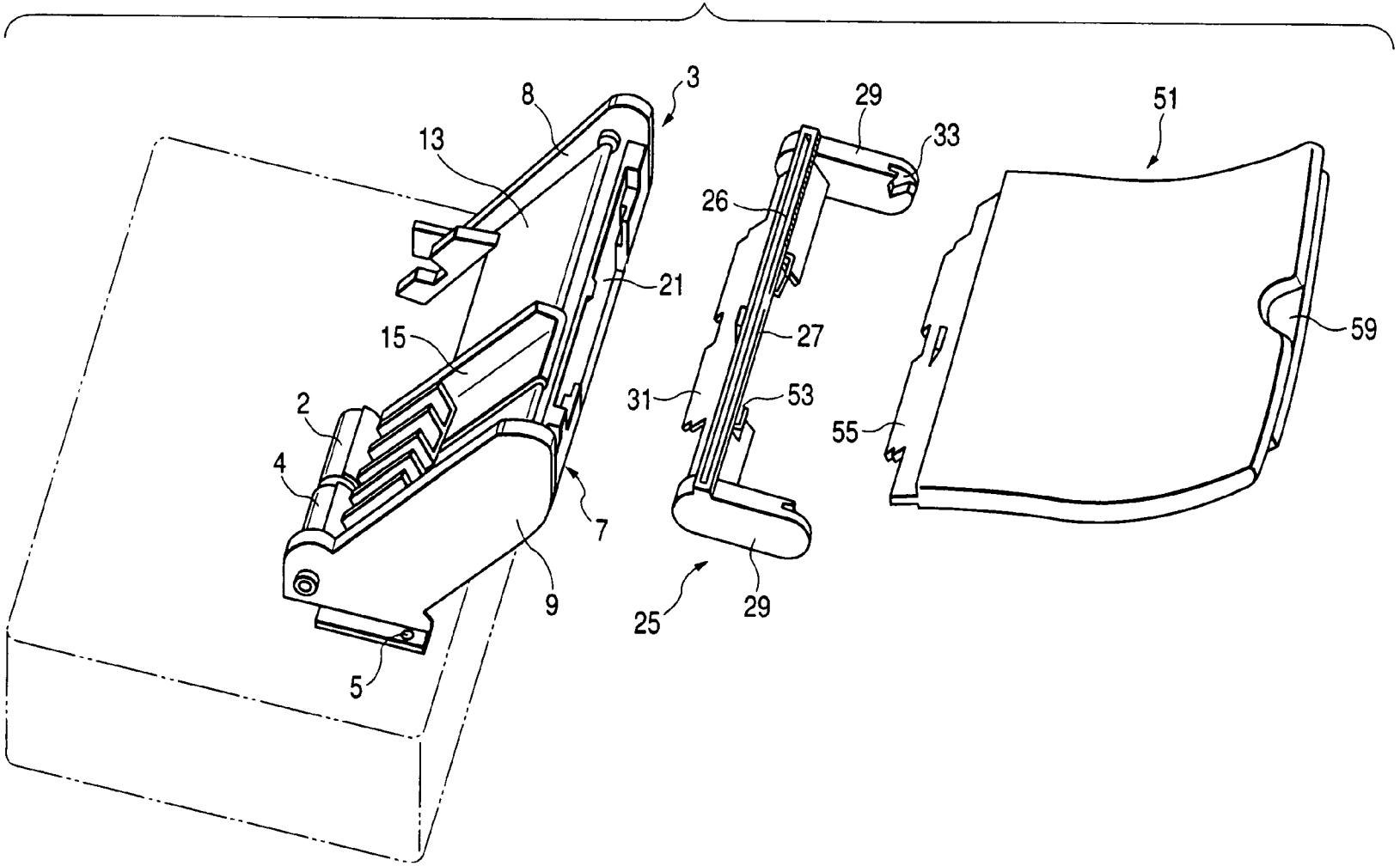
FIG. 48 is an exploded perspective view showing a paper feeder provided in an ink-jet recording apparatus according to a second embodiment of the present invention.
Figure 49:
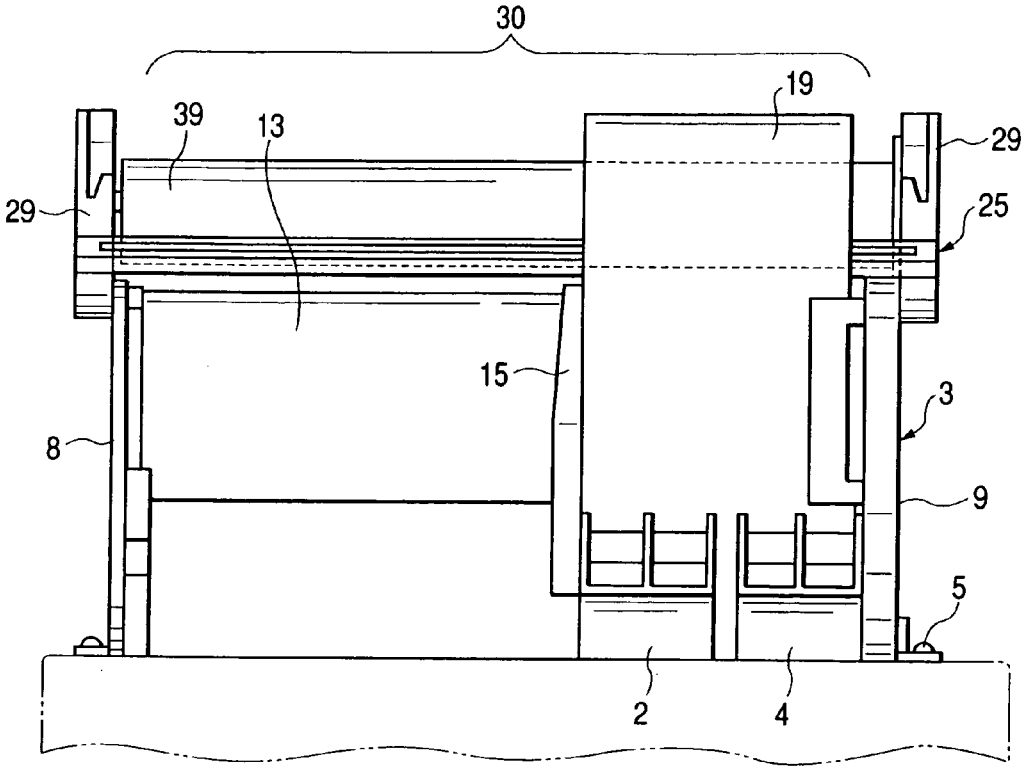
FIG. 49 is a front view showing the paper feeder according to the first embodiment.
Figure 50:
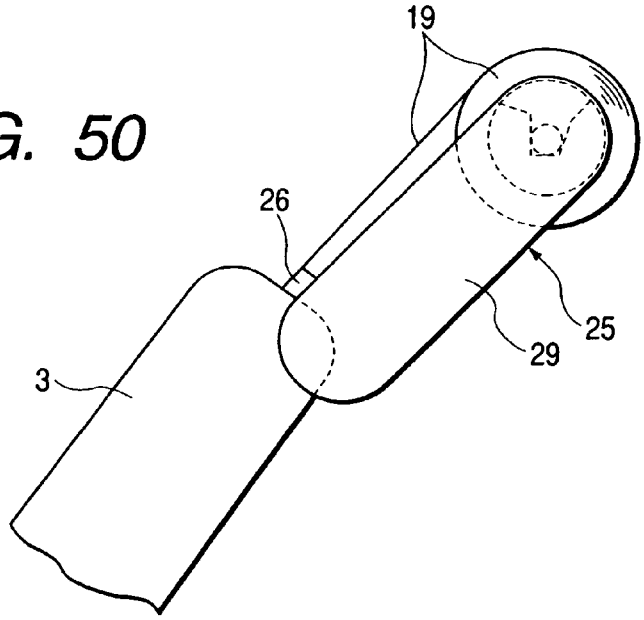
FIG. 50 is an enlarged side view showing a sheet feeder and a roll-of-paper holder when connected together.
Figure 51:
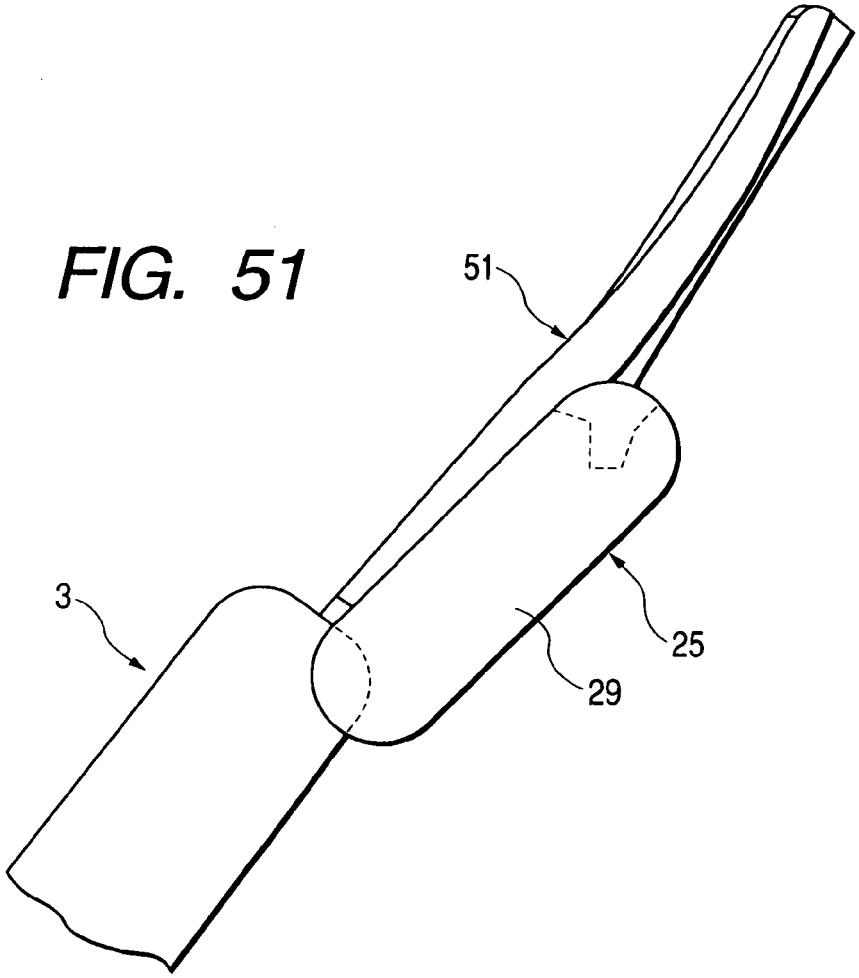
FIG. 51 is an enlarged side view showing the sheet feeder, the roll-of-paper holder, and a paper support when connected together.
Figure 52:
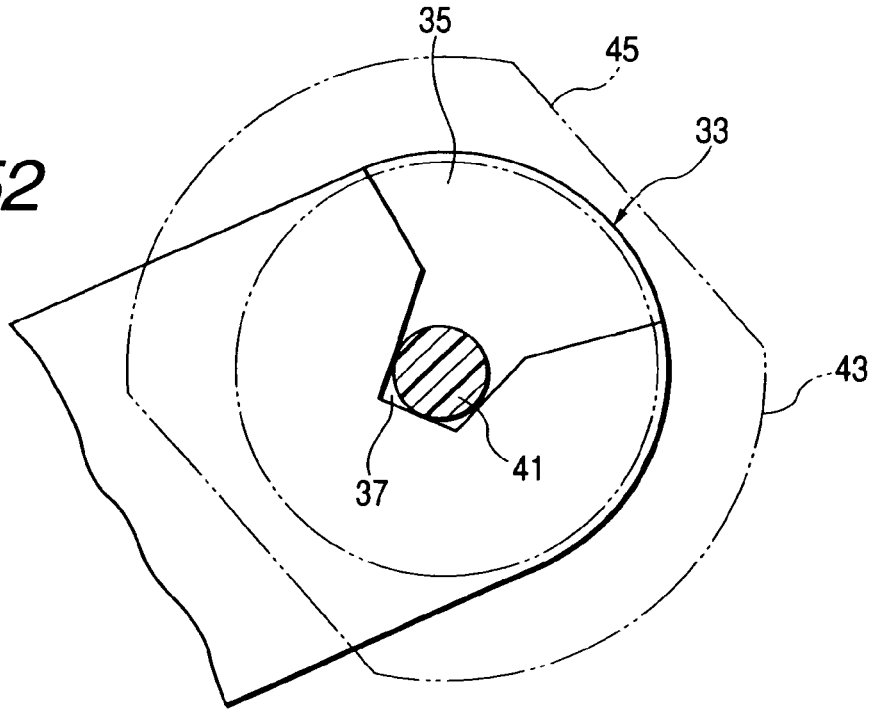
FIG. 52 is an enlarged side view showing a roll support shaft when the roll support shaft is supported by the roll-of-paper holder.

FIG. 47 is a exploded perspective view showing a paper feeder provided in an ink-jet recording apparatus according to a first embodiment of the present invention; FIG. 48 is an exploded perspective view showing a paper feeder provided in an ink-jet recording apparatus according to a second embodiment of the present invention; FIG. 49 is a front view showing the paper feeder according to the first embodiment; FIG. 50 is an enlarged side view showing a sheet feeder and a roll-of-paper holder when connected together; FIG. 51 is an enlarged side view showing the sheet feeder, the roll-of-paper holder, and a paper support when connected together; and FIG. 52 is an enlarged side view showing a roll support shaft when the roll support shaft is supported by the roll-of-paper holder.

As shown in FIG. 47, a cut sheet feeder 3, which is one of the principal constituent elements of the paper feeder 1, is attached to an upper rear portion of a printer main unit (designated by two-dot chain lines) with an upward gradient. The sheet feeder 3 has a known structure, and the structure of the sheet feeder 3 is schematically described hereinbelow. The lower base end of the sheet feeder 3 is secured to the printer main unit by means of screws 5. The sheet feeder 3 comprises a frame 7, side walls 8 and 9 attached to respective sides of the frame 7, and a hopper 13 interposed between the side walls 8 and 9. A plurality of single sheets of cut paper are loaded in the hopper 13. The lower end of the hopper 13 is pivotally moved via an unillustrated hopper spring and a cam mechanism, to thereby come into contact with or depart from a paper feed roller to be described later.

The hopper 13 is provided with an edge guide 15 for limiting the position of one widthwise end of a single sheet of cut paper, such that the edge guide 15 can move across the surface of the hopper 13 in its transverse direction. The side wall 9 of the two side walls 8 and 9 (i.e., the side wall situated near the viewer in FIG. 47) pairs up with the edge guide 15 and functions as an edge guide for limiting the position of the other widthwise side of the single sheet of cut paper. More specifically, the interior surface of the stationary side wall 9 (i.e., the surface of the side wall 9 opposing the edge guide 15) pairs up with the edge guide 15, thus limiting either side of the single sheet of cut paper in its widthwise direction, thereby assisting straightforward transportation of a single sheet of cut paper into a print section (not shown) of the printer.

In FIGS. 47 through 49, reference numerals 2 and 4 designate paper feed rollers (a paper feed roller shaft is omitted from the drawings). The single sheets of cut paper loaded on the hopper 13 are delivered to the print section one by one by means of the paper feed rollers 2 and 4 and an unillustrated separation pad. A removable receiving section 21 for enabling removable attachment of a paper support 51 (see FIG. 48) is provided on the upper end of the sheet feeder 3. In a case where a single sheet of cut paper whose lengthwise edge is aligned in the feeding direction is subjected to printing, the paper support 51 is additionally attached to the removable receiving section 21, to thereby support the portion of the sheet hanging out of the sheet feeder 3. In a case where a singe sheet of cut paper of normal size is subjected to printing, the paper support 51 is detached from the removable receiving section 21.

The roll-of-paper holder 25 which can be removably attached to the sheet feeder 3 will next be described. As shown in FIG. 47, the roll-of-paper holder 25 comprises a holder body 27 located at the center of the roll-of-paper holder 25, and a pair of arms 29, 29 provided on respective sides of the holder body 27. A removable lock section 31 which can be removably attached to the removable receiving section 21 of the sheet feeder 3 is formed in the center of the holder body 27 so as to protrude. In the present embodiment, the removable receiving section 21, which is of female type, is formed in the sheet feeder 3, and the removable lock section 31, which is of male type, is formed in the roll-of-paper holder 25. The positional relationship between the removable receiving section 21 and the removable lock section 31 may be reversed. Any type of publicly-known removable structures can be employed for removably interconnecting these two sections 21 and 31, so long as the two sections can be removably attached.

A roll-of-paper loading region 30 is formed between the two arms 29, and a receiving section 33 is formed in the interior surface of the free-end portion of each arm 29. As shown in an enlarged view of FIG. 52, the receiving section 33 has an widely-open receiving portion 35, and a small-pin-receiving section 37 oriented substantially upward.

A rotary pin 41 formed on either side of a roll support shaft 39 is finally fitted into the small-pin-receiving section 37 by way of the receiving portion 35. The roll support shaft 39 is retained by the receiving sections 33 so as to be rotatable about its axis and stationary with respect to the horizontal direction.

As shown in FIG. 47, a flange 43 is formed on one side of the roll support shaft 39. The flange 43 assumes a shape similar to a running track formed by separating, by means of two line segments, two semicircular chords located symmetrically with respect to the center of a circle. A linear section of the flange 43 acts as a rotation limitation section 45. When the roll support shaft 39 is detached from the roll-of-paper holder 25 and placed on top of a flat table, the rotation limitation sections 45 prevent inadvertent rotation of the roll support shaft 39. However, these flanges 43 are not inevitably included as elements of the roll support shaft 39.

A cutter travel channel 26 for receiving a cutter for separating the roll of paper 19 is formed in the roll-of-paper holder 25. The cutter travel channel 26 acts as a guide channel when the roll of paper 19 is cut through use of a cutter (not shown). So long as the user causes the cutter to scan along the cutter travel channel 26, the roller 19 is smoothly cut along that guide channel.

The operation of the paper feeder of the first embodiment will now be described by reference to FIG. 47. As shown in FIG. 47, in a case where a single sheet of cut paper is used, it is not necessary to attach the roll-of-paper holder 25 to the sheet feeder 3, and a plurality of single sheets of cut paper are loaded on the hopper 13 of the sheet feeder 3 such that the sheets of cut paper are delivered one by one to the print section of the printer.

In a case where the roll of paper 19 is used, the roll support shaft 39 is inserted into the roll of paper 19 in an unrestricted manner (i.e., in a state in which the roll of paper 19 is freely rotatable relative to the roll support shaft 39). The rotary pin 41 provided on either side of the roll support shaft 39 is fitted into the corresponding shaft bearing 37 of the roll-of-paper holder 25, thus setting the roll of paper 9 into the roll-of-paper holder 25. The removable engagement section 31 of the roll-of-paper holder 25 is then fitted into the removable receiving section 21 of the sheet feeder 3, thus attaching the roll-of-paper holder 25 to the sheet feeder 3. FIG. 50 is a side view showing the roll-of-paper holder 25 and the sheet feeder 3 when connected together.

The roll of paper 19 is rolled out from the roll-of-paper holder 25, and the leading edge of the roll of paper 19 is aligned with the hopper 13 of the sheet feeder 3 and set in the paper transport path of the sheet feeder 3. The edge guide 15 is moved according to the width of the roll of paper 19, to thereby prevent the roll of paper 19 from wobbling in the horizontal direction (see FIG. 49). Thus, the edge guide 15 can guide either the side edge of a single sheet of cut paper or the side edge of a roll of paper. The horizontal position of the unwound roll of paper 19 is limited, and during a printing operation the paper unwound from the roll of paper 19 is straightforwardly supplied to the print section.

Paper is unwound from the roll of paper 19 by means of the feeding force exerted by a paper feed roller (not shown). Since the roll of paper 19 is retained by the roll-of-paper holder 25 in an unrestricted manner, the roll of paper 19 stretched by the paper feed roller is excessively rotated by means of inertial force. As a result, paper is excessively unwound, whereupon slack arises in the paper. The slack absorbs back tension, which would otherwise be applied to the paper when the roll of paper 19 is delivered to the print section, thus improving the accuracy of paper feeding operation.

The paper feeder according to the second embodiment will now be described by reference to FIG. 48. In the first embodiment, in a case where a single sheet of cut paper is subjected to printing, single sheets of cut paper are loaded into the hopper 13 of the sheet feeder 3. However, large-size paper, such as A3-size paper or B4-size paper, does not completely fit into the hopper 13 of the sheet feeder 3. In such a case, the paper support 51 has conventionally been attached, as an auxiliary member, to the removable receiving section 21 of the sheet feeder 3. In the present embodiment, the paper support 51 or the roll-of-paper holder 25 can be selectively attached to the sheet feeder 3. Alternatively, both the paper support 51 and the roll-of-paper holder 25 can be attached to the sheet feeder 3 simultaneously.

As shown in FIG. 48, the sheet feeder 3 and the roll-of-paper holder 25 are identical with those shown in FIG. 47. Further, as shown in FIG. 48, a removable receiving section 53 for receiving the paper support 51 is formed in the center of the interior surface of the roll-of-sheet holder 25. A removable engagement section 55 formed at the lower end of the paper support 51 can be attached to the removable receiving section 53.

The removable engagement section 55 of the paper support 51 can also be attached to the removable receiving section 21 of the sheet feeder 3. In the second embodiment, the roll-of-paper holder 25 is formed so as to be able to connect with the sheet feeder 3, by utilization of the removable receiving section 21 of the sheet feeder 3 for removably receiving the paper support 51. In other words, the removable receiving section 21 formed in the sheet feeder 3 can serve as an attachment point for both the roll-of-paper holder 25 and the paper support 51.

A withdrawable extension support 59 is provided on the reverse side of the upper end of the paper support 51. In a case where a single sheet of cut paper extends beyond the paper support 51, the extension support 59 is withdrawn supplementally, thus supporting the entirety of the single sheet of cut paper.

Next, the operation of the paper feeder according to the second embodiment of the invention shown in FIG. 48 will now be described. As in the case of the paper feeder shown in FIG. 47, the removable engagement section 31 of the roll-of-paper holder 25 is attached to the removable receiving section 21 of the sheet feeder 3. In this state, the roll of sheet 19 is set in the roll-of-paper holder 25, whereby a roll of paper can be subjected to printing, as in the case of the paper feeder shown in FIG. 47.

In a case where a long single sheet of cut paper is used for printing, the roll of paper 19 is detached from the roll-of-paper holder 25, and the removable engagement section 55 of the paper support 51 is attached to the removable receiving section 53 of the roll-of-paper holder 25 (see FIG. 51). Single sheets of cut paper are loaded on the hopper 13 so as to extend to the paper support 51, and the edge guide 15 is moved, to thereby prevent horizontal displacement of the sheets of cut paper and enable printing. Thus, even in a case where the roll-of-sheet holder 25 is not used, the paper feeder of the present embodiment obviates a necessity for removing the roll-of-paper holder 25 from the sheet feeder 3 each time the roll-of-sheet holder 25 is not in use. A long single sheet of cut paper can be printed, so long as the paper support 51 is attached to the paper feeder.

In a case where use of a roll of paper is not expected for a while, the roll-of-sheet holder 25 is removed from the sheet feeder 3, and the removable engagement section 55 of the paper support 51 can be attached directly to the removable receiving section 21 of the sheet feeder 3.

In the paper feeder of the present embodiment, the roll-of-paper holder 25 is structured so as to be attached to the sheet feeder 3, thus rendering the roll-of-paper holder 25 compact and improving the ease of use thereof. Accordingly, the ink-jet recording apparatus can be prevented from becoming bulky.

The roll-of-sheet holder 25 is attached to the sheet feeder 3 such that a roll of sheet to be retained is situated above the upper end of the sheet feeder and in substantially an extension of a paper transport path of the sheet feeder 3. As a result, a roll of paper and a sheet of cut paper can be transported over a single common path, thus reducing variations in recording quality. Further, the entirety of the roll-of-paper holder 25 can be readily made compact.

As a result of the removable receiving section 21 of the sheet feeder 3 being arranged so as to be shared between the roll-of-paper holder 25 and the paper support 51, the structure to be used for removal attachment can be simplified. Further, so long as the paper support 51 is detached from the removable receiving section 21 of the sheet feeder 3 and the roll-of-paper holder 25 is attached to the removable receiving section 21, data can be recorded (printed) on a roll of paper. Conversely, so long as the paper support 51 is attached to the removable receiving section 21 of the sheet feeder 3, a sheet of cut paper which is long in the feeding direction can be stably transported while the end of the paper is supported by the paper support 51.

The removable receiving section 53 for receiving the paper support 51 is formed in the roll-of-paper holder 25. While the roll-of-paper holder 25 is attached to the sheet feeder 3, the paper support 51 can be attached to the roll-of-paper holder 25. Even while the roll-of-paper holder 25 remains attached to the sheet feeder 3, the paper support 51 can be additionally attached to the roll-of-paper holder 25. As a result, even when a roll of paper is not used, a single sheet of cut paper which is long in the feeding direction can be used by means of assistance of the paper support 51 and without involvement of removal of the roll-of-paper holder 25, thus improving the ease of use of the paper feeder.

Paper Feeding Method

A method of feeding paper in the ink-jet recording apparatus of 20 the present invention will now be described by reference to FIGS. 53 through 67. Throughout these drawings, like reference numerals designate like elements. However, the reference numerals are irrelevant to those employed in other drawings. Hence, the reference numerals may designate different elements from those designated in other drawings.

Figure 53:
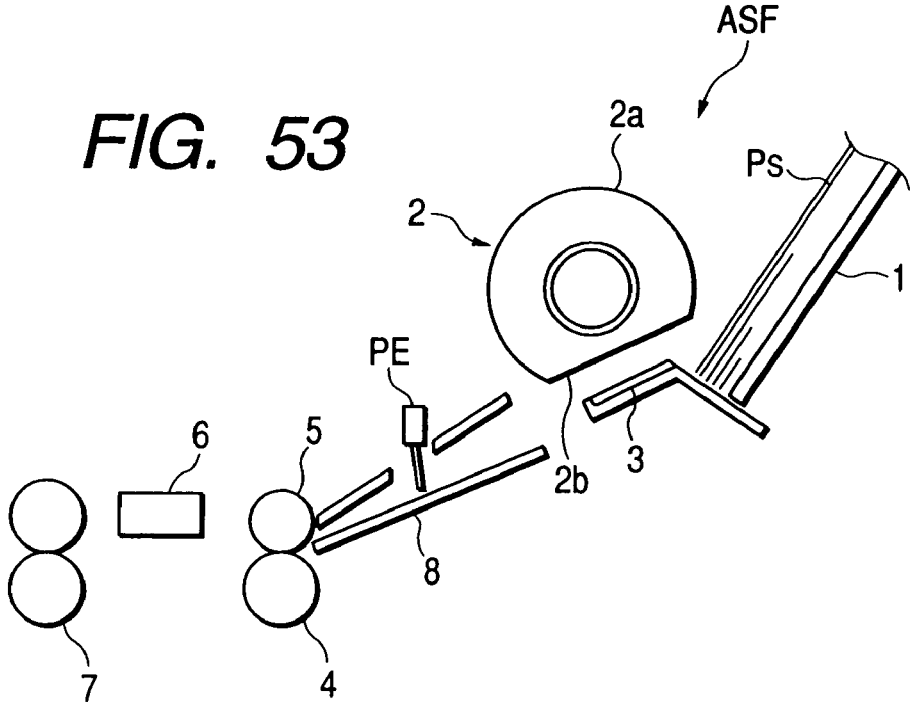
FIG. 53 is a diagrammatic representation showing a system for feeding a single sheet of cut paper in an ink-jet recording apparatus of the present invention.
Figure 54:
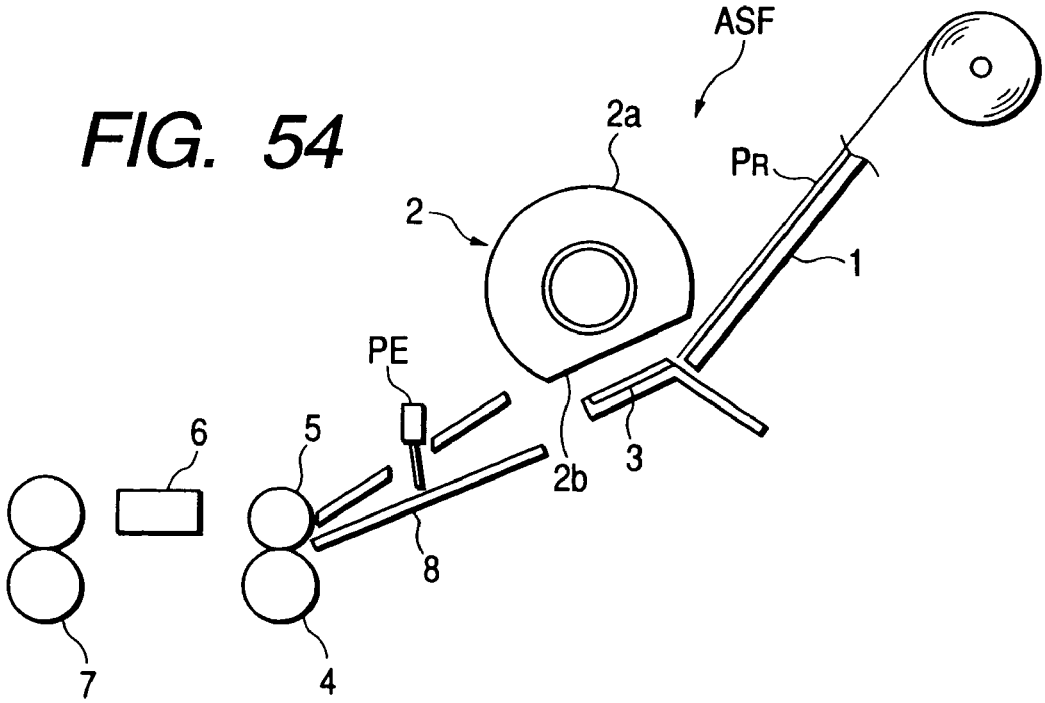
FIG. 54 is a diagrammatic representation showing a system for feeding a roll of paper in an ink-jet recording apparatus of the present invention.

FIG. 53 is a diagrammatic representation showing a system for feeding a single sheet of cut paper in an ink-jet recording apparatus of the present invention, and FIG. 54 is a diagrammatic representation showing a system for feeding a roll of paper in an ink-jet recording apparatus of the present invention. In the present embodiment, the expression "paper P" is employed in the description of paper feed control common to feeding of a single sheet of cut paper and feeding of a roll of paper.

The outline of a system for feeding a singe sheet of cut paper will be described by reference to FIG. 53. A paper feed apparatus ASF has the function of feeding, one by one, a plurality of single sheets of cut paper Ps stacked into layers. The paper feed apparatus ASF is essentially made up of a hopper 1 on which a plurality of single sheets of cut paper Ps stacked into layers are loaded; a paper feed roller 2 for picking up the top single sheet of cut paper Ps loaded on the hopper 1 and feeding the thus-picked up paper Ps; and a separation pad 3 for separating other sheets of cut paper Ps, which would otherwise be transported together with the top sheet of paper Ps, from the top sheet of paper Ps.

The paper feed roller 2 has a D-shaped side cross section and comprises a circular-arc section 2*a* which is to be brought into contact with the single sheet of cut paper Ps, and a linear section 2*b* which departs from the single sheet of cut paper Ps. At least the surface of the paper feed roller 2 is formed from high-friction material, such as rubber. During a single rotation of the paper feed roller 2 in which the circular arc section 2*a* remains in contact with the separation pad 3, one single sheet of cut paper Ps is fed to a conveyor roller 4 by way of a paper guide 8.

After skews have been eliminated from the single sheet of cut paper Ps by means of cooperation of the conveyor roller 4 and a driven roller 5, the single sheet of cut paper is advanced by a certain length, and the single sheet of cut paper Ps is delivered to the area of a recording head 6 constituting a recording section of the recording apparatus, in accordance with recording timing. In the region of the recording head 6, data are recorded on the single sheet of cut paper Ps, and the paper Ps having the data recorded thereon is output by means of an output roller 7.

The system for feeding a roll of paper will now be described by reference to FIG. 54. The single sheet of cut paper Ps is removed from the hopper 1, and a roll of paper $P_R$ is set to the paper feeder. The leading portion of the roll of paper $P_R$ is unwound, and the thus-unwound portion is placed on a single-sheet-of-paper loading section of the hopper 1. The leading end of the roll of paper $P_R$ is set to the same position at which the leading edge of the single sheet of cut paper Ps had been located. When feeding of paper is commenced, the hopper 1 is raised, and the paper feed roller 2 picks up the leading end of the roll of paper $P_R$, thus feeding the paper. The roll of paper is advanced without involvement of elimination of skew, and the paper $P_R$ is fed to the region of the recording head 6 in accordance with the recording timing, thus recording data on the paper. The roll of paper $P_R$ having the data recorded thereon is output by the output roller 7 and is cut by cutting means, such as a cutter, which is not accommodated in the ink-jet recording apparatus.

The example paper feeder to be used with the recording apparatus of the present invention is shown in FIGS. 47 through 49, which have been previously employed for description. As shown in FIGS. 47 through 49, the sheet feeder 3 for use with a single sheet of cut paper Ps, which is one of the principal constituent elements of the paper feeder 1 (ASF), is attached to an upper rear portion of a printer main unit (designated by two-dot chain lines), with an upward gradient. The sheet feeder 3 has a known structure.

Paper is unwound from the roll of paper $P_R$ by means of the feeding force exerted by the paper feed roller 2. Since the roll of paper $P_R$ is retained by the roll-of-paper holder 25 in an unrestricted manner, the roll of paper $P_R$ stretched by the paper feed roller 2 is excessively rotated by means of inertial force. As a result, paper is excessively unwound, whereupon slack arises in the paper. The slack absorbs back tension, which would otherwise be applied to the paper $P_R$ when the roll of paper $P_R$ is delivered to the print section, thus improving the accuracy of paper feeding operation.

Figure 55:
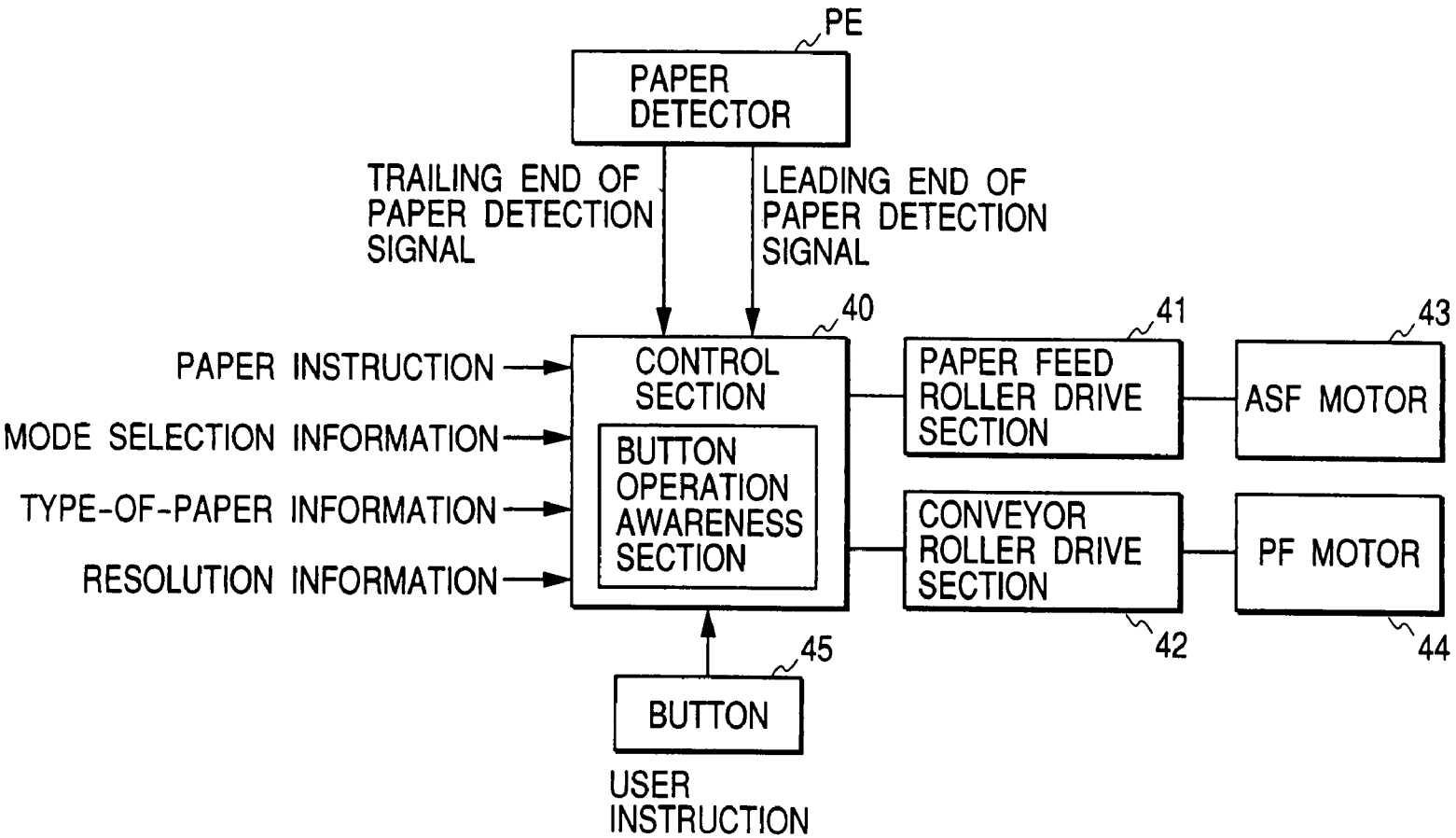
FIG. 55 is a block diagram showing a paper feed control block according to an embodiment of the present invention.

In the present embodiment, the paper feed roller 2 and the conveyor roller 4 are actuated independently by corresponding motors. The motors are controlled according to a selected paper feed sequence. FIG. 55 shows a paper feed control block.

A control section 40 receives print information output from a print driver of a main control section (not shown) or a like section of the recording apparatus. On the basis of determination of the print information, the control section 40 selects one from a plurality of paper feed sequences stored in the control section 40 in advance and executes the selected paper feed sequence through use of a paper feed instruction. On the basis of the result of detection of paper issued by a paper detector PE (e.g., a leading-end-of-paper detection signal or a trailing-end-of-paper detection signal), the control section 40 controls a paper feed roller drive section 41 and a conveyor roller drive section 42.

Print information comprises information (type-of-paper information) about the type of paper, such as plain paper, coated paper, an OHP sheet, glossy paper, a glossy film, or a post card; information about resolution (resolution information); and mode selection information about a feed rate, a single sheet of cut paper, a roll of paper, and feeding of paper by way of a control panel. The paper feed sequence is formed by combination of an operation for rotating the paper feed roller 2 and the conveyor roller 4 at a normal feed rate, an operation for rotating the paper feed roller 2 at a rate faster than the ordinary feed rate (i.e., a high-speed mode), and an operation for rotating, in the forward or reverse direction, the paper feed roller 2 and the conveyor roller 4 at a normal feed rate.

The control section 40 stores a first paper removal routine and a second paper removal routine. According to the first paper removal routine, there is performed an operation for outputting, to the outside of the ink-jet recording apparatus, the paper which has been fed by way of a control panel by means of causing the paper to advance. According to the second paper removal routine, there is performed an operation for outputting, to the outside of the ink-jet recording apparatus, the paper which has been fed by way of a control panel by means of causing the paper to move in reverse. After advancing the paper over a certain distance has been completed, either the first or second paper removal routine is performed in accordance with an instruction from the user. In a case where the user issues an instruction by means of actuation of a button 45 provided on the control panel, a button operation awareness section 40A gains awareness of operation of the button 45, thus determining a paper removal routine to be executed and executing the thus-determined routine. The button operation awareness section 40A gains awareness of the way of operation of an existing button (e.g., a control panel paper feed button or a control panel paper output button), the time required for the user to operate the existing button, the way of operation of a paper removal button which can be used for removing a single sheet of cut paper as well as for removing a roll of paper, the time required for the user to operate the paper removal button, operation of a single-sheet-of-paper output button, and operation of a roll-of-paper output button.

Figure 56:
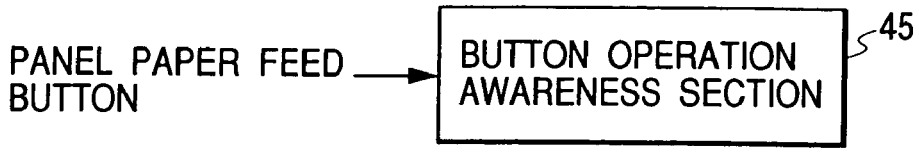
FIG. 56 is a block diagram in which a known panel paper feed button is used as a button to be used for instructing execution of a paper removal routine according to the method of feeding paper to the ink-jet recording apparatus of the present invention.
Figure 57:
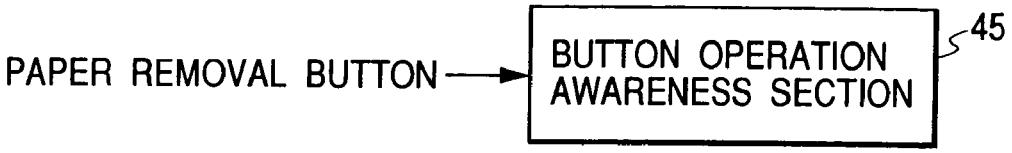
FIG. 57 is a block diagram in which a single button is used as a button for instructing execution of a first paper removal routine and a second paper removal routine according to the method of feeding paper to the ink-jet recording apparatus of the present invention.
Figure 58:
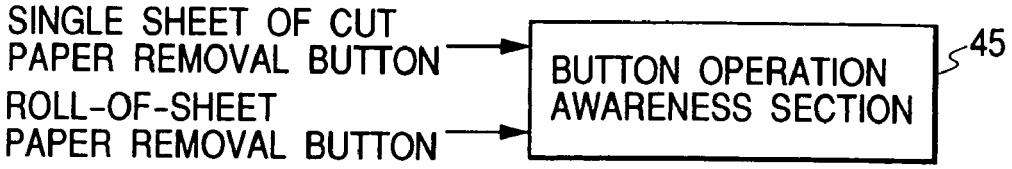
FIG. 58 is a block diagram in which a specific button is used as a button for instructing execution of a first paper removal routine and another specific button is used as a button for instructing execution of a second paper removal routine according to the method of feeding paper to the ink-jet recording apparatus of the present invention.

There will now be described an embodiment of the button 45. FIG. 56 shows an example use of a known panel paper feed button. The control panel paper feed button is for issuing a paper feed instruction. The control panel paper feed button does not follow an ordinary paper feed instruction operation but is actuated according to, for example, the length of time during which the control panel paper feed button is actuated. FIG. 57 shows an example button by which the user issues an instruction for executing the first paper removal routine or the second paper removal routine. Such an operation of the button is embodied by combination of different operations of the paper removal button. FIG. 58 show an example button specifically designed for instructing execution of the first paper removal routine and an example button specifically deigned for instructing execution of the second paper removal routine. Execution of the appropriate paper removal routine is effected by operation of a button specifically designed for the routine (i.e., a single-sheet-of-cut-paper removal button and a roll-of-paper removal button).

The first and second paper removal routines will now be described by reference to diagrammatic illustrations. In the description, the expression "button" typifies buttons shown in FIGS. 56 through 58.

Figure 59A:
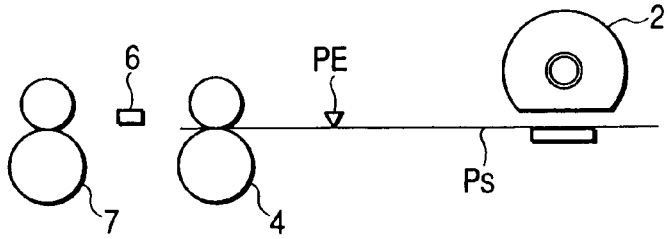
Figure 59B:
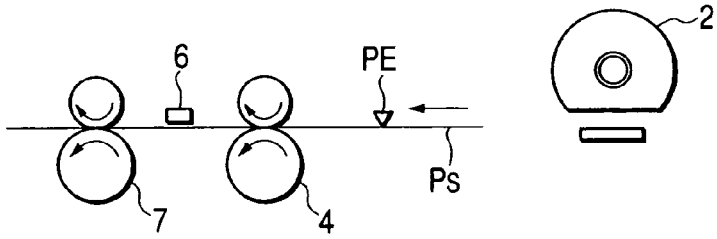
Figure 60:
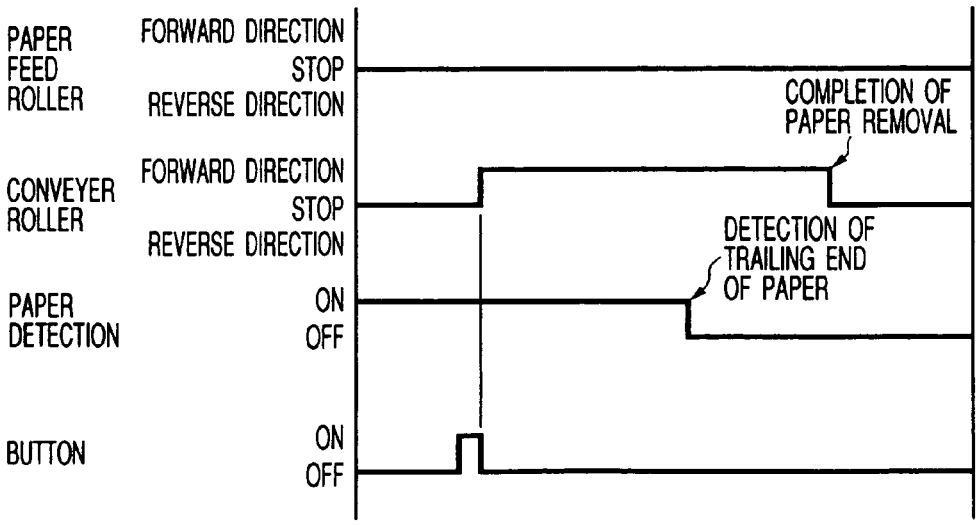
FIG. 60 is a timing chart of the first paper removal routine.

FIGS. 59A and 59B are schematic representations of the first paper removal routine; and FIG. 60 is a timing chart of the first paper removal routine. The first paper removal routine corresponds to an output operation applied to a single sheet of cut paper. After advancement of the top of the single sheet of cut paper over a certain distance has been completed in the control panel paper feed mode (see FIG. 59A), the single sheet of cut paper is advanced to the outside of the ink-jet recording apparatus, by means of operation of the button provided on the control panel (see FIG. 59B).

Figure 61A:
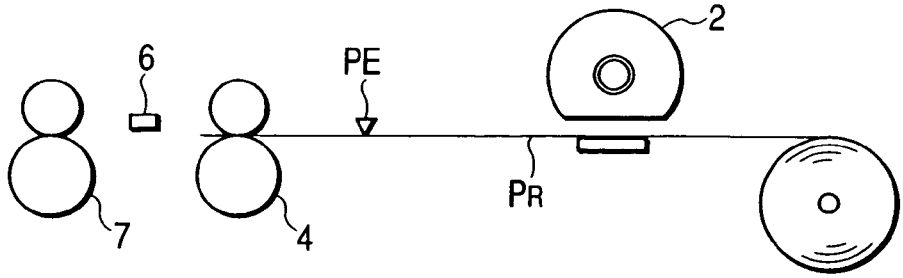
Figure 61B:
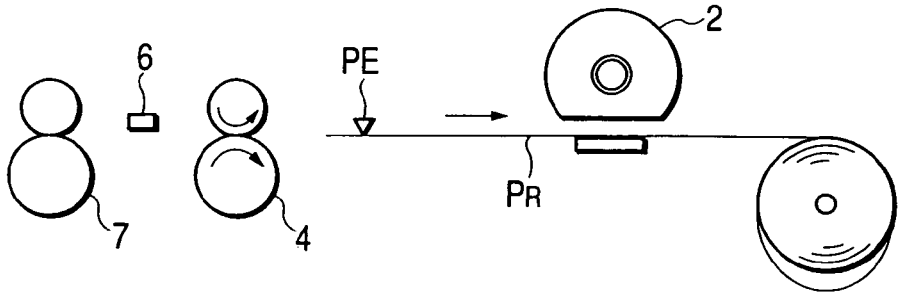
Figure 62:
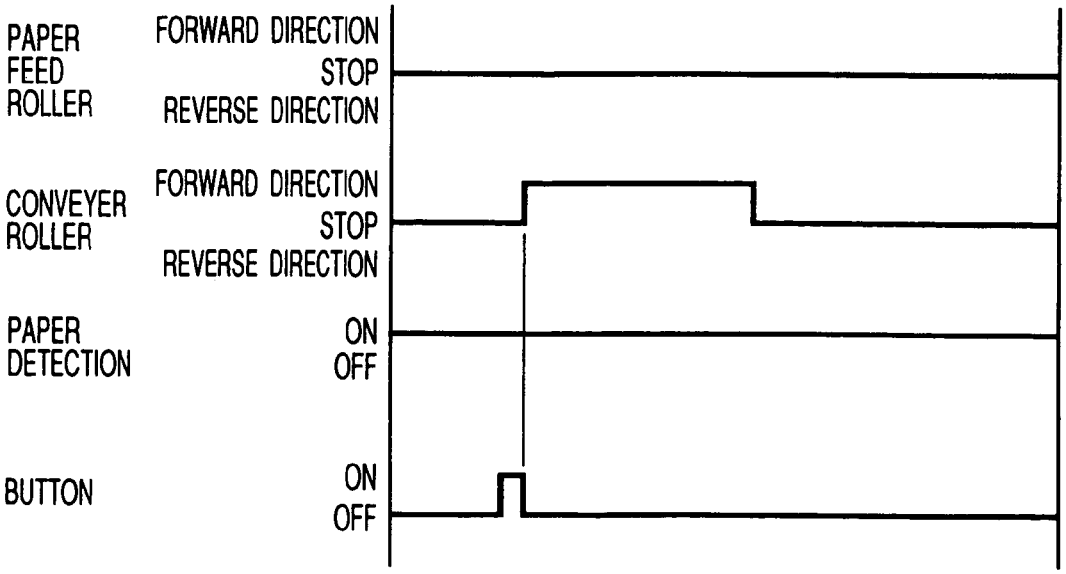
FIG. 62 is a timing chart of the second paper removal routine.
Figure 63A:
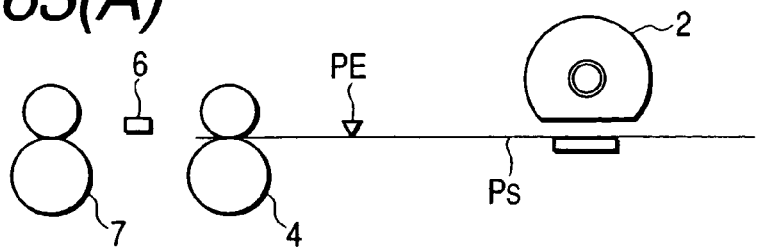
FIG. 63A is a schematic representation showing a state in which advancing both the top of recording medium over a certain distance has been completed and the top of a roll of paper over a certain distance have been completed, by means of combination of the first and second paper removal routines.
Figure 63B:
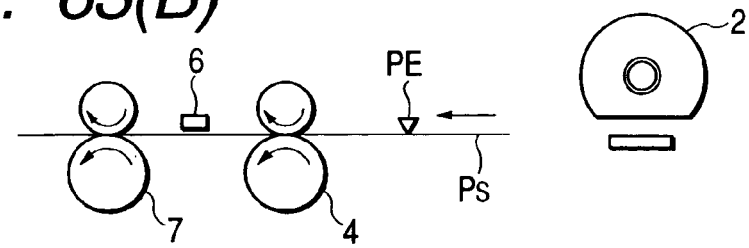
FIG. 63B shows forward advancement of a single sheet of cut paper.
Figure 63C:
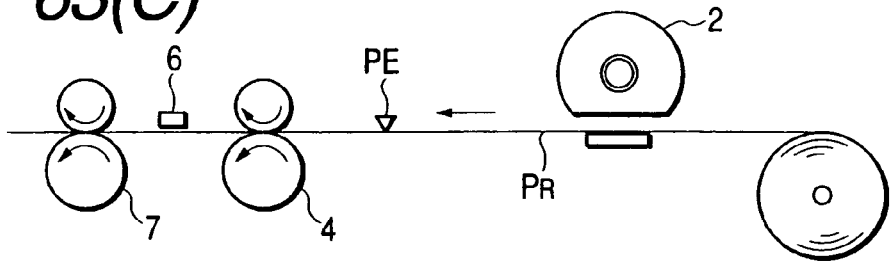
FIG. 63C shows forward advancement of a roll of paper.
Figure 63D:
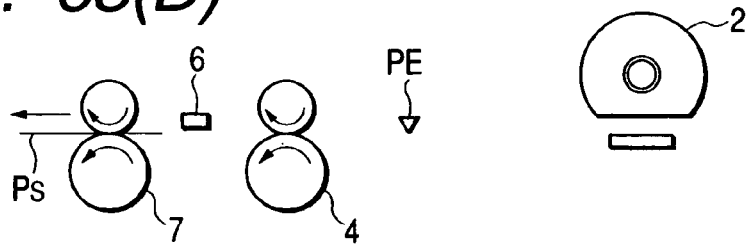
FIG. 63D shows forward output of the single sheet of cut paper.
Figure 63E:
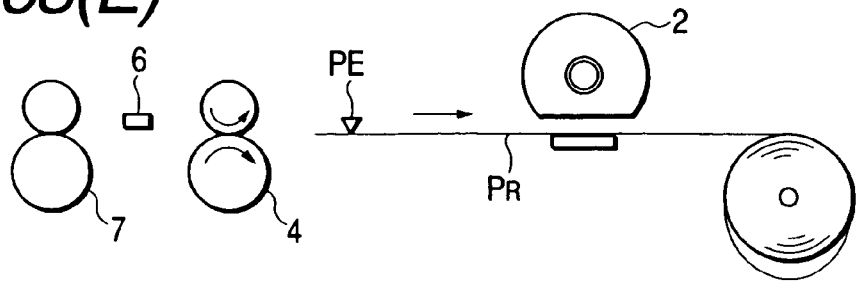
FIG. 63E shows reverse output of the roll of paper.

FIGS. 61A and 61B are schematic representations of the second paper removal routine; and FIG. 62 is a timing chart of the second paper removal routine. The second paper removal routine corresponds to an output operation applied to a roll of paper. After advancement of the top of the roll of paper over a certain distance has been completed in the control panel paper feed mode (see FIG. 61A), the single sheet of cut paper is moved in reverse to the outside of the ink-jet recording apparatus, by means of operation of the button provided on the control panel (see FIG. 61B).

Figure 64:
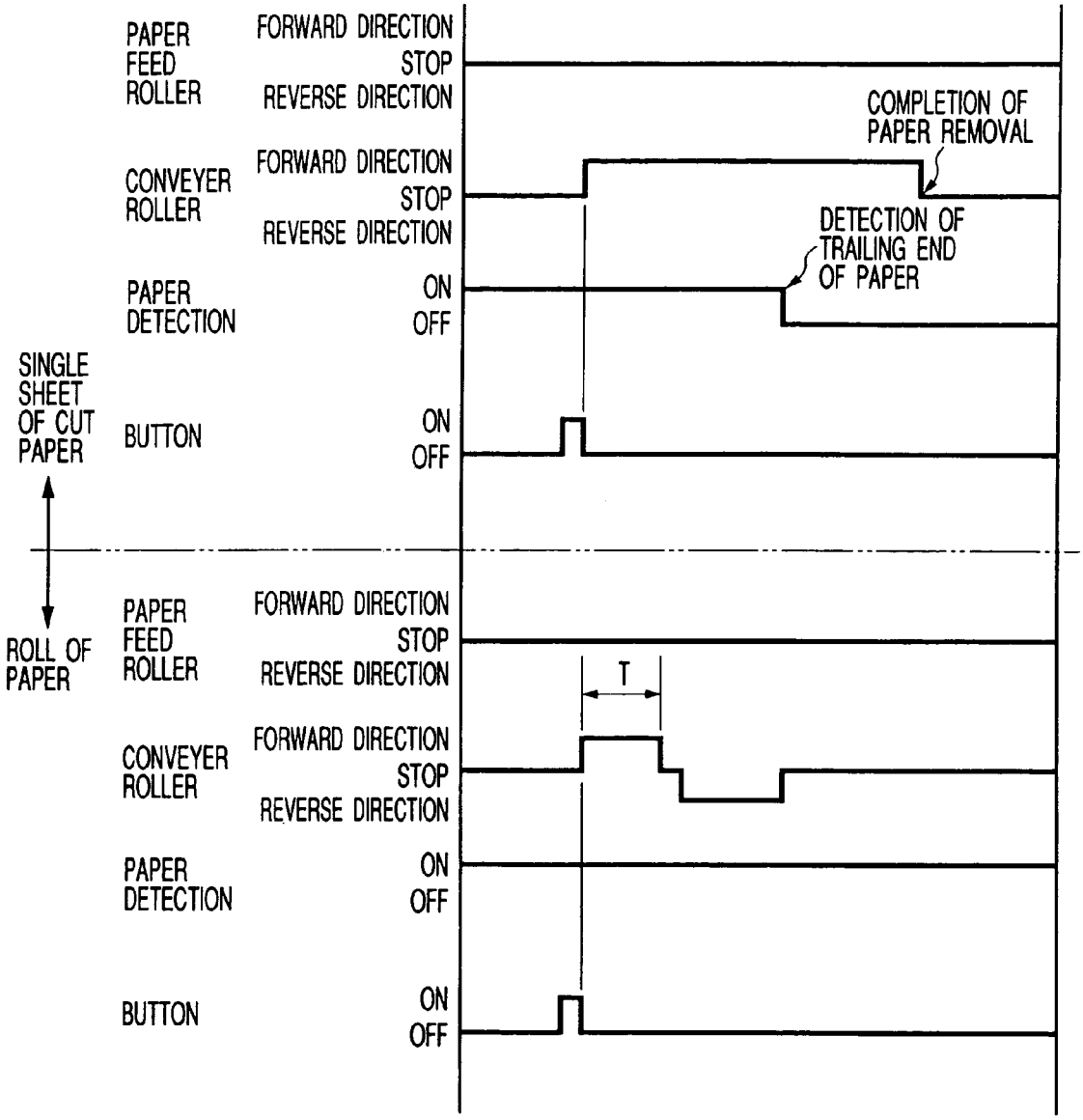
FIG. 64 is a timing chart showing execution of the first and second paper removal routines in combination.

FIGS. 63A through 63E are schematic representations showing execution of the first and second paper removal routines in combination. FIG. 64 is a timing chart showing execution of the first and second paper removal routines in combination. In the present embodiment, the paper fed into the recording apparatus is determined to be a single sheet of cut paper or a roll of paper, by means of determining whether or not the trailing end of paper has been detected within a predetermined period of time. Subsequently, a paper removal operation suitable for the nature of the thus-determined paper is performed. If the user operates a button while the recording apparatus is in the state shown in FIG. 63A, the first paper removal routine is executed. The conveyor roller 4 is rotated forward, thus advancing the paper (see FIGS. 63B and 63C). In a case where the trailing end of the paper is detected within a predetermined period of time, the first paper removal routine to be applied to a single sheet of paper is performed continuously, and the forward rotation of the conveyor roller 4 is also continued (see FIG. 63D). In contrast, if the trailing end of the paper has not been detected within a predetermined period of time, the routine is switched to the second paper removal routine to be applied to a roll of paper, whereupon the paper feed roller 2 and the conveyor roller 4 are rotated in reverse (see FIG. 63E).

Figure 65:
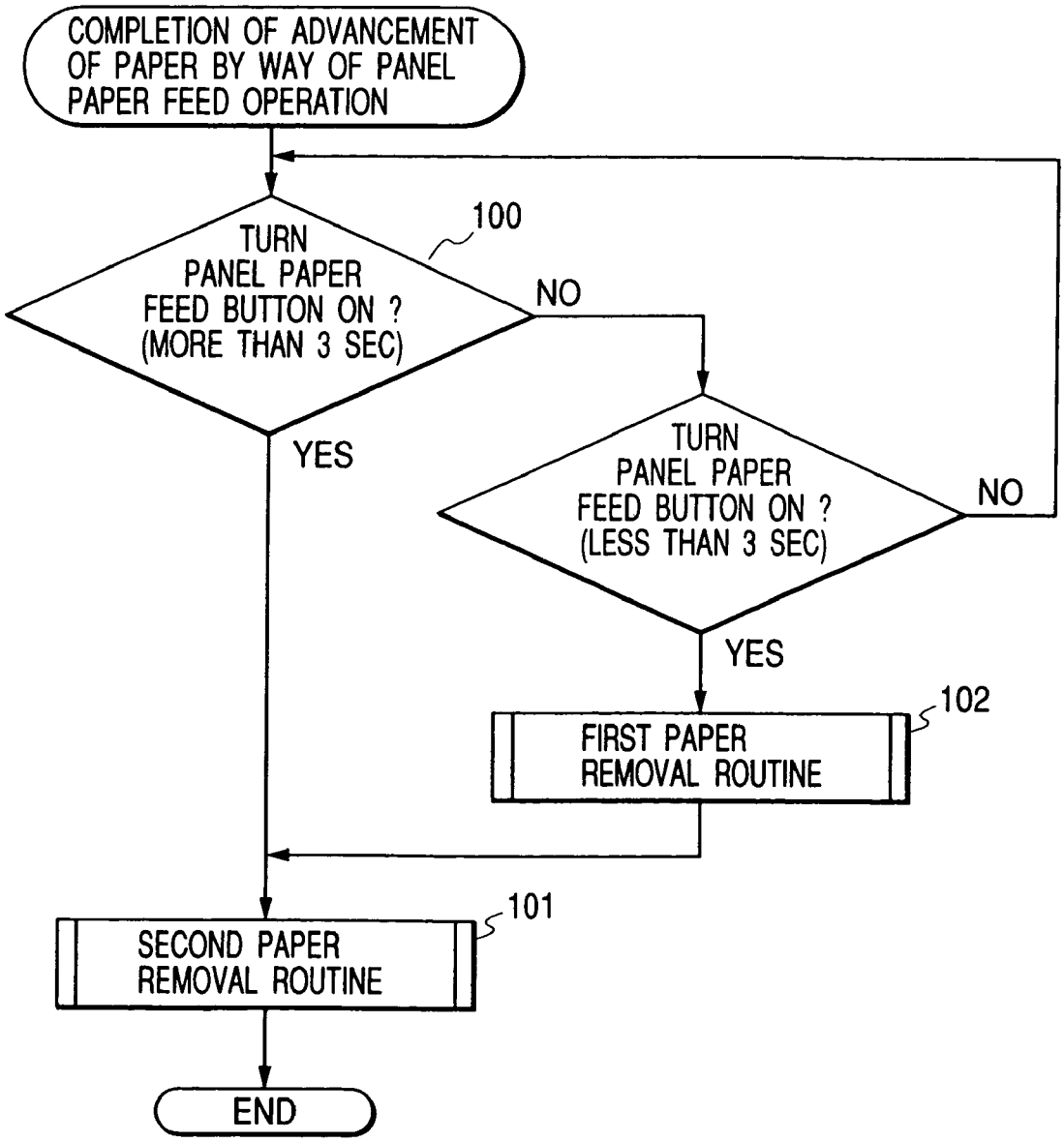
FIG. 65 shows a paper removal routine by which removal of paper is selectively performed by means of determination of the length of the time during which the control panel paper feed button is actuated.

A specific example of paper removal will now be described. FIG. 65 shows a paper removal routine by which removal of paper is selectively performed by means of determination of the length of the time during which the control panel paper feed button is actuated. The paper removal routine shown in FIG. 65 corresponds to processing to be performed after advancement of the top of the paper over a certain distance has been completed by means of feeding the paper by way of the control panel.

In FIG. 65, a determination is made as to whether or not the control panel paper feed button has been activated for more than three seconds. Further, when the control panel paper feed mode is selected, interaction is adopted. If the control panel paper feed button is not operated before execution of a routine, processing pertaining to the routine is suspended. Accordingly, it is desirable to inform the user of the relationship between the contents of the next routine to be executed and the operation time of a button, as well as to prompt the user to operate the control panel paper feed button by means of outputting a beeping sound.

After advancement of the top of the paper over a certain distance has been completed, the user operates the control panel paper feed button, whereupon the time required for the user to operate the control panel paper feed button is determined (step 100). If the button is pressed for three seconds or more, the second paper removal routine to be described later is executed (step 101). In contrast, if the button is pressed for less than three seconds, the first paper removal routine to be described later is executed (step 102).

Figure 66:
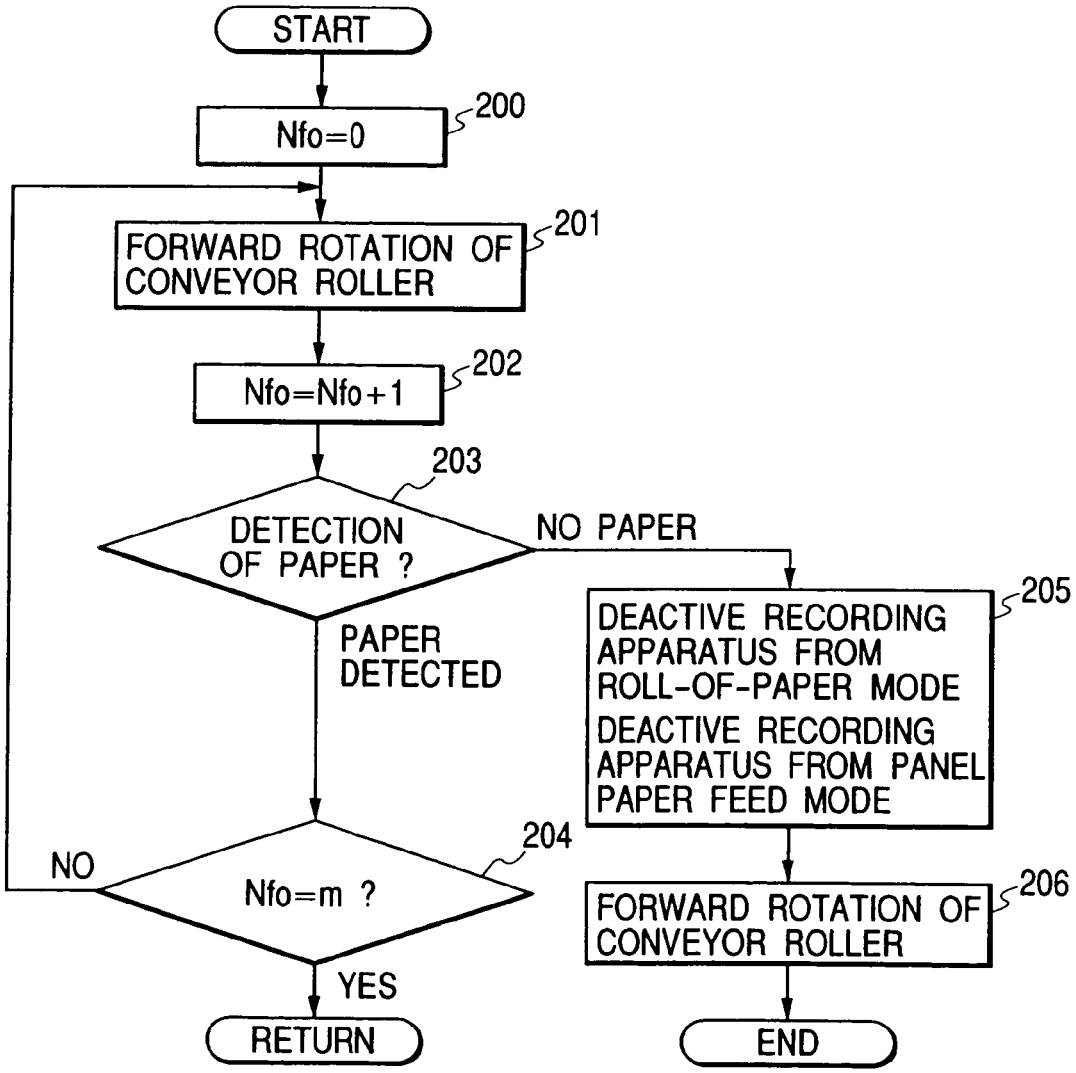
FIG. 66 is a flowchart showing the flow of the first paper removal routine according to the present embodiment.

According to the first paper removal routine of the present embodiment, the trailing end of the paper is detected through use of a paper detector, to thereby determine whether the paper is a single sheet of cut paper or a roll of paper, thus causing subsequent processing to branch. A determination as to whether or not the paper is a single sheet of cut paper or a roll of paper is made by utilization of the conveyor roller 4. If paper is detected when the conveyor roller 4 is rotated forward a predetermined number of rotations, the paper is determined to be a roll of paper. In contrast, if no paper is detected, the paper is determined to be a single sheet of cut paper. FIG. 66 is a flowchart showing the flow of the first paper removal routine according to the present embodiment. When the first paper removal routine is executed, a counter is set to Nfo=0 in order to count the number of rotations made by the conveyor roller A (step 200), and the conveyor roller 4 is rotated forward (step 201). The counter is then incremented (Nfo=Nfo+1) (step 202), and detection of paper is determined (step 203). If presence of paper is detected, a determination is made as to whether or not the count value Nfo has achieved "m" rotations (step 204). In the case of Nfo=m, the paper is determined to be a roll of paper, and processing exits the routine; that is, the forward rotation of the conveyor roller 4 is terminated. In contrast, in the case of Nfo≠m, the forward rotation of the conveyor roller 4 is continued. If paper depletion is detected before Nfo=m is achieved, the paper is determined to be a single sheet of cut paper, thereby releasing the control section from the roll-of-paper mode and the control panel paper feed mode (step 205). Further, the conveyor roller 4 is rotated forward a predetermined number of rotations (step 206).

Figure 67:
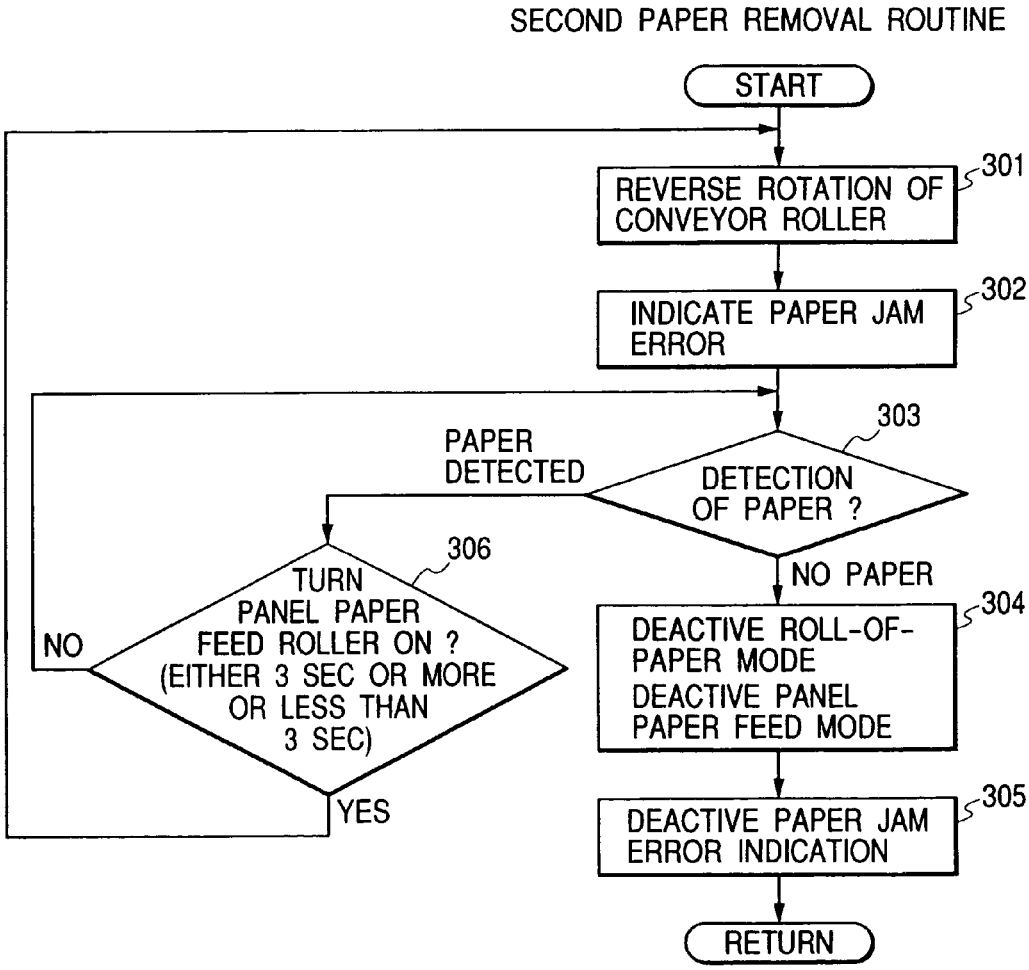
FIG. 67 is a flowchart showing the flow of the second paper removal routine according to the present embodiment.

FIG. 67 is a flowchart showing the flow of the second paper removal routine according to the present embodiment. When the second paper removal routine is executed, the conveyor roller 4 is rotated in reverse a given number of rotations (step 301). In this operation, the paper can be moved backward only until presence of paper is detected; specifically, when the paper enters the detection range of the paper detector. Accordingly, a paper jam error message is indicated in order to prompt the user to manually remove the paper (step 302). After removal of the paper, the paper detector again determines whether or not paper is present (step 303). The control section deactivates the roll-of-paper mode and the panel paper feed mode (step 304), and, further, deactivates indication of the paper jam error message (step 305). If presence of paper is detected in step 303, the user presses the control panel paper feed button (the time during which the button is pressed is not counted) (step 306). Actuation of the control panel paper feed button resumes reverse rotation of the conveyor roller 4 (step 301), to thereby move the paper backward over a predetermined distance. The round of operations is continued until the paper can be removed from the paper feeder.

According to the paper feed method of the present embodiment, the user instructs removal of the current paper before execution of a printing operation and after advancement of the top of the paper over a certain distance has been completed in the panel paper feed mode, thereby eliminating wastage of paper and rendering a printing operation economical. In the recording apparatus of the present embodiment, a roll of paper is set on the paper feeder through use of the hopper for use with a single sheet of cut paper, thus rendering the recording apparatus compact and easy to operate. Further, the edge guide of the hopper doubles as a guide for a roll of paper. Therefore, even if the leading edge of the roll of paper is cut obliquely, the roll of paper can be properly advanced over a certain distance in the feeding direction. Moreover, the recording apparatus yields the same advantages as those yielded by the paper feed method.

What is claimed is:

1. An ink-jet recording apparatus comprising:

a recording head having a dot formation element array including a plurality of dot Formation elements arranged in a first direction; and a platen operable to hold a recording medium in a position opposite to the recording head, the platen having a first hole formed in a substantially center area in the first direction of the platen, and which guides ink that has been discarded outside at least one of a leading end and a trailing end of the recording medium when data are recorded on the recording medium without leaving a margin on at least one of the leading end and the trailing end of the recording medium, wherein the first hole has a size in the first direction which is less than an entire portion of the dot formation element array.

2. The ink jet recording apparatus as set forth in claim 1, wherein:

the recording head is operable to selectively perform a standard interlaced recording operation in which all of the dot formation elements are driven, and a limited interlaced recording operation in which a part of the dot formation elements is driven; and the limited interlaced recording operation is performed in a case where at least one of the leading end and the trailing end of the recording medium is situated above the first hole.

* * * * *